US008953986B2

(12) United States Patent
Yoshida et al.

(10) Patent No.: US 8,953,986 B2
(45) Date of Patent: Feb. 10, 2015

(54) POWDER CONTAINER, POWDER CONVEYING APPARATUS, AND IMAGE FORMING APPARATUS

(75) Inventors: Keiichi Yoshida, Kanagawa (JP); Shunji Katoh, Kanagawa (JP); Hiroshi Ikeguchi, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/643,718

(22) PCT Filed: Apr. 21, 2011

(86) PCT No.: PCT/JP2011/059871
§ 371 (c)(1),
(2), (4) Date: Oct. 26, 2012

(87) PCT Pub. No.: WO2011/136129

PCT Pub. Date: Mar. 11, 2011

(65) Prior Publication Data

US 2013/0039678 A1 Feb. 14, 2013

(30) Foreign Application Priority Data

| | | |
|---|---|---|
| Apr. 27, 2010 | (JP) | 2010-102628 |
| Apr. 27, 2010 | (JP) | 2010-102630 |
| Apr. 27, 2010 | (JP) | 2010-102634 |
| Sep. 22, 2010 | (JP) | 2010-212293 |
| Feb. 2, 2011 | (JP) | 2011-020866 |
| Feb. 8, 2011 | (JP) | 2011-024848 |
| Mar. 1, 2011 | (JP) | 2011-043866 |
| Mar. 14, 2011 | (JP) | 2011-055537 |

(51) Int. Cl.
*G03G 15/08* (2006.01)

(52) U.S. Cl.
CPC .... *G03G 15/0874* (2013.01); *G03G 2215/0132* (2013.01)
USPC ..... 399/262; 222/214

(58) Field of Classification Search
CPC ..... G03G 2215/0682; G03G 15/0874
USPC ..... 399/262
See application file for complete search history.

(56) References Cited

U.S. PATENT DOCUMENTS

| | | | |
|---|---|---|---|
| 6,549,744 | B2 | 4/2003 | Terazawa et al. |
| 6,678,492 | B1 | 1/2004 | Terazawa et al. |

(Continued)

FOREIGN PATENT DOCUMENTS

| | | |
|---|---|---|
| CN | 1259690 A | 7/2000 |
| JP | 60-115255 | 8/1985 |

(Continued)

OTHER PUBLICATIONS

Combined Office Action and Search Report issued Aug. 22, 2013 in Taiwanese Patent Application No. 100114464 (with English Translation and English Translation of Category of Cited Documents).

(Continued)

*Primary Examiner* — Clayton E Laballe
*Assistant Examiner* — Leon W Rhodes, Jr.
(74) *Attorney, Agent, or Firm* — Oblon, Spivak, McClelland, Maier & Neustadt, L.L.P.

(57) ABSTRACT

A powder container includes: a powder containing unit which has an opening portion formed at one end portion thereof, contains a powder therein, and is formed of a flexible material; a discharging unit which is provided in the end portion provided with the opening portion, is fixed to a powder conveying apparatus, and discharges the powder delivered from the opening portion out to the powder conveying apparatus; and a portion to be locked which is provided in an end portion opposite to the opening portion and is locked to a locking portion of the powder conveying apparatus while a delivery member is biased in a direction opposite to the movement direction. When the delivery member is pressed inward from the outside of the powder containing unit so as to move toward the opening portion, the powder is delivered out from the opening portion.

19 Claims, 36 Drawing Sheets

(56) References Cited

U.S. PATENT DOCUMENTS

| | | | |
|---|---|---|---|
| 7,826,786 | B2 | 11/2010 | Suda et al. |
| 2001/0041083 | A1 | 11/2001 | Terazawa et al. |
| 2002/0025195 | A1 | 2/2002 | Iwata et al. |
| 2002/0025196 | A1 | 2/2002 | Matsumoto et al. |
| 2003/0012586 | A1 | 1/2003 | Iwata et al. |
| 2003/0235435 | A1 | 12/2003 | Muramatsu et al. |
| 2004/0091289 | A1 | 5/2004 | Terazawa et al. |
| 2004/0253023 | A1 | 12/2004 | Terazawa et al. |
| 2005/0089347 | A1 | 4/2005 | Muramatsu et al. |
| 2005/0152722 | A1 | 7/2005 | Tawada et al. |
| 2005/0249533 | A1 | 11/2005 | Suda et al. |
| 2006/0067727 | A1 | 3/2006 | Suda et al. |
| 2007/0081832 | A1 | 4/2007 | Yoshida et al. |
| 2007/0104516 | A1 | 5/2007 | Katoh et al. |
| 2007/0212116 | A1 | 9/2007 | Itoh et al. |
| 2009/0116864 | A1 | 5/2009 | Ino et al. |
| 2009/0136257 | A1 | 5/2009 | Hattori et al. |
| 2009/0190960 | A1 | 7/2009 | Hirayama et al. |
| 2011/0058858 | A1 | 3/2011 | Fukuda et al. |
| 2012/0099902 | A1 | 4/2012 | Yoshida et al. |
| 2012/0219318 | A1 | 8/2012 | Yoshida et al. |

FOREIGN PATENT DOCUMENTS

| | | |
|---|---|---|
| JP | S60-115255 | 8/1985 |
| JP | 4-201860 | 7/1992 |
| JP | H04-356078 | 12/1992 |
| JP | 6-69961 U | 9/1994 |
| JP | H10-063072 | 3/1998 |
| JP | H11-143195 | 5/1999 |
| JP | 2000-356898 | 12/2000 |
| JP | 2001-100506 | 4/2001 |
| JP | 2001-194907 | 7/2001 |
| JP | 2002-046843 | 2/2002 |
| JP | 2002-53113 | 2/2002 |
| JP | 2002-072645 | 3/2002 |
| JP | 2002-278237 | 9/2002 |
| JP | 2003-195617 | 7/2003 |
| JP | 2004-078252 | 3/2004 |
| JP | 2004-101718 | 4/2004 |
| JP | 3554162 | 5/2004 |
| JP | 2004-185038 | 7/2004 |
| JP | 2005-017789 | 1/2005 |
| JP | 2005-024603 | 1/2005 |
| JP | 2005-091879 | 4/2005 |
| JP | 2005-107524 | 4/2005 |
| JP | 2005-173543 | 6/2005 |
| JP | 2007-121471 | 5/2007 |
| JP | 2007-148277 | 6/2007 |
| JP | 2007-241147 | 9/2007 |
| JP | 2009-020233 | 1/2009 |
| JP | 2009-116046 | 5/2009 |

OTHER PUBLICATIONS

International Search Report issued May 24,2011 in PCT/JP2011/059871 filed Apr. 21, 2011.

Japanese Office Action issued Jan. 28, 2014, in Japan Patent Application No. 2010-102634.

Japanese Office Action issued Jan. 28, 2014, in Japan Patent Application No. 2010-102628.

Office Action issued Aug. 5, 2014 in Chinese Patent Application No. 201180030242.X.

Japanese Office Action mailed Jul. 17, 2014 for Japanese Patent Application No. 2010-212293.

Office Action issued Oct. 17, 2014 in Japanese Patent Application No. 2011-024848.

(a)

(b)

(c)

(a)

(b)

(a)

(b)

(a)

(b)

(c)

(a)

(b)

(a)

(b)

(a)

(b)

(a)

(b)

(a)

(b)

(a)

(b)

(a)

(b)

POWDER CONTAINER, POWDER CONVEYING APPARATUS, AND IMAGE FORMING APPARATUS

FIELD

The present invention relates to a powder container that contains powder therein, a powder conveying apparatus that conveys the powder contained in the powder container to a discharging unit, and an image forming apparatus that includes the same.

BACKGROUND

Electrophotographic image forming apparatuses, such as copiers, printers, facsimile machines, or multifunction peripherals having functions of copiers, printers and facsimile machines, generally form images by causing developing devices to form toner images with developer called toner or carrier. In such image forming apparatuses, toner is consumed through image formation; therefore, in general, toner cartridges containing toner are attached to the image forming apparatuses and when the toner cartridges become empty of the toner, the toner cartridges are replaced with new ones in order to replenish new toner.

In a toner supply system using the cartridges as described above, there is a user's demand to use up all toner in the cartridges in order to reduce running costs. Therefore, various methods have been employed, such as a method in which what is called a screw bottle that is a cylindrical container provided with an inner-mounted spiral protrusion is used as a toner cartridge and toner is gradually conveyed to a discharging unit by rotating the container, or a method in which a screw typically called an auger is provided inside the container and toner is conveyed to a discharging unit by rotating the screw.

In the conveying system using the auger, it is needed to arrange and rotate the screw inside the container, so that the configuration becomes complicated. Furthermore, in this conveying system, because a stack of toner is forcibly conveyed by the auger, load is applied to the toner and the toner may be aggregated or deteriorated. Moreover, arranging the screw inside the container that is a replaceable part leads to increase in costs of consumables, so that environmental loads increase because of resource consumption.

On the other hand, in the conveying system using the screw bottle, it is not needed to arrange a screw inside the container. Therefore, the configuration becomes simple. However, in this conveying system, because the container itself is rotated when it is used, the container usually has a shape of a cylinder with an outlet arranged on one side surface of the body thereof (a shape like a bottle being laid down). Therefore, the container is disadvantageous in that the capacity for housing toner becomes smaller than a container in a rectangular-solid shape or the container may be too slippery for a person to hold when the container is replaced.

Alternatively, as a toner conveying system that does not use the screw bottle and the auger, there is a method in which a container is caused to oscillate (reciprocating movement) by applying shock to the container from outside or by bringing the container into contact with a stopper so that toner can be moved and discharged with the aid of the inertia force thereof (see Japanese Laid-open Patent Publication No. 2002-46843). In this system, when a large amount of toner is contained, the toner stacked in the container collectively moves by the oscillation, so that a satisfactory toner conveying speed can be assured per reciprocating oscillation. However, as the amount of toner in the container decreases, a stack of the toner collapses and the toner is thinly spread, so that the toner conveying speed per reciprocating oscillation decreases with a decrease in the height of the stack of the toner. Therefore, the conveying speed cannot be maintained. Furthermore, a writing system may be influenced by the oscillation of the container and image distortion may occur. Moreover, it takes a long time to fluidize the toner or the toner may be aggregated (blocked) due to an action similar to tapping that occurs by the oscillation.

Further, as a conveying type different from the respective conveying types, there is proposed a type in which a deformable container is used and a convex member is pressed and moved from the outside of the container so as to deliver a toner therein (see Patent Literature 2). According to such a conveying type, the toner may be conveyed with a small stress. Then, the aggregation or the degradation of the toner may be suppressed and there is a low possibility that an abnormal image may be generated by a large vibration or an impact.

Patent Literature 1: Japanese Patent Application Laid-open No. 2002-46843

Patent Literature 2: Japanese Patent Application Laid-open No. 11-143195

SUMMARY

Technical Problem

However, in the conveying type that uses the deformable container, the toner is gradually crushed in the convex member as the toner delivery operation is repeated, and hence it becomes difficult for the toner to move inside the container as time goes by. As a result, there is a problem in which the toner may not be easily conveyed. Further, the container is deformed into an unexpected shape when the toner is pressed toward a discharge port by the convex member. Accordingly, there is a concern that the toner may not be stably discharged or the container may not be deformed into an appropriate shape. Further, the entire container moves by the pressing force generated by the convex member. Accordingly, there is a concern that the toner may not be delivered and the toner inside the container may not be delivered to the last.

The invention is made in view of the above-described circumstances, and it is an object of the invention to provide a powder container, a powder conveying apparatus, and an image forming apparatus capable of stabilizing a powder conveying amount and decreasing powder amount that is remained therein.

Solution to Problem

According to first aspect of the invention, there is provided a powder container that includes: a powder containing unit which has an opening portion formed at one end portion thereof, contains a powder therein, and is formed of a flexible material so as to be deformable; a discharging unit which is provided in the end portion provided with the opening portion, is fixed to a powder conveying apparatus, and discharges the powder delivered from the opening portion out to the powder conveying apparatus; and a portion to be locked which is provided in an end portion opposite to the opening portion and is locked to a locking portion of the powder conveying apparatus while a delivery member, moved from the outside of the powder containing unit to the opening portion, is biased in a direction opposite to the movement direction. When the delivery member is pressed inward from the outside of the powder containing unit so as to move toward the opening portion, the powder is delivered out from the opening portion.

Since the portion to be locked is locked to the counter locking portion, it is possible to suppress an uneven deformation of the powder containing unit with the powder delivery operation, and hence to suppress a powder conveying failure.

According to second aspect of the invention, the powder container further includes: an air passage portion which enables passage of air between the inside and the outside of the powder container.

When the powder containing unit is pressed and deformed inward so as to deliver the powder therein toward the discharging unit, it is possible to discharge the air inside the powder containing unit from the air passage portion to the outside with the deformation. Accordingly, it is possible to prevent an increase in internal pressure with the deformation of the powder containing unit, and hence to prevent a problem in which the powder discharging amount becomes excessively large and the powder scatters in the conveying destination.

Further, since the powder containing unit expands due to the restoring property thereof or the weight of the powder after the powder delivery operation, it is possible to suction air from the air passage portion. In this way, since the air is suctioned into the powder containing unit through the air passage portion, the powder may be scattered by the suctioned air while the powder containing unit expands so as to be easily returned to the original shape. Accordingly, it is possible to improve the powder conveying performance and to stably convey the powder.

According to third aspect of the invention, the air passage portion is provided in the powder containing unit.

In this case, since the air may be suctioned at a position close to the contained powder, it is possible to improve the powder scattering effect.

According to forth aspect of the invention, the air passage portion is provided in an upper surface of the powder containing unit.

Since the air passage portion is provided in the upper surface of the powder containing unit, it is possible to prevent the air passage portion from being clogged with the powder.

According to fifth aspect of the invention, the powder containing unit is configured as a member that has an air passage property.

In this case, since there is no need to separately provide the air passage hole or the filter in the powder containing unit so as to form the air passage portion, the number of components decreases, and the above-described operation and effect may be easily realized. Further, since the clogging is hard to occur compared to the case where the filter is partially provided, it is possible to ensure the air passage property for a long period of time. In addition, since problem such that the air passage portion is deformed or damaged or the filter is peeled with the deformation of the powder containing unit is hard to occur, the reliability improves.

According to sixth aspect of the invention, the air passage portion is provided in the discharging unit.

In this case, air is easily discharged particularly around the discharging unit, and hence the spouting of the powder may be highly prevented.

According to seventh aspect of the invention, the air passage portion is provided in an upper surface of the discharging unit and provided in such a manner to oppose the air passage portion provided in the discharging unit.

Since the air passage portion is provided in the upper surface of the discharging unit, it is possible to prevent the air passage portion from being clogged by the powder. Further, since the air passage portion is disposed so as to face the discharge port, the discharge of air may be further effectively performed.

According to eighth aspect of the invention, there is provided a powder conveying apparatus that includes: a powder container which includes a powder containing unit having an opening portion formed at one end portion thereof, containing a powder therein, and being formed of a flexible material so as to be deformable; a delivery member which delivers the powder from the opening portion by pressing the powder containing unit inward from the outside thereof so as to move the powder toward the opening portion; a discharging unit which is provided in the end portion provided with the opening portion of the powder containing unit, is fixed to the powder conveying apparatus, and discharges the powder delivered from the opening portion to the powder conveying apparatus; and a portion to be locked which is provided in one end portion opposite to the opening portion of the powder containing unit and is locked to a locking portion of the powder conveying apparatus while being biased in a direction opposite to the movement direction of the delivery member.

Since the end portion of the powder container is locked to the locking portion, it is possible to suppress an uneven deformation of the powder containing unit with the powder delivery operation, and hence to suppress a powder conveying failure.

According to ninth aspect of the invention, the locking portion is configured to be movable toward the discharging unit and to be movable in the opposite direction thereto, and the portion to be locked is biased toward the direction opposite toward the discharging unit through an elastic member.

In this case, since the powder containing unit is pressed toward the discharging unit by the moving delivery member during the powder delivery operation, the locking portion which locks the end portion of the powder container is also pulled toward the discharging unit. However, the locking portion is returned in a direction opposite to the discharging unit by the biasing force of the elastic member after that time. Accordingly, it is possible to suppress an uneven deformation of the powder containing unit with the powder delivery operation, and hence to suppress a powder conveying failure.

According to tenth aspect of the invention, the powder container is provided with an air passage portion which enables passage of air between the inside and the outside of the powder container.

When the powder containing unit is deformed by being pressed inward by the delivery member during the powder delivery operation, the air inside the powder containing unit is discharged to the outside through the air passage portion with the deformation. Accordingly, it is possible to prevent an increase in internal pressure with the deformation of the powder containing unit, and hence to prevent a problem in which the powder discharging amount becomes excessively large and the powder scatters in the destination conveyed.

Further, since the powder containing unit expands due to the restoring property thereof or due to the weight of the powder after the powder delivery operation, it is possible to suction air from the air passage portion. In this way, since the air is suctioned into the powder containing unit through the air passage portion, the powder may be scattered by the suctioned air while the powder containing unit expands so as to be easily returned to the original shape. Accordingly, it is possible to improve the powder conveying performance and to stably convey the powder.

According to eleventh aspect of the invention, the air passage portion is provided in the powder containing unit.

In this case, since the air may be suctioned at a position close to the contained powder, it is possible to improve the powder scattering effect.

According to twelfth aspect of the invention, the air passage portion is provided on an upper surface of the powder containing unit.

Since the air passage portion is provided in the upper surface of the powder containing unit, it is possible to prevent the air passage portion from being clogged by the powder.

According to thirteenth aspect of the invention, the air passage portion is provided in the discharging unit.

In this case, air is easily discharged particularly around the discharging unit, and hence the spouting of the powder may be highly prevented.

According to fourteenth aspect of the invention, the air passage portion is provided on an upper surface of the discharging unit and at a position opposing to a discharge port provided in the discharging unit.

Since the air passage portion is provided in the upper surface of the discharging unit, it is possible to prevent the air passage portion from being clogged by the powder. Further, since the air passage portion is provided so as to face the discharge port, the discharge of air may be further effectively performed.

According to fifteenth aspect of the invention, there is provided an image forming apparatus that includes the powder conveying apparatus according to eighth aspect of the invention.

Since the image forming apparatus includes the powder conveying apparatus according to the eighth aspect, the above-described effect by the powder conveying apparatus may be obtained.

Advantageous Effects of Invention

According to the invention, since the uneven deformation of the powder containing unit may be reduced, a powder conveying failure may be suppressed. Thus, there is an effect in which the powder conveying amount may be stabilized and the remaining powder amount decreases.

BRIEF DESCRIPTION OF DRAWINGS

FIG. 6(*b*) is a plan view the pullout tray after the toner cartridge is attached.

DESCRIPTION OF EMBODIMENTS

Figure 1:
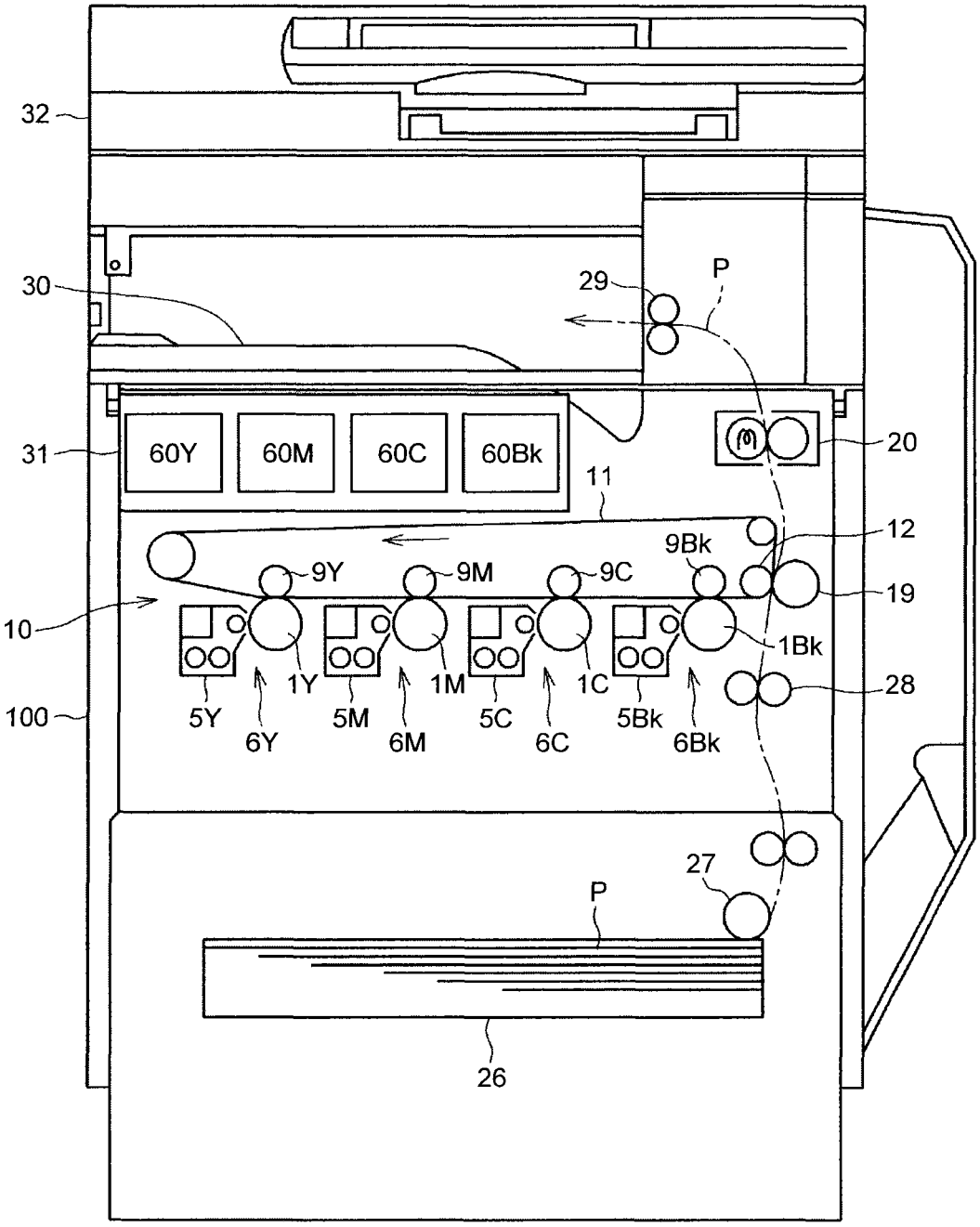
FIG. 1 is a configuration diagram of a printer as an image forming apparatus according to the present embodiment.

Exemplary embodiments will be described below with reference to the accompanying drawings. In the drawings, the same or equivalent components are denoted by the same reference numerals and redundant explanation will be appropriately simplified or will not be repeated.

First Embodiment

Figure 2:
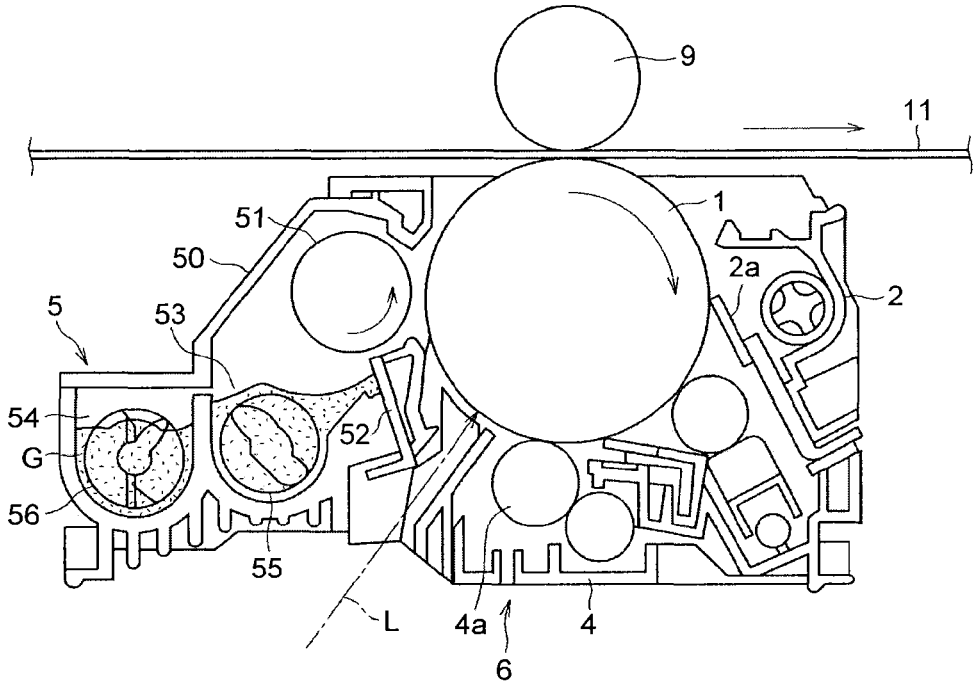
FIG. 2 is an enlarged view of an image forming unit of the image forming apparatus.

An overall configuration and operations of an image forming apparatus will be described below with reference to FIGS. 1 and 2. FIG. 1 is a configuration diagram of a printer as the image forming apparatus. FIG. 2 is an enlarged view of an image forming unit of the image forming apparatus.

As illustrated in FIG. 1, image forming units 6Y, 6M, 6C, and 6Bk corresponding to respective colors (yellow, magenta, cyan, and black) are arranged side by side and opposite to an intermediate transfer belt 11 of an intermediate transfer unit 10. The four image forming units 6Y, 6M, 6C, and 6Bk installed in an apparatus main body 100 have substantially the same configurations except for colors of toner to be used in image formation processes. Therefore, in FIG. 2, alphabets (Y, M, C, and Bk) assigned to the image forming units 6, photosensitive drums 1, and primary transfer bias rollers 9 are omitted.

As illustrated in FIG. 2, the image forming unit 6 includes the photosensitive drum 1 as an image carrier and includes a charging unit 4, a developing device 5 as a developing unit, and a cleaning unit 2, which are arranged around the photosensitive drum 1 (only the developing devices 5 are illustrated in FIG. 1). The image formation processes (a charging process, an exposing process, a developing process, a transfer process, and a cleaning process) are performed on the photosensitive drum 1, so that a desired toner image is formed on the photosensitive drum 1.

Each of the photosensitive drum 1, the charging unit 4, the developing device 5, and the cleaning unit 2 in the image forming unit 6 is detachably attached to the apparatus main body 100 of the image forming apparatus. Each unit can be replaced with new own when the unit ends its life.

In the present embodiment, each of the photosensitive drum 1, the charging unit 4, the developing device 5, and the cleaning unit 2 in the image forming unit 6 is configured as one independent unit. However, these units can be integrated as a process unit that can be detachably attached to the apparatus main body 100. In this case, the maintenance operability of the image forming unit 6 can be improved.

The configuration of the developing device 5 in the image forming unit 6 will be described in detail below with reference to FIG. 2. As illustrated in FIG. 2, the developing device 5 includes a developing roller 51 as a developer carrier arranged opposite to the photosensitive drum 1; a doctor blade 52 as a developer regulating member arranged below the developing roller 51; two conveying screws 55 and 56 as developer stirring conveying members arranged inside developer containers 53 and 54, respectively; and a case 50 for containing developer G. Here, as the developer G, two-component developer which is formed of a carrier and a toner is used. Further, a toner concentration sensor (not illustrated) which detects the toner concentration in the developer G is provided in the developing device 5. Further, here, the two-component developer is used as the developer G, but one-component developer which is formed of a toner may be used.

The surface of the developing roller 51 is roughened in the range of 5 to 35 μmRz by a sand blasting treatment. Further, various blasting treatments may be also used other than the sand blasting treatment. Further, a plurality of grooves each of which has a depth of 0.05 to 1 mm may be formed instead of the blasting treatment. The grooves may be arranged perpendicularly or obliquely with respect to the rotation direction of the developing roller 51, may be arranged in a twill line shape so as to intersect each other, or may be formed in a wavy shape. When the grooves are formed on the surface of the developing roller 51 or the surface thereof is roughened in this way, the developer is suppressed from falling by sliding on the developing roller 51, and hence the developer may be attached onto the developing roller 51 without discontinuity.

Referring to FIG. 2, the photosensitive drum 1 is rotationally driven clockwise in FIG. 2 by a driving unit (not illustrated). Then, the surface of the photosensitive drum 1 is uniformly charged by a charging roller 4*a* at the position of the charging unit 4 (a charging process). Here, the charging roller 4*a* which abuts the photosensitive drum 1 is used as the charging unit, but a charging roller which is disposed so as not to abut the photosensitive drum 1 such as an electrostatic charger may be used.

Subsequently, when the surface of the photosensitive drum 1 reaches an irradiation position of a laser beam L which is emitted from an exposing unit (not illustrated), an electrostatic latent image is formed at the position by exposure-scanning (an exposing process).

The surface of the photosensitive drum 1 reaches a position opposing to the developing roller 51 of the developing device 5. At this position, the electrostatic latent image is developed, so that a desired toner image is formed (the developing process).

The surface of the photosensitive drum 1 reaches a position opposing to both of the intermediate transfer belt 11 and the primary transfer bias roller 9. At this position, the toner image on the photosensitive drum 1 is transferred to the intermediate transfer belt 11 (the primary transfer process). At this time, a small amount of residual toner remains on the photosensitive drum 1. Here, a roller contact type is adopted in which the primary transfer bias roller 9 abuts the photosensitive drum 1, but a belt contact type in which a belt abuts the photosensitive drum 1 or a non-contact type such as an electrostatic charger may be used.

Subsequently, when the surface of the photosensitive drum 1 reaches a position facing the cleaning unit 2, the non-transferred toner which remains on the photosensitive drum 1 is collected by a cleaning blade 2*a* at the position (a cleaning process). Further, as the cleaning unit, an electrostatic collection type may be applied in which the non-transferred toner is collected by causing a brush or a roller applied with a cleaning bias to abut the photosensitive drum 1.

Finally, when the surface of the photosensitive drum 1 reaches a position facing a neutralization unit (not illustrated), the remaining potential on the photosensitive drum 1 is removed at the position. Furthermore, the neutralization unit may become a type in which the remaining potential is forcedly reduced by corona charging or may become a type in which the remaining potential is reduced by exposing the photosensitive drum 1 to light. Further, the neutralization unit may not be provided depending on the type of the photosensitive drum 1 or the charging type of the photosensitive drum 1. In this way, a series of image forming processes which are performed on the photosensitive drum 1 end.

The image formation processes described above are performed on each of the four image forming units 6Y, 6M, 60, and 68*k*. That is, the exposing unit (not illustrated) arranged below the image forming units applies the laser light L (see FIG. 2) to the photosensitive drum 1 of each of the image forming units 6Y, 6M, 6C, and 68*k* on the basis of image information read by a reading unit 32 illustrated in FIG. 1. More specifically, the exposing unit emits the laser light L from a light source and irradiates the photosensitive drum 1 with the laser light L via a plurality of optical elements while scanning the laser light L by a polygon mirror that is being rotated. Thereafter, toner images of the respective colors formed on the photosensitive drums 1 through the developing process are transferred to the intermediate transfer belt 11 in a superimposed manner. Consequently, a color image is formed on the intermediate transfer belt 11.

Four primary transfer bias rollers 9Y, 9M, 9C, and 9Bk and photosensitive drums 1Y, 1M, 1C, and 1Bk sandwich the intermediate transfer belt 11, so that respective primary transfer nips are formed. A transfer bias voltage with a polarity opposite to the polarity of toner is applied to each of the primary transfer bias rollers 9Y, 9M, 9C, and 9Bk. The intermediate transfer belt 11 moves in the direction of an arrow in the figure and sequentially passes through the primary transfer nips of the primary transfer bias rollers 9Y, 9M, 9C, and 9Bk. Accordingly, the toner images of the respective colors on the photosensitive drums 1Y, 1M, 1C, and 13*k* are primary transferred to the intermediate transfer belt 11 in a superimposed manner.

The intermediate transfer belt 11 on which the toner images of the respective colors are transferred in the superimposed manner reaches a position opposing to a secondary transfer roller 19. At this position, a secondary transfer backup roller 12 and the secondary transfer roller 19 sandwich the intermediate transfer belt 11, so that a secondary transfer nip is formed. The color toner image formed on the intermediate transfer belt 11 is transferred to a transfer material P, such as a transfer sheet, conveyed to the position of the secondary transfer nip. At this time, residual toner that has not been transferred to the transfer material P remains on the intermediate transfer belt 11. The residual toner on the intermediate transfer belt 11 is removed by a belt cleaning device (not illustrated). As described above, a series of transfer processes performed on the intermediate transfer belt 11 is completed.

The transfer material P is conveyed to the position of the secondary transfer nip from a feeding unit 26 arranged below the apparatus main body 100 via a feed roller 27, a registration roller pair 28, and the like. More specifically, a plurality of transfer materials P, such as transfer sheets, is housed in the feeding unit 26 in a stacked manner. When the feed roller 27 is rotated counterclockwise in FIG. 1, the topmost transfer material P is fed toward a nip between rollers of the registration roller pair 28.

The transfer material P conveyed to the registration roller pair 28 temporarily stops at a position of the roller nip of the registration roller pair 28 whose rotation is stopped. Thereafter, the registration roller pair 28 is rotated and the transfer material P is conveyed toward the secondary transfer nip in synchronization with a timing of the color image on the intermediate transfer belt 11. Accordingly, a desired color image is transferred to the transfer material P.

The transfer material P on which the color image is transferred at the position of the secondary transfer nip is further conveyed to a position of a fuser unit 20. At this position, the color image transferred on the surface of the transfer material P is fixed to the transfer material P due to heat and pressure applied by a fuser roller and a pressing roller.

Thereafter, the transfer material P passes through a nip between rollers of a discharge roller pair 29 and is discharged to the outside of the apparatus. The transfer material P discharged to the outside of the apparatus main body 100 by the discharge roller pair 29 is stacked, as an output image, on a stacking unit 30. As described above, a series of the image formation processes in the image forming unit is completed.

In FIG. 1, a toner supply unit 31 is arranged above the intermediate transfer unit 10. The toner supply unit 31 includes four toner supply devices (developer supply devices) 60Y, 60M, 60C, and 60Bk, each of which is filled with toner of a corresponding color. A toner conveying path is extended from each of the toner supply devices 60Y, 60M, 60C, and 60Bk to corresponding one of a developing devices 5Y, 5M, 5C, and 5Bk. Toner is supplied from the toner supply devices 60Y, 60M, 60C, and 60Bk to the developing devices 5Y, 5M, 5C, and 5Bk via the respective toner conveying paths. Therefore, it is possible to supply toner in accordance with the consumption amount of toner in each of the developing devices 5Y, 5M, 5C, and 5Bk. Consequently, the developing devices can be used for a long period of time.

The four toner supply devices 60Y, 60M, 60C, and 60Bk have the same configurations except for colors of toner contained therein. Therefore, in the following, the configuration of only one toner supply device will be described.

Figure 3:
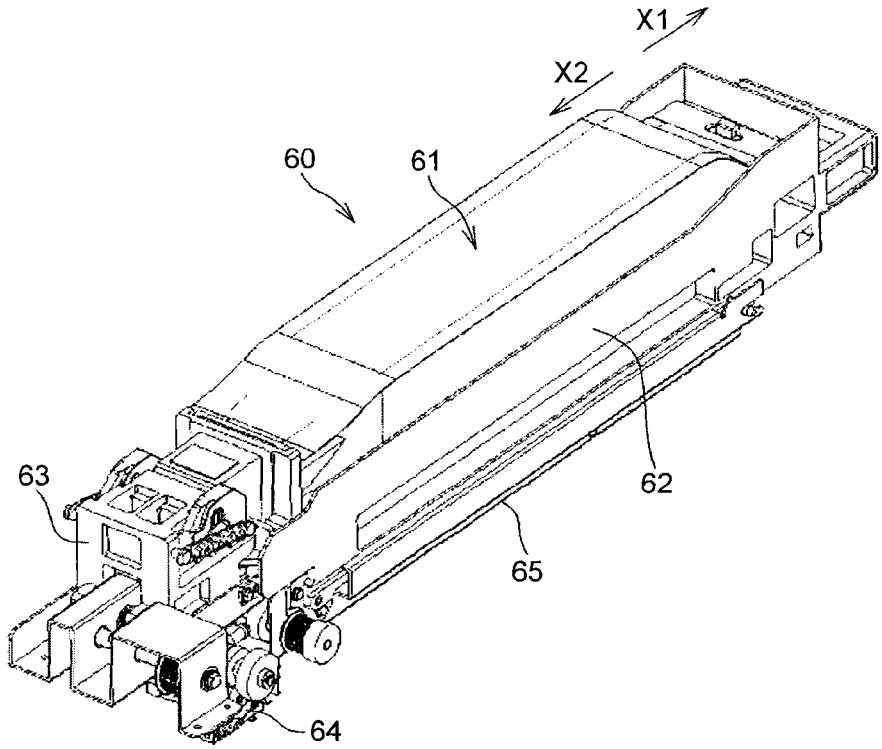
FIG. 3 is a perspective view illustrating a configuration of a toner supply device.

FIG. 3 is a perspective view illustrating a configuration of the toner supply device. In FIG. 3, an alphabet (Y, M, C, or Bk) assigned to a toner supply device 60 is omitted. As illustrated in FIG. 3, the toner supply device 60 includes a toner cartridge 61 as a toner container (a powder container) that is filled with toner; a pullout tray 62 as a holder member that holds the toner cartridge 61; a fixing unit 63 that fixes the toner cartridge 61; and a sub hopper 64 that accumulates toner discharged from the toner cartridge 61. A toner conveying pipe (not illustrated) for conveying the toner accumulated in the sub hopper 64 toward the developing device is connected to the sub hopper 64.

The pullout tray 62 is mounted so that the pullout tray 62 can move in the horizontal direction relative to a main-body frame 65. When the pullout tray 62 is moved in a direction of an arrow X1 in the figure, the pullout tray 62 is pulled out of the apparatus main body. On the other hand, when the pullout tray 62 is moved in a direction of an arrow X2, the pullout tray 62 is housed in the apparatus main body.

Figure 4:
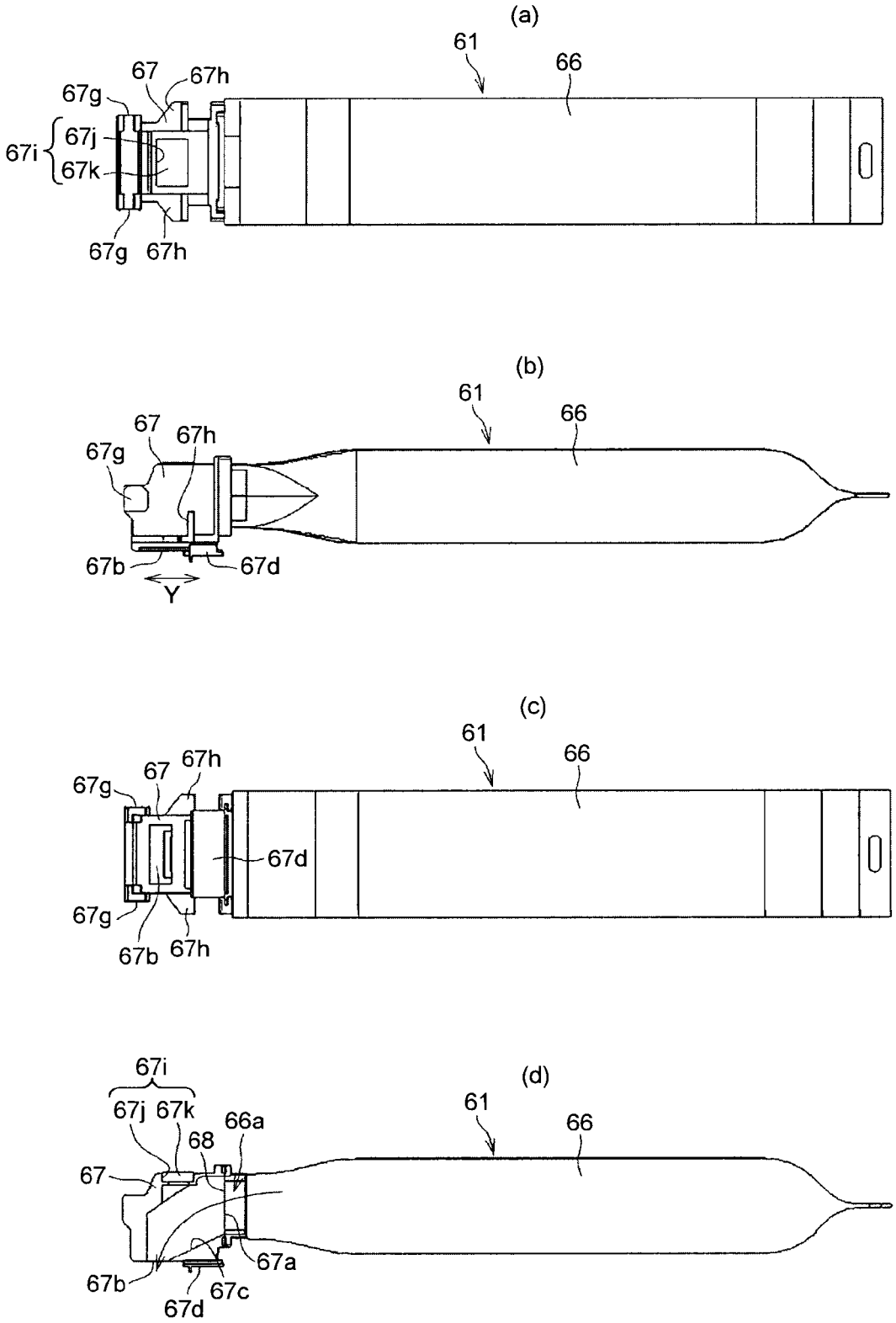
FIG. 4 is a configuration diagram of a toner cartridge.

FIG. 4 is a configuration diagram of a toner cartridge 61. In the same drawing, FIG. 4(*a*) is a plan view, FIG. 4(*b*) is a side view, FIG. 4(*c*) is a bottom view, and FIG. 4(*d*) is a cross-sectional view. As illustrated in FIG. 4, the toner cartridge 61 includes a toner containing unit (a powder containing unit) 66 which contains a toner as a powder and a discharging unit 67 which discharges the toner inside a toner containing unit 66 to the outside.

As illustrated in FIG. 4(*d*), the toner containing unit 66 is formed as a deformable longitudinal bag member which has a toner input port (a powder input port) 66*a* provided as an opening portion so as to be opened to one end portion. A flexible material is used as the material of the toner containing unit 66, and for example, a thin sheet material formed of PET may be exemplified. The toner containing unit 66 illustrated in FIG. 4 is formed by bonding four sheet materials to each other, but may be formed by forming one sheet material according to a bag shape. Further, the toner containing unit 66 is provided with an opening holder member 68 which holds the toner input port 66*a* in an opened state so that the toner is easily charged from the toner input port 66*a*. In the embodiment, a P×P toner (having an average particle diameter of 5.8 μm) which is manufactured by RICOH Company, Ltd. is contained inside the toner containing unit 66. For example, when the toner containing unit 66 substantially has a dimension of 60 mm×60 mm×400 mm, about 500 g of the toner may be contained in the toner containing unit 66.

Further, a flexible material which has flexibility is used as the material of the toner containing unit 66. As the material of the toner containing unit 66, sheets of various resins such as PA (polyamide resin, nylon), FE (high-density polyethylene, low-density polyethylene), PC (polycarbonate resin), PP (polypropylene resin), PS (polystyrene resin), PAN (polyacrylonitrile resin), PET (polyester resin), PVC (polyvinyl chloride resin), and PVDC (polyvinylidene chloride) may be solely used or a composite thereof may be used. In the embodiment, four types of resin sheets of PP, PET, PA, and LDPE (low-density polyethylene) are bonded to each other. As a method of forming a sheet, a thin film forming method such as a PVD (Physical Vapor Deposition) method or a CVD (Chemical Vapor Deposition) method may be applied. Further, in a case where the sheets adhere to each other by heat-bonding, the adhesiveness improves when LDPE is used in the innermost sheet layer.

The discharging unit 67 includes an inlet 67*a* for introducing toner; and a discharge port 67*b* for discharging toner. In the embodiment, the discharge port 67*b* is arranged so as to face downward. Therefore, it is possible to allow toner to fall from the discharge port 67*b* to the sub hopper 64 by weight, enabling to simplify the configuration for discharging toner. An inclined surface 67*c*, which is inclined downward from the inlet 67*a* to the discharge port 67*b*, is arranged in the discharging unit 67 so that the toner can smoothly be conveyed to the discharge port 67*b*. It is preferable to set the inclination angle of the inclined surface 67*c* with respect to the horizontal plane to be 10° or greater. A slide shutter 67*d* for opening and closing the discharge port 67*b* is arranged on the bottom surface (the lower surface) of the discharge port 67*b* so that the slide shutter 67*d* can slide in a direction of an arrow Y in FIG. 4(*b*).

Further, as illustrated in FIGS. 4(*a*) and 4(*d*), an air passage portion 67*i* which enables the passage of air between the inside and the outside is formed in the upper surface of the discharging unit 67. The air passage portion 67*i* includes an air passage hole 67*j* which is formed so as to be opened to the upper surface of the discharging unit 67 and a toner leakage preventing filter 67*k* which is attached to the air passage hole 67*j*. Further, the air passage portion 67*i* is disposed at the opposite side with the movement path, in which the toner introduced from an inlet 67*a* moves to a discharge port 67*b*, interposed therebetween so as to face the discharge port 67*b*. Further, although it will be described later, a projection portion 67*g* and a projection portion 67*h* are provided.

Figure 5:
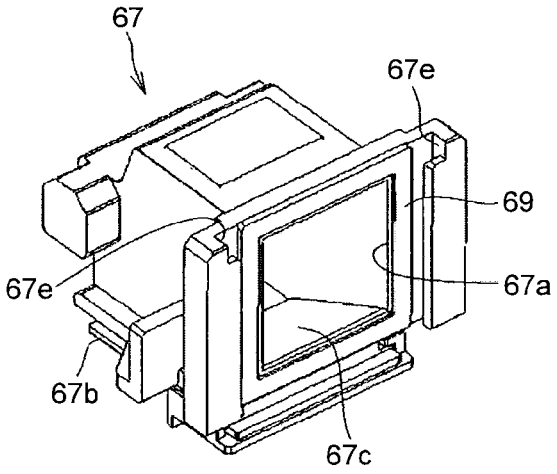
FIG. 5 is an exploded view of the toner cartridge.
Figure 5:
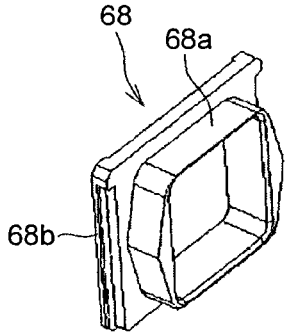
Figure 5:
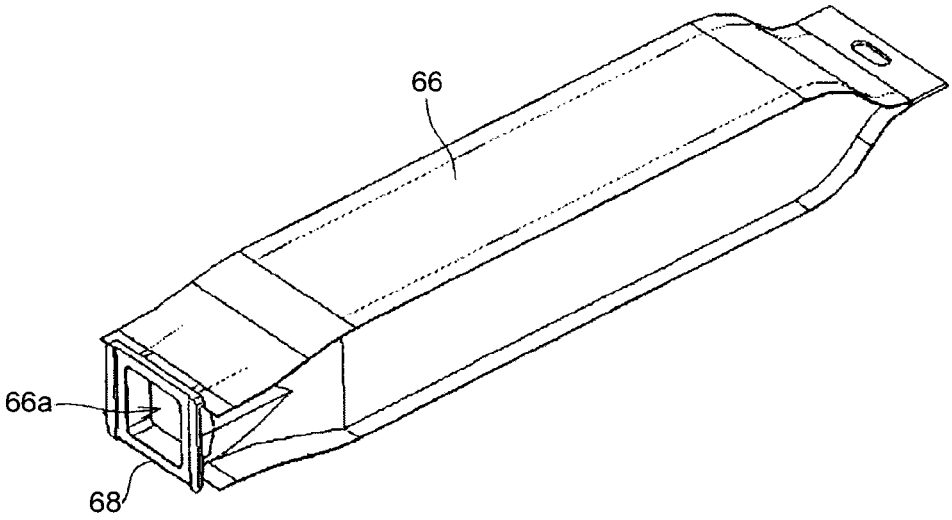

FIG. 5 is an exploded diagram of the toner cartridge 61. In the same drawing, FIG. 5(*a*) is a perspective view of the discharging unit 67, FIG. 5(*b*) is a perspective view of the opening holder member 68, and FIG. 5(*c*) is a perspective view illustrating a state where the opening holder member 68 is provided in the toner containing unit 66. As illustrated in FIG. 5(*b*), the opening holder member 68 is formed by integrally molding a short cylindrical insertion portion 68*a* and a flange-like connection portion 68*b*. As illustrated in FIG. 5(*c*), the insertion portion 68*a* may be inserted into the toner input port 66*a* of the toner containing unit 66. In the embodiment, the toner containing unit 66 and the opening holder member 68 adhere to each other by heat-bonding, but may be attached to each other by an adhesive agent. Further, the outer shape of the insertion portion 68*a* is substantially formed in a hexagonal shape in order to easily suppress the insertion position of the insertion portion 68*a* in the vertical direction of FIG. 5(*c*) during the heat-bonding operation.

As illustrated in FIG. 5(*a*), the inlet 67*a* of the discharging unit 67 is provided with a pair of grooves 67*e* which may engage with the connection portion 68*b* of the opening holder member 68. As described above, when the opening holder member 68 is inserted into the toner containing unit 66 so as to adhere thereto and the opening holder member 68 is inserted into the upper side of the groove 67*e* so as to engage therewith, the toner containing unit 66 and the discharging unit 67 may be integrally connected to each other. Further, the connection portion between the discharging unit 67 and the opening holder member 68 is provided with a seal material 69 which prevents the toner from leaking from the connection portion.

Figure 6:
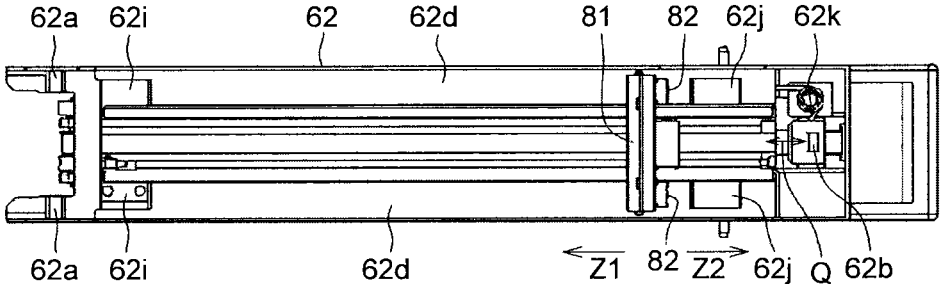
FIG. 6(*a*) is a plan view of a pullout tray before the toner cartridge is attached.
Figure 6:
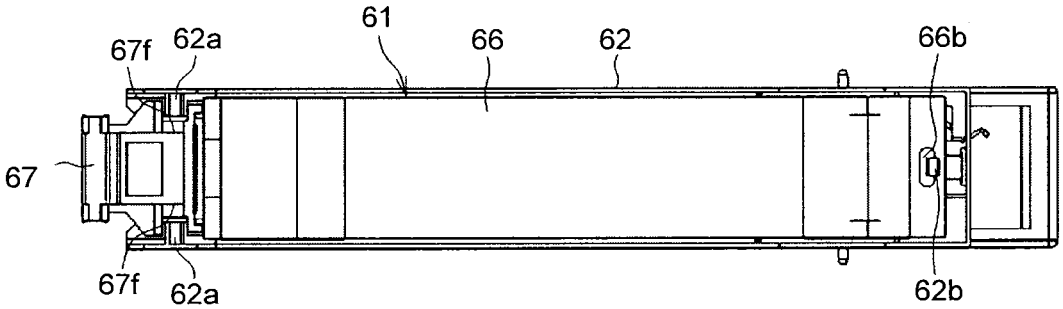

FIG. 6(*a*) is a plan view illustrating a state before the toner cartridge 61 is attached to the pullout tray 62, and FIG. 6(*b*) is a plan view illustrating a state where the toner cartridge 61 is attached to the pullout tray 62. Further, although it will be described later, a placement surface 62*d*, concave portions 62*i* and 62*j*, a delivery member 81, and a leg member 82 are provided.

As illustrated in FIG. 6(*b*), concave portions 67*f* are arranged on both side surfaces of the discharging unit 67. Convex members 62*a* are arranged on the pullout tray 62 so as to correspond to the positions of the concave portions 67*f*, so that the convex members 62*a* can be inserted into the concave portions 67*f*. A hole portion 66*b*, which is a to-be-engaged portion to be engaged with an engaging portion of other unit, is formed on an end portion of the toner containing unit 66 on the side opposite to the discharging unit 67 side. A hook-shaped hook portion 62*b* as the engaging portion is arranged on the pullout tray 62 so as to correspond to the position of the hole portion 66*b*.

By inserting the hook portion 62*b* to the hole portion 66*b* so that they are engaged with each other and inserting the convex members 62*a* into the concave portions 67*f*, the toner cartridge 61 is attached to the pullout tray 62. When the toner cartridge 61 is attached as described above, the convex members 62*a* and the concave portions 67*f* are not in contact with each other. However, when the toner cartridge 61 moves in the longitudinal direction along with the pullout tray 62 being pulled out of the apparatus main body or being housed in the apparatus main body, the convex members 62*a* come into contact with the concave portions 67*f*, so that the movement of the toner cartridge 61 in the longitudinal direction can be regulated.

When the toner cartridge 61 is detached from the pullout tray 62, the concave portions 67*f* are separated from the convex members 62*a* and the hook portion 62*b* is disengaged from the hole portion 66*b*. In the embodiment, the convex members 62*a* (or the concave portions 67*f*) have the same shapes; however, if the shapes are made different, it is possible to prevent the toner cartridge 61 from being erroneously attached.

As illustrated in FIG. 6(*a*), a hook portion 62*b* is attached to the pullout tray 62 so as to be movable in the direction of the arrow Q of the drawing. That is, the hook portion 62*b* is adapted to be movable in a direction toward the discharging unit 67 and the opposite direction thereto while the toner cartridge 61 is attached to the pullout tray 62 (the state illustrated in FIG. 6(*b*)). Further, as illustrated in FIG. 6(*a*), the hook portion 62*b* is biased rightward in the drawing by a torsional coil spring 62*k* as an elastic member. Accordingly, when the hook portion 62*b* is inserted into a hole portion 66*b* of the toner containing unit 66 in a hung state, the hook portion 62*b* is pulled by the biasing force of the torsional coil spring 62*k* toward the opposite direction to the discharging unit 67, so that the toner containing unit 66 is held at a predetermined position. Furthermore, a member other than the torsional coil spring may be used as the elastic member that pulls the hook portion 62*b*, but the structure for pulling the hook portion 62*b* is made compact by using the torsional coil spring 62*k* herein.

Figure 7:
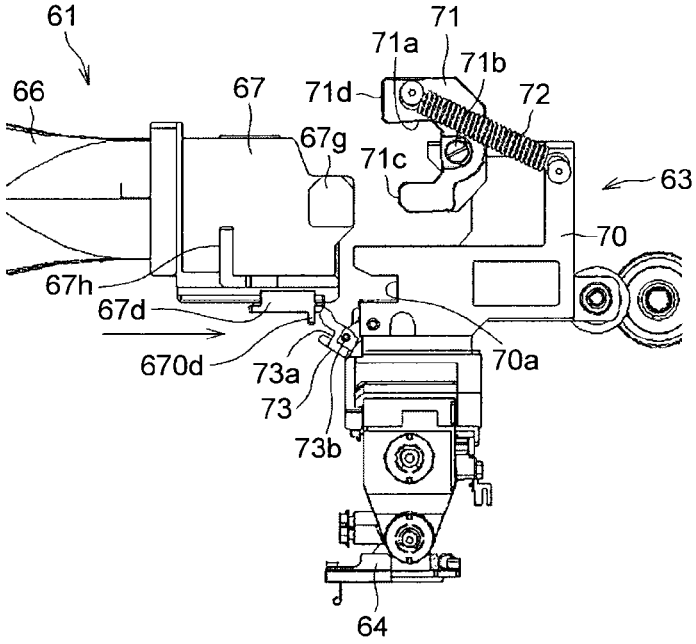
FIG. 7 is an enlarged view of a fixing unit.
Figure 7:
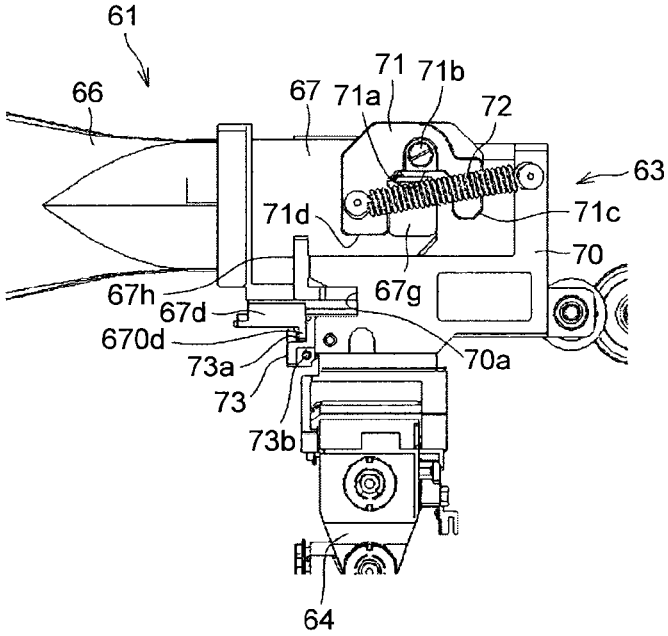

FIG. 7 is an enlarged view of the fixing unit 63. Specifically, FIG. 7(*a*) illustrates a state before the toner cartridge 61 is fixed to the fixing unit 63, and FIG. 7(*b*) illustrates a state after the toner cartridge 61 is fixed to the fixing unit 63. As illustrated in FIG. 7, the fixing unit 63 includes a main body 70 connected to an upper portion of the sub hopper 64; a fixing arm 71 attached to an upper portion of the main body 70; a spring member 72 attached between the fixing arm 71 and the main body 70; and a shutter opening member 73 attached to the main body 70 on the lower side of the fixing arm 71. The fixing arm 71, the spring member 72, and the shutter opening member 73 are arranged on each of the front side and the back side in the figures.

The fixing arm 71 has an approximate C-shape with a concave portion 71*a*. The fixing arm 71 is attached to the main body 70 so that the fixing arm 71 can rotate about a horizontal support shaft 71*b* that is arranged in the center of the fixing arm 71. By rotating the fixing arm 71 about the support shaft 71*b*, the fixing arm 71 is switched between a fixation released position illustrated in FIG. 7(*a*) and a fixed position illustrated in FIG. 7(*b*).

The spring member 72 is a tensile coil spring. One end of the spring member 72 is attached to the fixing arm 71 and the other end of the spring member 72 is attached to the main body 70. As illustrated in FIGS. 7(*a*) and 7(*b*), when the fixing arm 71 rotates between the fixed position and the fixation released position, the end of the spring member 72 attached to the fixing arm 71 moves across a rotation fulcrum (the support shaft 71*b*) of the fixing arm 71. By causing the spring member 72 to move across the rotation fulcrum along with the rotation of the fixing arm 71, the fixing arm 71 is biased by the spring member 72 in the rotation direction.

Protrusions 67*g* as to-be-fixed portions to be fixed to the fixing arm 71 are arranged on the discharging unit 67. The protrusions 67*g* are arranged on the respective side surfaces of the discharging unit 67 (see FIG. 4(*a*) or FIG. 4(*c*))

The shutter opening member 73 is attached to the main body 70 so that the shutter opening member 73 can rotate about a horizontal support shaft 73*b*. The shutter opening member 73 includes a concave portion 73*a* for holding a convex member 670*d* of the slide shutter 67*d* arranged on the discharging unit 67.

A notch portion 70*a* is formed on the main body 70 of the fixing unit 63. L-shaped protrusions 67*h* that come into contact with an upper portion of the notch portion 70*a* are arranged on the respective side surfaces of the discharging unit 67.

To fix the toner cartridge 61 to the fixing unit 63, the toner cartridge 61 is first attached to the pullout tray 62 as described above with reference to FIG. 6. Then, the pullout tray 62 is moved in a direction in which the pullout tray 62 is housed in the apparatus main body (in the direction of the arrow X2 in FIG. 3). Along with this housing operation, as illustrated in FIG. 7(*a*), when the discharging unit 67 of the toner cartridge 61 approaches the fixing unit 63, the protrusion 67*g* arranged on the discharging unit 67 comes into contact with one end portion 71*c* (a lower end portion in FIG. 7(*a*)) of the fixing arm 71 and causes the fixing arm 71 to rotate counterclockwise in the figure against the biasing force applied by the spring member 72. Accordingly, the fixing arm 71 is switched from the fixation released position illustrated in FIG. 7(*a*) to the fixed position illustrated in FIG. 7(*b*). As a result, as illustrated in FIG. 7(*b*), the protrusion 67*g* is fitted into the concave portion 71*a* of the fixing arm 71 and is sandwiched and fixed by an end portion 71*d* (a left end portion in FIG. 7(*b*)) of the fixing arm 71 and the edge of the main body 70. When the spring member 72 moves across the rotation fulcrum of the fixing arm 71 along with the rotation of the fixing arm 71, the spring member 72 applies a biasing force to the fixing arm 71 in a direction in which the fixing arm 71 is maintained at the switched position.

Furthermore, as the discharging unit 67 of the toner cartridge 61 approaches the fixing unit 63, the protrusions 67*h* arranged on the discharging unit 67 enter the notch portion 70*a* of the main body 70 and come into contact with the upper portion of the notch portion 70*a* (see FIG. 7(*b*)). Therefore, backlash of the discharging unit 67 in the vertical direction can be prevented.

Further, when fixing the toner cartridge 61 to a fixing unit 63, a slide shutter 67*d* which is provided in the discharging unit 67 abuts a shutter opening member 73, so that the shutter opening member 73 is rotated clockwise in the drawing. Then, when the shutter opening member 73 moves to the position illustrated in FIG. 7(*b*), the further rotation of the shutter opening member 73 is regulated, so that the slide shutter 67*d* moves by being pressed toward the rear side of the discharging unit 67 by the shutter opening member 73. Accordingly, the slide shutter 67*d* (the discharge port) is opened, and the toner may be discharged from the discharging unit 67 by a sub hopper 64. Further, the shutter opening member 73 moves to the position of FIG. 7(*b*), and a convex member 670*d* of the slide shutter 67*d* is inserted into a concave portion 73*a* of the shutter opening member 73 so as to be held therein. With the above-described configuration, the toner cartridge 61 is completely fixed to the fixing unit 63.

When the fixation of the toner cartridge 61 is to be released, the pullout tray 62 is moved in the direction in which the pullout tray 62 is pulled out of the apparatus main body (in the direction of the arrow X1 in FIG. 3). With this pullout operation, the toner cartridge 61 moves to the left in FIG. 7(*b*), so that the protrusion 67*g* arranged on the discharging unit 67 pushes the end portion 71*d* of the fixing arm 71 and causes the fixing arm 71 to rotate clockwise in the figure against the biasing force applied by the spring member 72. Accordingly, the fixing arm 71 is switched from the fixed position illustrated in FIG. 7(*b*) to the fixation released position illustrated in FIG. 7(*a*), so that the protrusions 67*g* is separated from the fixing arm 71. At the same time, the protrusions 67*h* and the slide shutter 67*d* arranged on the discharging unit 67 are separated from the notch portion 70*a* and the shutter opening member 73, respectively, so that the fixation of the toner cartridge 61 is released. A spring or the like (not illustrated) applies a biasing force to the slide shutter 67*d* separated from the shutter opening member 73 so that the slide shutter 67*d* moves in the direction in which the discharge port is closed. Therefore, toner leakage from the discharge port can be prevented.

Figure 8:
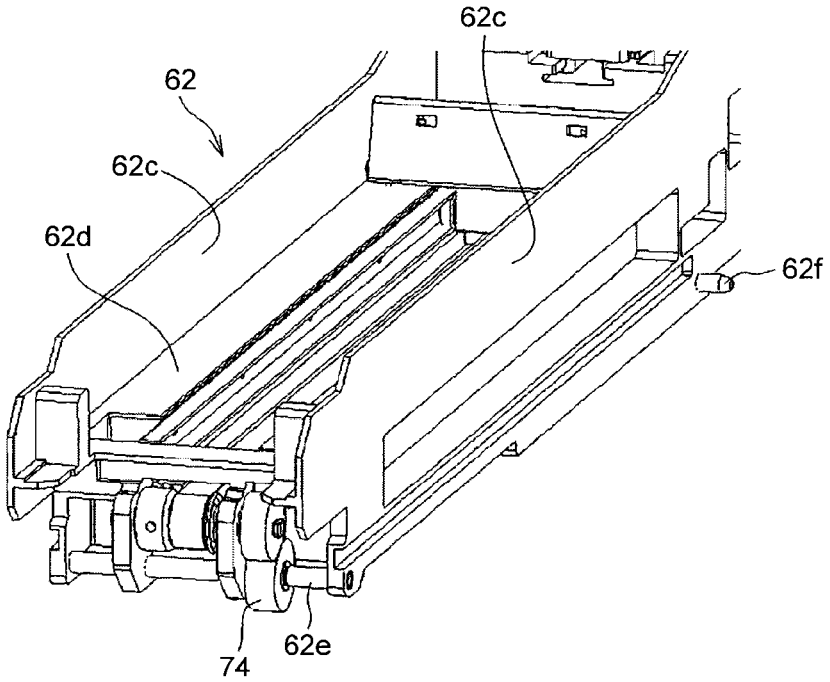
FIG. 8 is a perspective view of the pullout tray.

FIG. 8 is a perspective view of the pullout tray 62. As illustrated in FIG. 8, the pullout tray 62 includes a pair of side walls 62*c* for supporting both side surfaces of the toner cartridge 61; and a placement surface 62*d* for placing the toner cartridge 61. A main reference shaft 62*e* to be used as a main reference at the time of attachment to the main-body frame 65 is arranged on the front end portions of the side walls 62*c* in the figure. In the embodiment, the main reference shaft 62*e* is used as a support shaft of a transmission gear 74 that transmits a driving force to a toner conveying apparatus, which will be described below. Sub reference shafts 62*f* to be used as sub reference at the time of attachment to the main-body frame 65 are arranged to respective back end portions of the side walls 62*c* in the figure.

Figure 9:
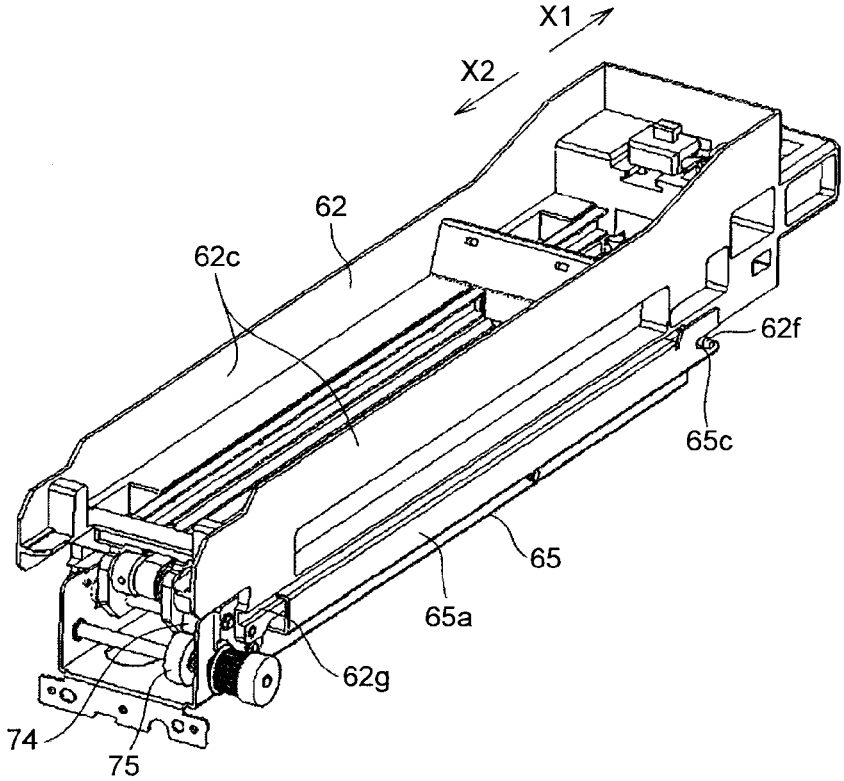
FIG. 9 is a perspective view of the pullout tray attached to a main-body frame.

FIG. 9 is a perspective view of the pullout tray 62 attached to the main-body frame 65. As illustrated in FIG. 9, the main-body frame 65 includes a pair of guide rails 65*a* extending in the pullout direction X1 and the housing direction X2 of the pullout tray 62. An upper edge of each of the guide rails 65*a* is inserted in corresponding one of grooves 62*g* that are formed on the respective side walls 62*c* of the pullout tray 62. Therefore, the pullout tray 62 is movable in the pullout direction X1 and the housing direction X2 along the guide rails 65*a*.

Figure 10:
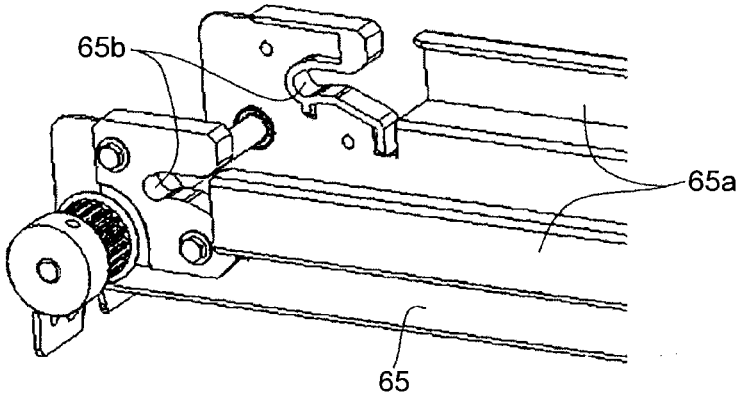
FIG. 10 is an enlarged view of the main-body frame.

First positioning concaves 65*b* that can be engaged with the main reference shaft 62*e* of the pullout tray 62 are formed on an end portion of the main-body frame 65 on the front side in the figure (see FIG. 10). Second positioning concaves 65*c* that can be engaged with the sub reference shafts 62*f* are formed on an end portion of the main-body frame 65 on the back side in the figure. Therefore, when the pullout tray 62 is moved in the housing direction X2, the main reference shaft 62*e* and the sub reference shafts 62*f* are inserted in and engaged with the first positioning concaves 65*b* and the second positioning concaves 65*c*, respectively, so that the position of the pullout tray 62 can be fixed at a predetermined position with respect to the main-body frame 65.

As illustrated in FIG. 9, a drive gear 75 that is driven by a driving device is arranged on the end portion of the main-body frame 65 on the front side in the figure. The drive gear 75 is connected to the transmission gear 74 while the pullout tray 62 is received inside the apparatus main body and is positioned in a main-body frame 65.

Figure 11:
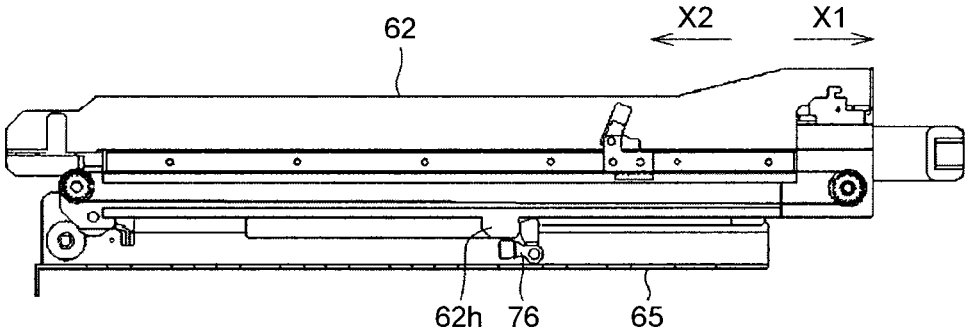
FIG. 11 is a cross-sectional side view of the main-body frame and the pullout tray.

As illustrated in FIG. 11, a pressing member 76 for pressing and fixing the pullout tray 62 is arranged on the main-body frame 65. In the embodiment, the pressing member 76 is formed as a combination of two levers. When the pullout tray 62 is moved in the housing direction X2, a convex member 62*h* arranged on the bottom surface of the pullout tray 62 is sandwiched and pressed by the two levers so that the pullout tray 62 is pushed toward the first positioning concaves 65*b* side and the second positioning concaves 65*c* side so that the position of the pullout tray 62 can be fixed.

Figure 12:
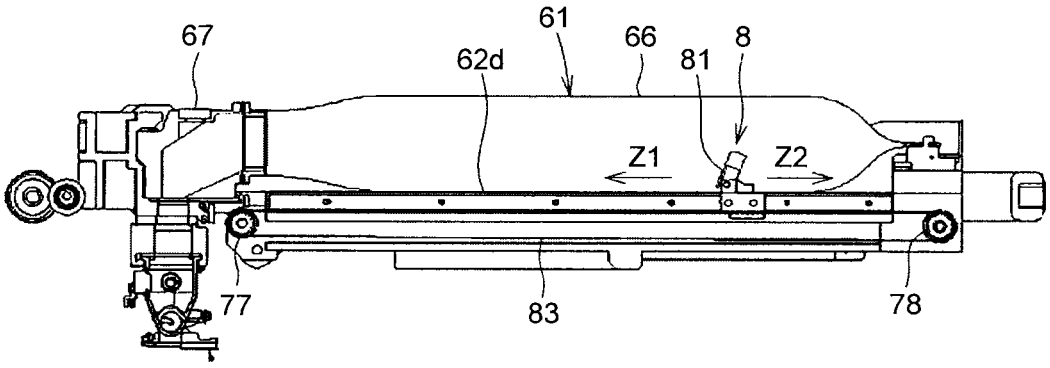
FIG. 12 is a cross-sectional side view of the pullout tray and components.

Further, as illustrated in FIG. 12, the pullout tray 62 is provided with a toner conveying apparatus (a powder conveying apparatus) 8 which conveys the toner inside the toner containing unit 66 to the discharging unit 67. In FIG. 12, rollers 77 and 78, the delivery member 81, and a belt member 83 are provided. Hereinafter, a configuration of the toner conveying apparatus 8 will be described in detail based on FIGS. 12 to 15.

Figure 13:
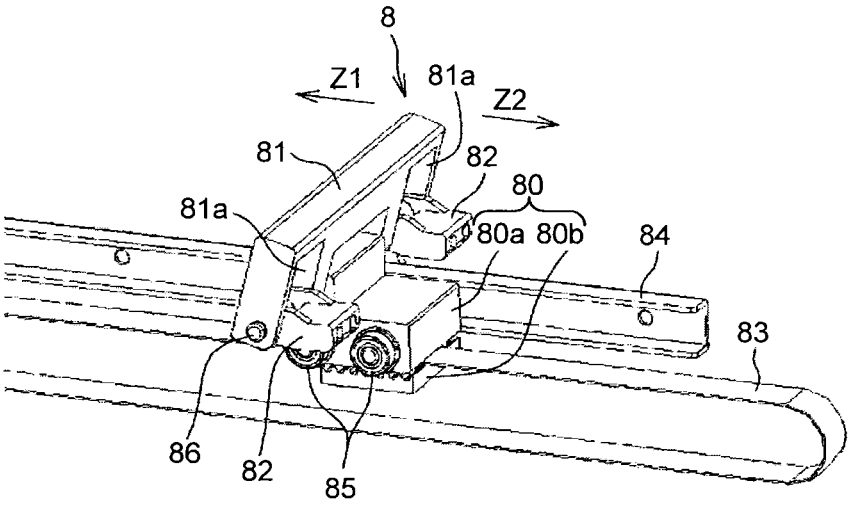
FIG. 13 is a configuration diagram of a toner conveying apparatus.

As illustrated in FIG. 13, the toner conveying apparatus 8 includes a base member 80; a delivery member 81 and a pair of leg members 82, which are attached to the base member 80; a belt member 83 as a moving means for moving the base member 80; and a pair of guide rails 84 as guide members for guiding the base member 80. In FIG. 13, illustration of the guide rail 84 on the front side is omitted.

The base member 80 is divided into an upper portion 80*a* and a lower portion 80*b*. The upper portion 80*a* and the lower portion 80*b* sandwich the belt member 83 so that the base member 80 is attached to the belt member 83. The belt member 83 is an endless belt and stretched between two rollers 77 and 78 (see FIG. 12) arranged on the pullout tray 62. The belt member 83 rotates both in the forward direction and the reverse direction upon transmission of a driving force from the transmission gear 74 (see FIG. 8) to the roller 77. By rotating the belt member 83 in the forward direction and in the reverse direction, the base member 80 can reciprocate in a delivery direction Z1 toward the discharging unit 67 and a return direction Z2 opposite to the delivery direction, together with the delivery member 81 and the leg members 82 attached to the base member 80.

Two rollers 85 as rotary members that roll on the guide rails 84 are arranged on each of the side surfaces of the base member 80. By arranging the rollers 85 on the base member 80, the base member 80 can smoothly move along the guide rails 84. The pair of the guide rails 84 is fixed to the pullout tray 62.

As illustrated in FIG. 13, the delivery member 81 and the leg members 82 are attached such that they can be opened or closed with respect to each other about a horizontal support shaft 86. More specifically, the delivery member 81 and the leg members 82 can separately rotate about the support shaft 86. When the delivery member 81 or the leg members 82 rotate about the support shaft 86, the delivery member 81 and the leg members 82 are opened or closed with respect to each other. The delivery member 81 and the leg members 82 are biased by a torsion coil spring as a biasing member (not illustrated) in a direction in which the delivery member 81 and the leg members 82 are opened with respect to each other. Housing concaves 81*a* for housing the leg members 82 when the leg members 82 are closed are formed on the delivery member 81.

Figure 14:
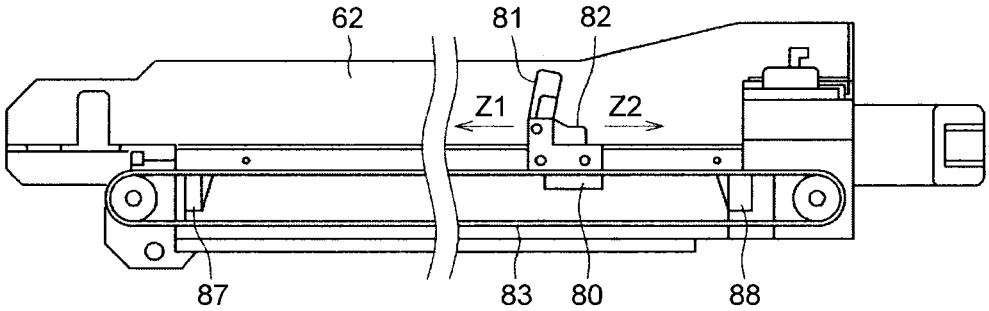
FIG. 14 is a cross-sectional side view of the pullout tray.

The rotation direction of the belt member 83 is switched by two switches 87 and 88 illustrated in FIG. 14. The switches 87 and 88 as moving-direction switching means are arranged at respective moving-direction switching positions of the delivery member 81. More specifically, the switch 87 is arranged on one end (a left end in the figure) in the delivery direction Z1 of the pullout tray 62 and the switch 88 is arranged on the other end (a right end in the figure) in the return direction Z2 of the pullout tray 62. When the delivery member 81 reaches one of the moving-direction switching positions, the base member 80 comes into contact with the switch 87 or the switch 88 arranged at this position. That is, the base member 80 functions as an input means that turns on the switch 87 or the switch 88 by coming into contact with the switch 87 or the switch 88. In this way, when a base member 80 contacts a switch 87 or 88, the movement direction of the delivery member 81 is changed to the delivery direction Z1 or the returning direction Z2 and hence the toner delivery operation may be continuously performed. It is possible to arrange a non-contact sensor instead of the contact sensor such that the sensor is turned on when a to-be-detected portion (an input means) arranged on the base member 80 is brought close to the non-contact sensor.

Figure 15:
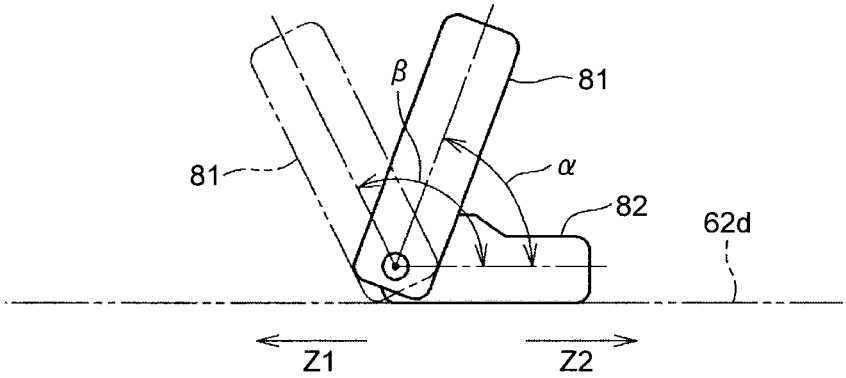
FIG. 15 is a side view of a delivery member and a leg member.

FIG. 15 is a side view of the delivery member 81 and the leg members 82. As illustrated in FIG. 15, the leg members 82 come into contact with the placement surface 62*d* of the pullout tray 62 and can reciprocate in the delivery direction Z1 and the return direction Z2 along the placement surface 62*d*. That is, the placement surface 62*d* also has a function as a guide surface for guiding the leg members 82. As described above, the delivery member 81 and the leg members 82 are biased by the torsion coil spring so that the delivery member 81 and the leg members 82 are opened with respect to each other. The leg members 82 are supported horizontally by contact with the placement surface 62*d*. The delivery member 81 is biased so that the delivery member 81 rotates in the delivery direction Z1 (to the discharging unit 67 side) and is opened with respect to the horizontally-supported leg members 82. A regulating unit, such as a stopper (not illustrated), regulates the rotation of the delivery member 81 in the opening direction against the biasing force applied by the torsion coil spring. Therefore, the delivery member 81 is supported so as to stand with respect to the placement surface 62*d* (the state indicated by a bold line in the figure). As described above, the placement surface 62*d* and the regulating unit maintain an opening angle between the delivery member 81 and the leg members 82 to a predetermined angle α so that the delivery member 81 can be in a predetermined standing state with respect to the placement surface 62*d*.

An opening angle β in FIG. 15 is an angle obtained when the delivery member 81 is not regulated by the regulating unit. That is, the angle β is an opening angle obtained when the torsion coil spring is in a normal state. As illustrated in FIG. 15, the opening angle β maintained by the torsion coil spring in the normal state is set in a range greater than the opening angle α, at which the delivery member 81 is in the predetermined standing state, and smaller than 180°.

As illustrated in FIG. 6(*a*), concave portions 62*i* and 62*j* in which the leg members 82 can be inserted are arranged on respective end portions in the directions (the delivery direction Z1 and the return direction Z2) in which the leg members 82 reciprocate on the placement surface 62*d*. In the embodiment, by arranging the concave portions 62*i* and 62*j*, the delivery member 81 can be switched between a standing state and a laid state with respect to the placement surface 62*d*.

The operations of switching the delivery member 81 between the standing state and the laid state will be described below with reference to FIGS. 16 and 17.

Figure 16:
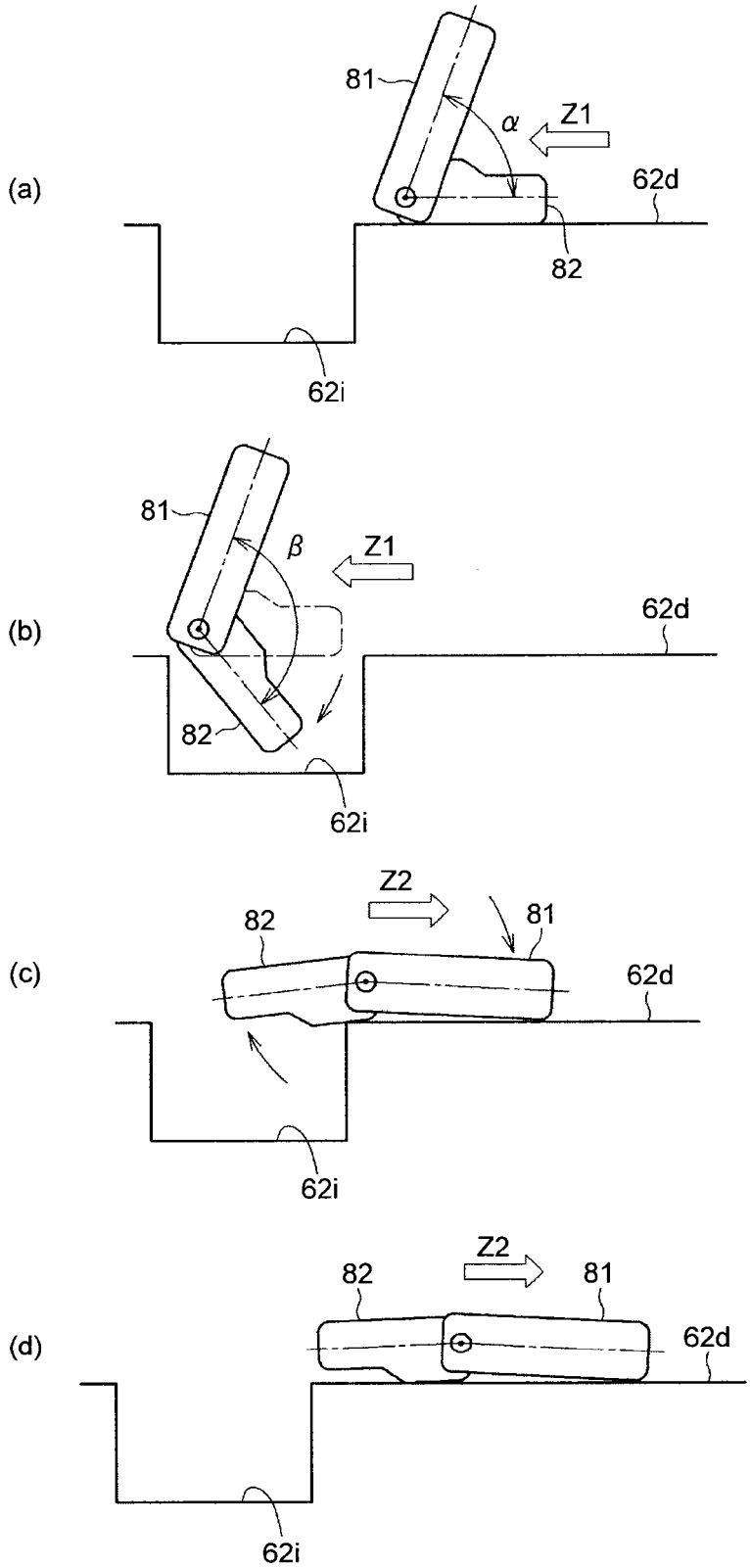
FIG. 16 is a diagram for explaining operations for switching the delivery member from a standing state to a laid state.

FIG. 16(*a*) illustrates a state before the delivery member 81 reaches the concave portions 62*i* that are arranged on the end side in the delivery direction Z1. In this state, the opening angle between the delivery member 81 and the leg members 82 is maintained at the predetermined angle α by the regulating unit (not illustrated) and the placement surface 62*d*, and the delivery member 81 is in the predetermined standing state with respect to the placement surface 62*d*.

As illustrated in FIG. 16(*b*), when the delivery member 81 moves in the delivery direction Z1 and the leg members 82 reach the positions of the concave portions 62*i*, because the placement surface 62*d* that supports the leg members 82 is not present at this position, the leg members 82 are opened downward because of the biasing force applied by the torsion coil spring (not illustrated). Therefore, the leg members 82 enter the concave portions 62*i*. The opening angle between the delivery member 81 and the leg members 82 at this time is the angle β that is the angle maintained when the torsion coil spring is in the normal state.

When the delivery member 81 reaches the positions of the concave portions 62*i*, the base member 80 comes into contact with the switch 87 illustrated in FIG. 14, so that the moving direction of the delivery member 81 is switched.

As illustrated in FIG. 16(*c*), when the moving direction is switched and the delivery member 81 moves in the return direction Z2, the leg members 82 come into contact with the edges of the concave portions 62*i* (near the opening) and the tips of the leg members 82 are lifted upward. When the leg members 82 are lifted upward and rotate further in the opening direction, the opening angle becomes greater than the angle β. Therefore, the biasing force applied by the torsion coil spring acts in the closing direction. As a result, the delivery member 81 receives a biasing force in the closing direction and is laid on the placement surface 62*d*.

As illustrated in FIG. 16(*d*), when the leg members 82 are separated from the concave portions 62*i*, the delivery member 81 and the leg members 82 are laid horizontally on the placement surface 62*d*. More specifically, the opening angle between the delivery member 81 and the leg members 82 is nearly 180°, so that the delivery member 81 and the leg members 82 are biased in the closing directions by the torsion coil spring. However, because the rotation of the delivery member 81 and the leg members 82 is regulated by the placement surface 62*d*, the delivery member 81 and the leg members 82 are kept laid horizontally. The delivery member 81 and the leg members 82 are configured so that they are not opened by 180° or greater.

Figure 17:
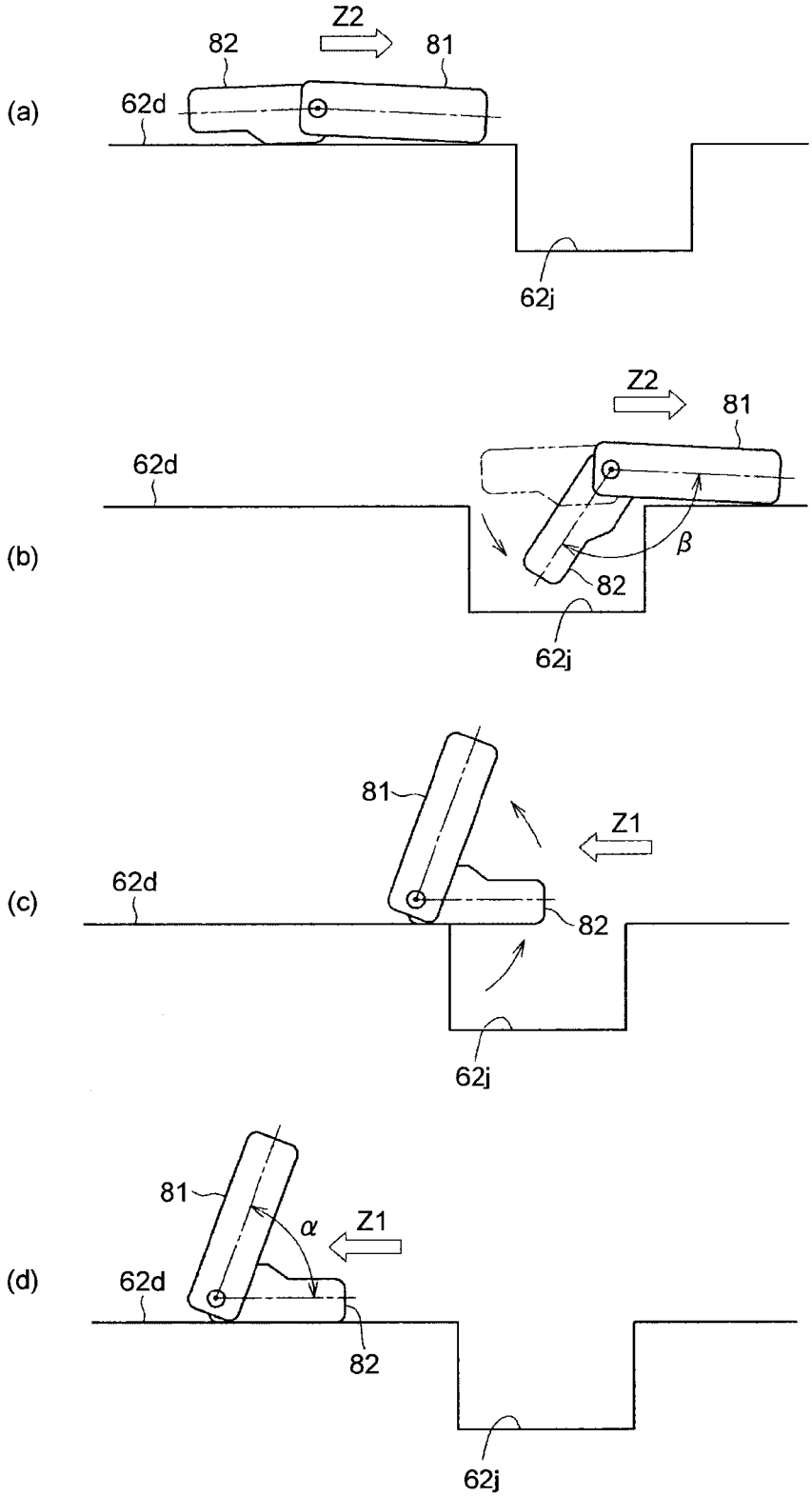
FIG. 17 is a diagram for explaining operations for switching the delivery member from the laid state to the standing state.

FIG. 17(*a*) illustrates a state before the delivery member 81 being laid in the above manner reaches the concave portions 62*j* that are arranged on the end side in the return direction Z2. In this state, similarly to the state in FIG. 16(*d*), the delivery member 81 and the leg members 82 are opened by nearly 180° and are laid horizontally on the placement surface 62*d*.

As illustrated in FIG. 17(*b*), when the leg members 82 reach the positions of the concave portions 62*j*, because the placement surface 62*d* that supports the leg members 82 is not present at this position, the leg members 82 are closed downward because of a biasing force applied by the torsion coil spring and enter the concave portions 62*j*. The opening angle between the delivery member 81 and the leg members 82 at this time is the angle β that is the angle maintained when the torsion coil spring is in the normal state. The delivery member 81 is configured so that it cannot enter the concave portions 62*j*. Therefore, the delivery member 81 passes over the concave portions 62*j*.

When the delivery member 81 reaches the positions of the concave portions 62*j*, the base member 80 comes into contact with the switch 88 illustrated in FIG. 14, so that the moving direction of the delivery member 81 is switched.

As illustrated in FIG. 17(*c*), when the moving direction is switched and the delivery member 81 moves in the delivery direction Z1, the leg members 82 come into contact with edges of the concave portions 62*j* (near the opening) and the tips of the leg members 82 are lifted upward. When the leg members 82 are lifted upward and rotate further in the closing direction, the opening angle becomes smaller than the angle β. Therefore, the biasing force applied by the torsion coil spring acts in the opening direction. As a result, the delivery member 81 receives a biasing force in the opening direction and stands.

As illustrated in FIG. 17(*d*), when the leg members 82 are separated from the concave portions 62*j*, the delivery member 81 is maintained in the standing state at the predetermined opening angle α.

Figure 18:
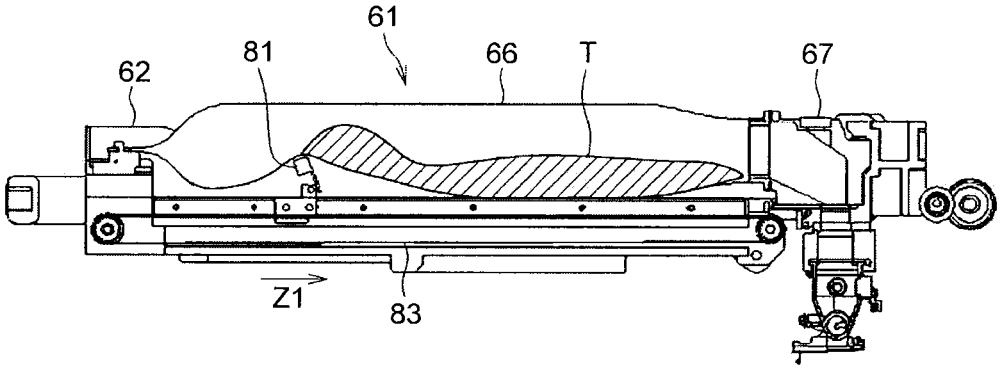
FIG. 18 is a diagram for explaining toner delivery operations.
Figure 18:
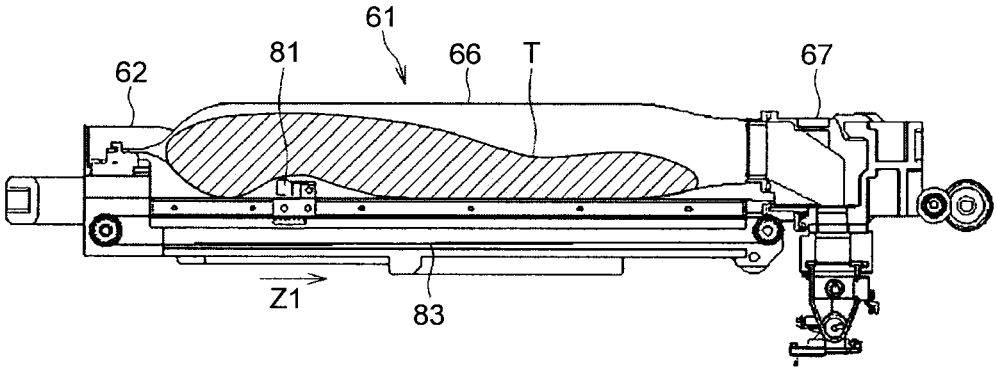
Figure 18:
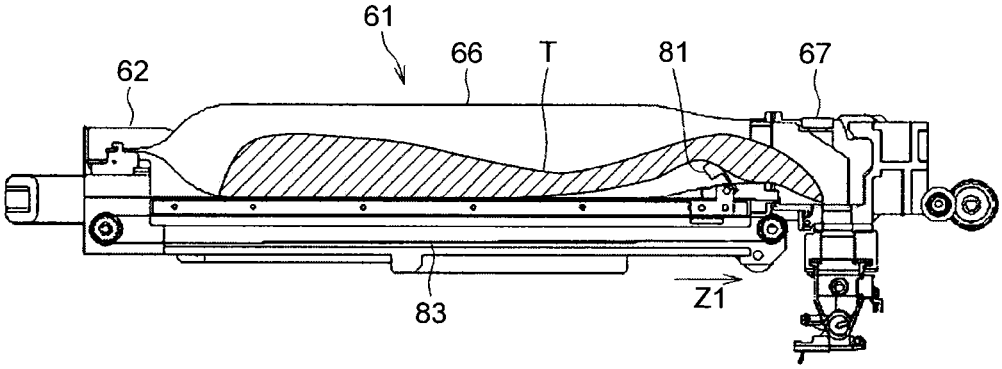

A toner delivery operation (conveying operation) by the toner conveying apparatus 8 according to the present embodiment will be described below with reference to FIG. 18. In FIGS. 18(*a*), (*b*) and (*c*), the toner cartridge 61 is attached to the pullout tray 62 and the pullout tray 62 is housed in the apparatus main body. Therefore, a driving device of the apparatus main body can transmit a driving force to the belt member 83 to reciprocate the delivery member 81.

FIG. 18(*a*) illustrates a state in which the remaining amount of toner T in the toner containing unit 66 is relatively reduced. In this case, the delivery member 81 is standing because of the biasing force applied by the torsion coil spring. Therefore, the bottom surface of the toner containing unit 66 is pushed inward by the standing delivery member 81. The delivery member 81 moves in the delivery direction Z1 while pushing the toner containing unit 66 inward, so that the toner T is pushed and moved toward the discharging unit 67 by the delivery member 81. The toner T that is moved toward the discharging unit 67 side is discharged downward from the discharging unit 67 by the inertia force and weight. The inclined surface 67*c* as mentioned above is provided in the discharging unit 67 (see FIG. 4(*d*)) so that the toner T is discharged out while sliding downward on the inclined surface 67*c*. In the embodiment, an oscillating means for slightly oscillating the discharging unit 67 is further provided. By causing the oscillating means to slightly oscillate the discharging unit 67, it is possible to accelerate the discharge of the toner T from the discharging unit 67. In addition, in the embodiment, the discharging unit 67 is provided with a vibration applying unit (not illustrated) which applies a minute vibration to the discharging unit 67. When a minute vibration is applied to the discharging unit 67 by the vibration applying unit, the discharge of the toner T from the discharging unit 67 is promoted and the attachment of the toner T to the discharging unit 67 is prevented.

In the embodiment, the discharging unit 67 is vibrated with the number of times of vibration of 30 Hz and amplitude of 0.3 mm. The number of times of vibration and the amplitude are different in accordance with the type of the toner in use, but as the satisfactory ranges of the number of times of vibration and the amplitude, the number of times of vibration is 10 to 100 Hz and the amplitude is 0.1 to 1 mm. When the number of times of vibration is smaller than 10 Hz or the amplitude is smaller than 0.1 mm, the effect of promoting the discharge of the toner and the effect of preventing the attachment of the toner to the discharging unit 67 decrease. On the other hand, when the number of times of vibration is larger than 100 Hz or the amplitude is larger than 1 mm, the vibration becomes large, and hence the image forming apparatus main body is also vibrated, whereby the image forming operation is influenced. Accordingly, when the number of times of vibration and the amplitude are set within the above-described ranges, it is possible to satisfactorily exhibit the effect of promoting the toner and the effect of preventing the attachment of the toner while suppressing a negative influence on the image forming operation.

Further, FIG. 18(*b*) illustrates a state where a large amount of the toner T is charged inside the toner containing unit 66. In this way, the toner containing unit 66 becomes solid due to the charging of the toner T and becomes heavy due to the weight of the toner T at a position where a large amount of the toner T is present inside the toner containing unit 66. For this reason, as illustrated in FIG. 18(*b*), the delivery member 81 becomes a laid state, so that the inward pressing amount of the delivery member 81 with respect to the toner containing unit 66 decreases. Then, the delivery member 81 moves in the delivery direction Z1 in a laid state at a position where the large amount of the toner T is present. Subsequently, when the delivery member 81 reaches a position where the amount of the toner T is comparatively small in the vicinity of the discharging unit 67, the delivery member 81 becomes a standing state as illustrated in FIG. 18(*c*), so that the inward pressing amount of the delivery member 81 increases. In this way, the inward pressing amount increases since the delivery member 81 stands in the vicinity of the discharging unit 67, and hence the toner T may be sequentially discharged from the toner T which is easily movable in the vicinity of the discharging unit 67.

According to the configuration of the embodiment described above, since the inward pressing amount of the delivery member 81 changes in response to the toner amount inside the toner containing unit 66, the toner may be stably delivered to the discharging unit 67 regardless of the remaining toner amount inside the toner containing unit 66. Further, according to the configuration of the embodiment, the toner may be conveyed by the source tray, and hence the aggregation or the degradation of the toner may be suppressed. Further, since the large vibration or the large impact does not occur in the invention, there is no need to worry about the occurrence of the abnormal image due to the vibration.

It is possible to adjust the pushing force of the delivery member 81 to an appropriate value by appropriately changing a biasing force, which is applied to the delivery member 81 by the torsion coil spring, depending on the material (flexibility or the like) or the maximum toner capacity of the toner containing unit 66. In this case, even when the biasing force applied by the torsion coil spring is increased, because the rotation of the delivery member 81 can be regulated by the regulating unit (not illustrated) in the embodiment, it is possible to maintain the predetermined standing state of the delivery member 81.

In the embodiment, because the base member 80 comes into contact with the switches 87 and 88 to switch the moving direction of the delivery member 81 between the delivery direction Z1 and the return direction Z2. Therefore, it is possible to continuously deliver the toner.

When the delivery member 81 is returned to the initial position, the delivery member 81 is switched to the laid state. Therefore, it is possible to prevent the delivery member 81 moving in the return direction Z2 from conveying the toner backward. Furthermore, as described with reference to FIGS. 16 and 17, the operation of switching the delivery member 81 between the standing state and the laid state can be realized by a simple mechanism in which the leg members 82 are inserted into the concave portions 62*i* or the concave portions 62*j*. Therefore, it is possible to simplify the overall configuration. It may be possible to use through holes instead of the concave portions 62*i* and 62*j*.

Further, as described above, the toner cartridge 61 is attached to the pullout tray 62 while receiving an appropriate tension in a such a manner that the discharging unit 67 provided in one end portion thereof is fixed and the hole portion 66*b* provided in the other end portion is locked while being biased in the opposite direction to the discharging unit 67 by the hook portion 62*b*. For this reason, even when the toner containing unit 66 is pressed by the delivery member 81, the toner containing unit 66 may be stably held at a predetermined position. Accordingly, the toner containing unit 66 is not deformed into an appropriate shape by the delivery operation of the delivery member 81 and the entire toner containing unit 66 is moved by the pressing force of the delivery member 81, thereby preventing a problem in which the toner is not delivered or the toner inside the toner containing unit 66 is delivered to the last. Accordingly, according to the embodiment, it is possible to stabilize the toner conveying amount from the toner containing unit 66 and reduce the remaining toner amount inside the toner containing unit 66.

Figure 29:
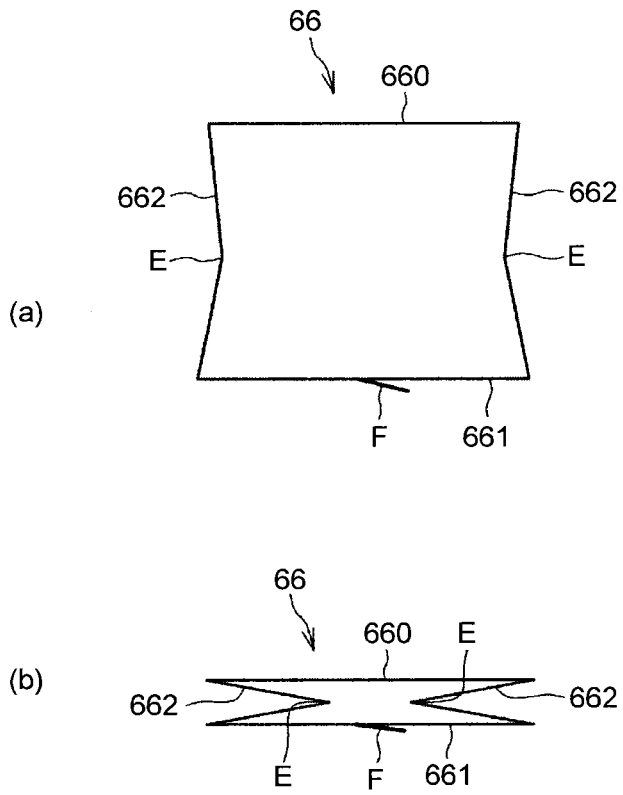
FIG. 29 is a cross-sectional view of the toner containing unit which is formed by one sheet material, where FIG. 29(*a*) is a diagram illustrating a state where the toner containing unit is expanded and FIG. 29(*b*) is a diagram illustrating a state where the toner containing unit is folded.

Further, since the toner cartridge 61 is provided with the air passage portion 67*i* (see FIG. 4(*a*) or FIG. 4(*d*)) as described above, the air inside the toner containing unit 66 is discharged to the outside through the air passage portion 67*i* when the toner containing unit 66 is pressed inward by the delivery member 81 so as to be deformed during the toner delivery operation as illustrated in FIG. 29. Accordingly, an increase in internal pressure with the deformation of the toner containing unit 66 may be prevented, thereby preventing a problem in which the toner supply amount (the discharge amount) excessively increases or the toner flies to the developing device at the conveying destination.

Figure 19:
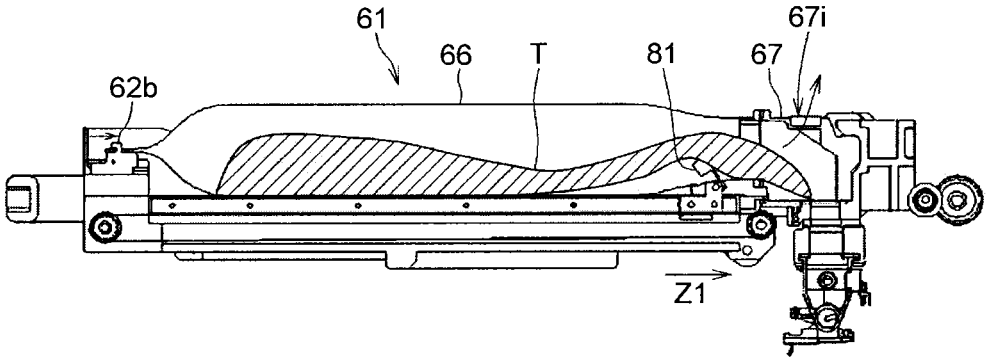
FIG. 19 is a diagram illustrating a state where air is discharged from an air passage portion.
Figure 20:
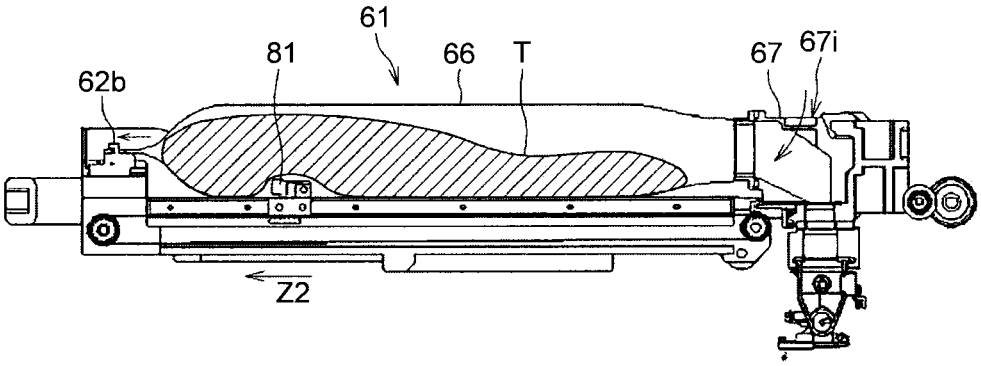
FIG. 20 is a diagram illustrating a state where air is suctioned from the air passage portion.

Further, when the toner cartridge 61 is pressed toward the discharging unit 67 by the moving delivery member 81 during the toner delivery operation as illustrated in FIG. 19, the hook portion 62*b* which locks the end portion of the toner cartridge 61 is also pulled toward the discharging unit 67. Subsequently, when returning the delivery member 81 as illustrated in FIG. 20, the toner cartridge 61 is pulled back toward the opposite direction to the discharging unit 67 by the torsional coil spring 62*k* (see FIG. 6(*a*)) which is attached to the hook portion 62*b*. At this time, since the toner containing unit 66 is expanded due to the backward pulling operation, the toner inside the toner containing unit 66 is scattered by the air which is suctioned to the inside from the air passage portion 67*i*. In this way, since the toner containing unit 66 is expanded so as to be easily returned to the original shape by suctioning the air through the air passage portion 67*i* after the toner delivery operation, the toner may be scattered by the suctioned air. Accordingly, it is possible to prevent packing in which the toner may not be discharged due to the adhesion of the facing inner surfaces of the toner containing unit 66 or blocking in which the toner is aggregated so as to block the conveying path. As a result, the toner conveying performance may be improved, and hence the toner may be stably conveyed.

Particularly, in the embodiment, since the hook portion 62*b* is first pulled toward the discharging unit 67 by the delivery operation and is pulled backward by the biasing force of the torsional coil spring 62*k*, the air suctioning operation of the toner containing unit 66 may be further activated compared to the case where the hook portion 62*b* is fixed. Accordingly, a large amount of air may be suctioned into the toner containing unit 66, and hence the toner scattering effect may be improved. Further, since the hook portion 62*b* is attached through the torsional coil spring 62*k*, an abrupt increase in load applied to the toner cartridge 61 by the delivery member 81 during the delivery operation may be reduced, and hence the wear damage of the toner cartridge 61 may be suppressed.

Further, since the end portion of the toner cartridge 61 is substantially fixed to the same position by the hook portion 62*b*, the uneven deformation of the toner containing unit 66 with the toner delivery operation may be suppressed, and hence a toner conveying failure or an excessive load on the toner may be suppressed. Furthermore, even when the hook portion 62*b* is attached through the elastic member such as the torsional coil spring 62*k*, the end portion of the toner cartridge 61 may be substantially fixed to the same position. Accordingly, the uneven deformation of the toner containing unit 66 is suppressed, so that the toner conveying failure or the excessive load on the toner may be suppressed.

Further, when the hook portion 62*b* is attached through the elastic member, the end portion of the toner containing unit 66 is not pulled backward by the biasing force of the elastic member. However, since the toner containing unit 66 is expanded due to its restoring property or the weight of the toner, air may be suctioned from the air passage portion 67*i* to a certain extent. Accordingly, when the toner containing unit 66 is expanded so as to be easily returned to the original shape, the toner may be scattered by the suctioned air, and hence the toner conveying performance may be improved or stabilized.

Further, in the embodiment, since the discharging unit 67 is provided with the air passage portion 67*i*, air may be easily discharged particularly near the discharging unit 67, and hence the spouting of the toner may be highly prevented. That is, since the air passage portion 67*i* is provided at the downstream side of the toner input port 66*a* in the toner delivery direction by the delivery member 81, the extruded air may be effectively discharged along with the toner, and hence the scattering of the toner may be suppressed. Further, since the air passage portion 67*i* is provided in the upper surface of the discharging unit 67, the air passage portion may be prevented from being clogged by the toner. Further, since the air passage portion 67*i* is provided so as to face the discharge port 67*b* provided in the discharging unit 67, air may be further effectively discharged.

Figure 21:
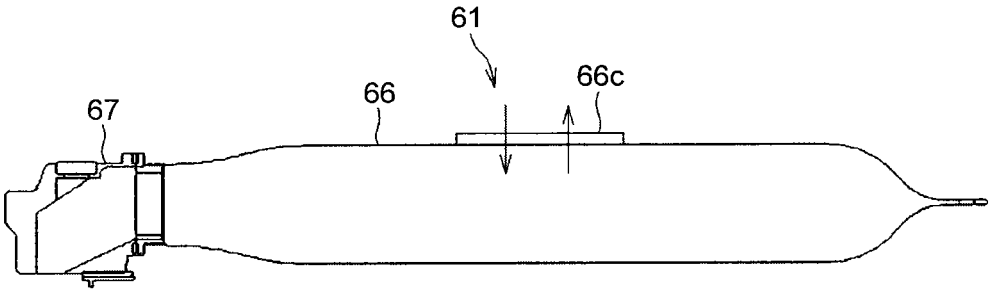
FIG. 21 is a diagram illustrating another embodiment of a toner cartridge.

Further, as illustrated in FIG. 21, an air passage portion 66*c* may be provided in the toner containing unit 66. In this case, since air may be suctioned at a position near the contained toner, the toner scattering effect may be improved. Further, it is desirable that the air passage portion 66*c* is provided in the upper surface of the toner containing unit 66 in order to prevent the filter provided in the air passage portion 66*c* from being clogged by the toner.

Further, the toner containing unit 66 may be formed as a member that has an air passage property. In this case, since it is not necessary to separately provide an air passage hole or a filter in the toner containing unit 66 so as to form the air passage portion, the number of components may be decreased, and hence the above-described operation and effect may be easily realized. Further, since the clogging hardly occurs compared to a case where the filter is partly provided, the air passage property may be continuously ensured for a long period of time. Further, since a problem such as deformation or damage of the air passage portion or peeling of the filter with the deformation of the toner containing unit 66 does not occur, the reliability improves.

As described above, in the embodiment, the hole portion 66*b* is locked to the hook portion 62*b*, but the toner conveying performance may be degraded depending on the locking position.

Figure 26:
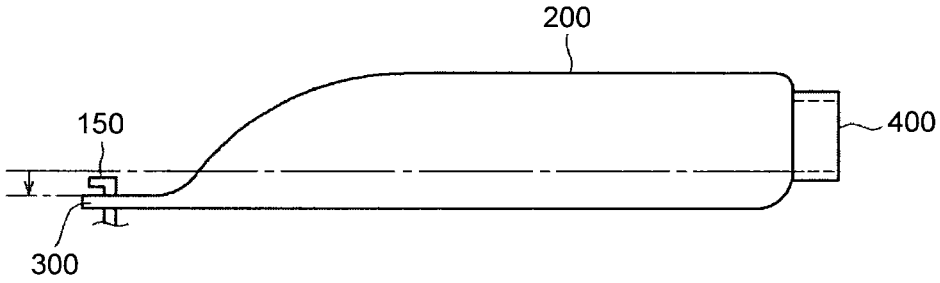
FIG. 26 is a diagram illustrating a configuration when the portion to be locked of the container is disposed at the lower side in relation to the lower end of the opening portion.
Figure 26:
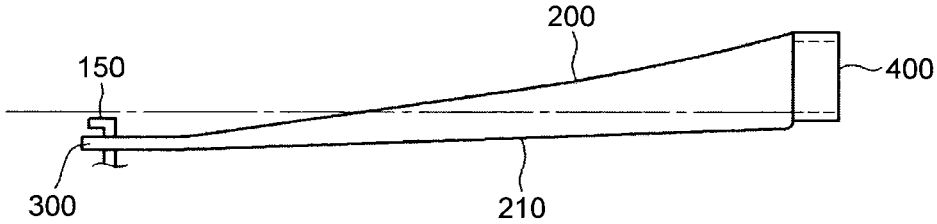

For example, in a case where a portion to be locked 300 of a container 200 locked to a locking portion 150 of the counter member is disposed below the lower end of an opening portion 400 as illustrated in FIG. 26(*a*), when the toner amount in the container 200 decreases with the discharging of the toner therein, the container 200 is deformed in a shape illustrated in FIG. 26(*b*). That is, since the portion to be locked 300 is fixed to a position below the lower end of the opening portion 400 in this case, when the toner amount decreases, a bottom surface 210 of the container 200 is inclined downward from the opening portion 400 toward the portion to be locked 300. Accordingly, since the bottom surface 210 is inclined particularly in a state where the amount of the toner inside the container 200 is small, the toner which is moved to the opening portion 400 is returned due to the influence of the gravity. As a result, the amount of the delivered toner decreases, so that the conveying speed (the discharge speed) decreases and the amount of the toner remaining inside the container to the last increases.

Figure 23:
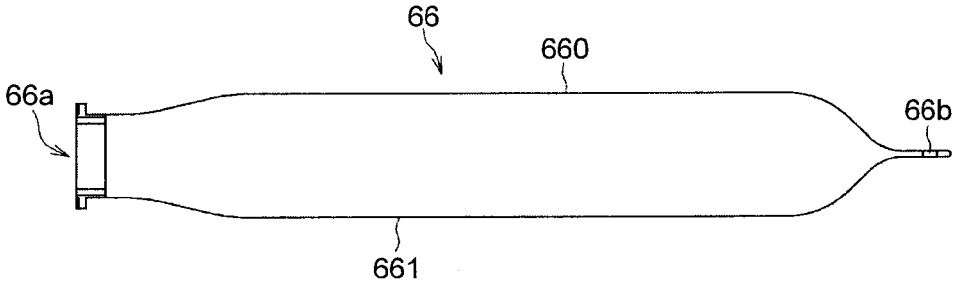
FIG. 23(*a*) is a diagram illustrating a state where the toner containing unit does not decrease in volume, and FIG. 23(*b*) is a diagram illustrating a state where the toner containing unit decreases in volume.
Figure 23:
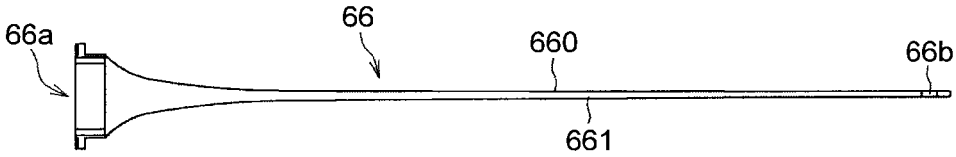
Figure 24:
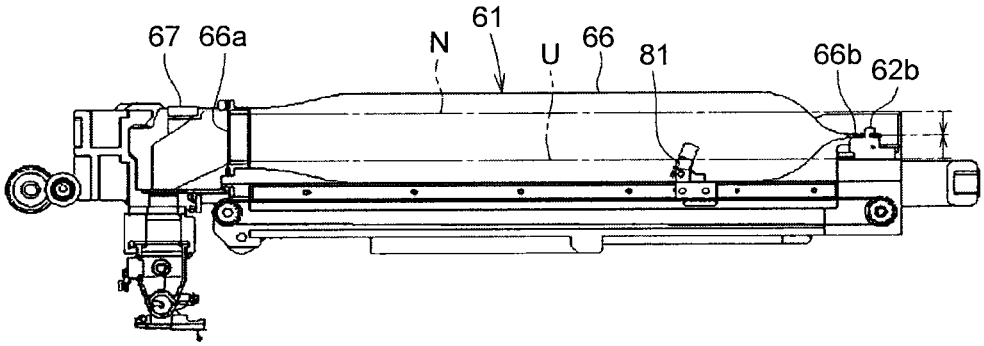
FIG. 24 is a diagram illustrating a positional relation between a portion to be locked and an opening portion in the toner containing unit.

Therefore, a configuration of the powder container capable of stabilizing the powder conveying amount and decreasing the remaining powder amount will be described by using FIGS. 23 to 25.

The toner containing unit 66 decreases in volume as the toner therein is delivered. Specifically, the toner containing unit decreases in volume while being deformed so that an upper surface 660 and a lower surface 661 of the toner containing unit 66 move close to each other by changing the state illustrated in FIG. 23(*a*) to the state illustrated in FIG. 23(*b*). In this way, since the toner containing unit 66 automatically decreases in volume with a decrease in the amount of the toner therein, the remaining toner amount may be recognized from the appearance thereof. Further, since the toner containing unit 66 automatically decreases in volume, it is not necessary to make an effort for crushing the toner containing unit 66 when discarding the used toner containing unit 66, and hence the convenience improves. Furthermore, since the entire toner containing unit 66 is formed as a deformable member in the embodiment, the used toner containing unit 66 may be folded in a further compact size. Accordingly, the environmental burden corresponding to the collection, the carriage, or the recycle may be reduced. Furthermore, when the toner containing unit 66 may decrease in volume with the discharging of the toner, the toner containing unit may be formed as a member of which only a part is deformable.

Further, when the toner containing unit 66 decreases in volume, the lower surface (the bottom surface) 661 of the toner containing unit 66 is disposed so as to be gradually inclined downward from the horizontal shape in a direction from the hole portion 66*b* as the portion to be locked toward the opening portion 66*a*. This is because the hole portion 66*b* of the toner containing unit 66 is disposed at the upper side in relation to the lower end (the position indicated by the one-dotted chain line U of FIG. 24) of the opening portion 66*a* in the installation posture of the toner containing unit 66 in use as illustrated in FIG. 24. That is, since the position of the fixed hole portion 66*b* does not change even when the toner containing unit 66 decreases in volume, the lower surface 661 of the toner containing unit 66 is disposed so as to be gradually inclined downward from the upper hole portion 66*b* toward the lower end of the lower opening portion 66*a*.

In this way, in the embodiment, since the lower surface 661 of the toner containing unit 66 is not inclined downward toward the opposite side to the opening portion 66*a* even when the amount of the toner inside the toner containing unit 66 decreases so that the volume of the toner containing unit decreases differently from the case illustrated in FIG. 26, it is possible to suppress the toner which is moved to the opening portion 66*a* from being returned due to the influence of the gravity. Accordingly, it is possible to suppress a decrease in toner conveying amount due to the returning of the toner from the opening portion 66*a*, and hence to stabilize the toner conveying amount. Further, it is possible to decrease the amount of the toner which finally remains inside the toner containing unit 66.

In addition, in the embodiment, since the end portion of the toner containing unit 66 is pulled by the hook portion 62*b*, a decrease in the volume of the toner containing unit 66 is promoted and the shape of the toner containing unit 66 is also stabilized by the tensile force which is generated at this time. Accordingly, it is possible to further effectively suppress the retuning of the toner.

Furthermore, it is desirable that the lower surface 661 is disposed in at least a horizontal shape when the toner containing unit 66 decreases in volume in order to suppress the returning of the toner. Accordingly, it is desirable that the position of the hole portion 66*b* is equal to the height of the lower end of the opening portion 66*a* or is higher than the lower end.

However, even when the hole portion 66*b* is disposed at a position equal to or higher than the lower end of the opening portion 66*a*, if the hook portion 62*b* which locks the hole portion 66*b* is present below the lower end of the opening portion 66*a*, the hole portion 66*b* is disposed below the lower end of the opening portion 66*a* while the hook portion 62*b* is hung by the hole portion 66*b*. Accordingly, it is also necessary to dispose the position of the hook portion 62*b* so as to be equal to the height of the hole portion 66*b* and to be equal to or higher than the lower end of the opening portion 66*a*.

Here, when the hook portion 62*b* is disposed above the upper end (the position indicated by the one-dotted chain line N of FIG. 24) of the opening portion 66*a*, the inclination degree of the toner containing unit 66 with respect to the horizontal direction increases in a case where the toner containing unit 66 of the configuration of the embodiment is adopted, and hence it is difficult to dispose the toner containing unit 66 so as to be compact in the vertical direction. Accordingly, it is desirable that the positions of the hook portion 62*b* and the hole portion' 66*b* are equal to or lower than the upper end of the opening portion 66*a* when disposing the toner containing unit 66 so as to be compact in the vertical direction.

In addition, in the embodiment, since the position of the opening portion 66*a* or the height of the delivery member 81 is set as below, it is possible to further stabilize the toner conveying amount and to decrease the remaining toner amount.

Figure 25:
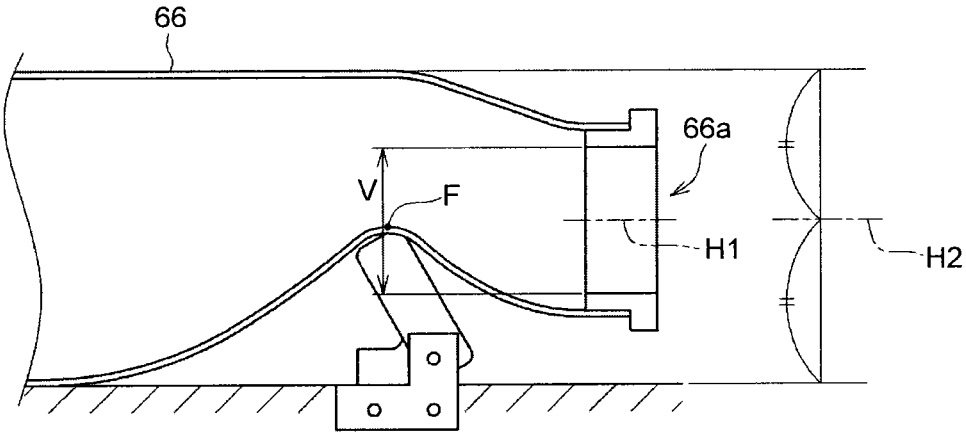
FIG. 25 is a diagram illustrating a position of the opening portion in the toner containing unit and a position of an inner surface top portion which is pressed inward by a delivery member.

Specifically, the opening portion 66*a* is disposed at the center portion of the end portion of the toner containing unit 66 in the vertical direction as illustrated in FIG. 25. When the opening portion 66*a* is disposed below the toner containing unit 66 differently from this configuration, the amount of the toner which is attached to the inner surface above the opening portion 66*a* due to the toner delivery operation by the delivery member 81 increases, and hence the remaining toner amount increases. In contrast, when the opening portion 66*a* is disposed at the upper portion of the toner containing unit 66, the position of the opening portion 66*a* relatively increases with respect to the height of the delivery member 81, and hence the amount of the delivered toner decreases. For this reason, since the opening portion 66*a* is disposed at the center portion of the end portion of the toner containing unit 66 in the vertical direction as described above, it is possible to further stabilize the toner conveying amount and to decrease the remaining toner amount.

Furthermore, the "case where the opening portion 66*a* is disposed at the center portion of the end portion of the toner containing unit 66 in the vertical direction" is not limited to the case where the vertical center line H1 of the opening portion 66*a* illustrated in FIG. 25 is disposed so as to completely match the vertical center line H2 of the bag-like main body of the toner containing unit 66, but the vertical center lines may be substantially present at the same position (the substantial center in the vertical direction).

Further, when delivering the powder by the delivery member 81 as illustrated in FIG. 25, it is desirable that the top portion F of the inner surface of the portion where the toner containing unit 66 is pressed inward by the delivery member 81 is equal to or higher than the lower end of the opening portion 66*a* or is equal to or lower than the upper end (within the range indicated by the reference numeral V of FIG. 25). When the top portion F of the inward pressing portion is lower than the lower end of the opening portion 66*a*, the toner conveying amount decreases. In contrast, when the top portion F of the inward pressing portion is higher than the upper end of the opening portion 66*a*, the toner adheres to the inner surface above the opening portion 66*a* by the toner delivery operation, and hence the remaining toner amount increases. For this reason, since the top portion F of the inner surface of the inward pressing portion is equal to or higher than the lower end of the opening portion 66*a* or is equal to or lower than the upper end as described above, it is possible to further stabilize the toner conveying amount and to decrease the remaining toner amount.

Furthermore, it is desirable that the top portion F of the inner surface of the inward pressing portion is equal to or higher than the lower end of the opening portion 66*a* or is equal to or lower than the upper end when the delivery member 81 is present near at least the opening portion 66*a*. Accordingly, even when the top portion F is lower than the lower end of the opening portion 66*a* when the delivery member 81 is in the laid state upon starting the delivery operation as illustrated in FIG. 18(*b*), it is desirable that the top portion F is equal to or higher than the lower end of the opening portion 66*a* when the delivery member 81 reaches the vicinity of the opening portion 66*a* and becomes the standing state as illustrated in FIG. 18(*c*).

Further, since a rotation operation of a fixing arm 71 and an opening and closing operation of the slide shutter 67*d* may be performed along with a drawing and receiving operation of the pullout tray 62 (the attachment and detachment operation to the fixing unit 63) in the embodiment as described above FIG. 7, the toner cartridge 61 may be easily fixed and released and the discharge port may be easily opened and closed, thereby obtaining the excellent operability. Further, since the spring member 72 passes by the rotation support point of the fixing arm 71 with the rotation of the fixing arm 71, the spring member 72 is biased in a direction to rotate the fixing arm 71, and hence the fixing arm 71 may be reliably held at the switched position by the biasing force. Further, since the backlash in the vertical direction of the discharging unit 67 may be prevented by causing the projection portion 67*h* to abut the notch portion 70*a*, the fixing state of the toner cartridge 61 may be stabilized. Further, in the embodiment, the toner containing unit 66 and the discharging unit 67 are adapted to be integrally attached to or detached from the pullout tray 62, but the toner containing unit 66 may be adapted to be attached or detached while the discharging unit 67 remains in the pullout tray 62 (or the fixing unit 63).

While the embodiment of the invention has been described, the invention is not limited to the above-described embodiment, and various modifications may be, of course, made without departing from the spirit of the invention. In the above-described embodiment, the entire toner containing unit 66 is formed as a deformable member, but only a position which is pressed inward by the delivery member 81 may be formed as a deformable member.

Further, the toner containing unit 66 may be formed as a transparent member or may be formed as a semi-transparent or opaque member. Further, the toner containing unit 66 may be colored in the same color as that of the toner therein.

Further, when the abrasion resistance of the bottom surface (the contact surface with respect to the delivery member 81) of the toner containing unit 66 is increased or the bottom surface is formed as a thin film having a small friction coefficient using various methods such as PVD or CVD, the abrasion of the bottom surface of the toner containing unit 66 due to the sliding of the delivery member 81 may be suppressed. Alternatively, when at least one of the delivery member 81 and the toner containing unit 66 is provided with a mechanism for applying lubricant, the abrasion may be suppressed by decreasing the abrasion therebetween.

Further, when a folding line is formed in the toner containing unit 66 in advance and the toner amount therein decreases, the toner containing unit 66 may be folded along the folding line with the delivery operation of the delivery member 81. In this case, since the toner containing unit 66 may decrease in volume, it is possible to reduce cost when discarding or collecting the used toner containing unit 66. Further, since the toner containing unit 66 is easily deformable, the toner may be easily discharged.

Further, since the portion provided with the hole portion 66*b* of the toner containing unit 66 receives a force by being pulled by the hook portion 62*b*, it is desirable that the portion has sufficient strength in order to prevent the damage or the deformation thereof.

Figure 22:
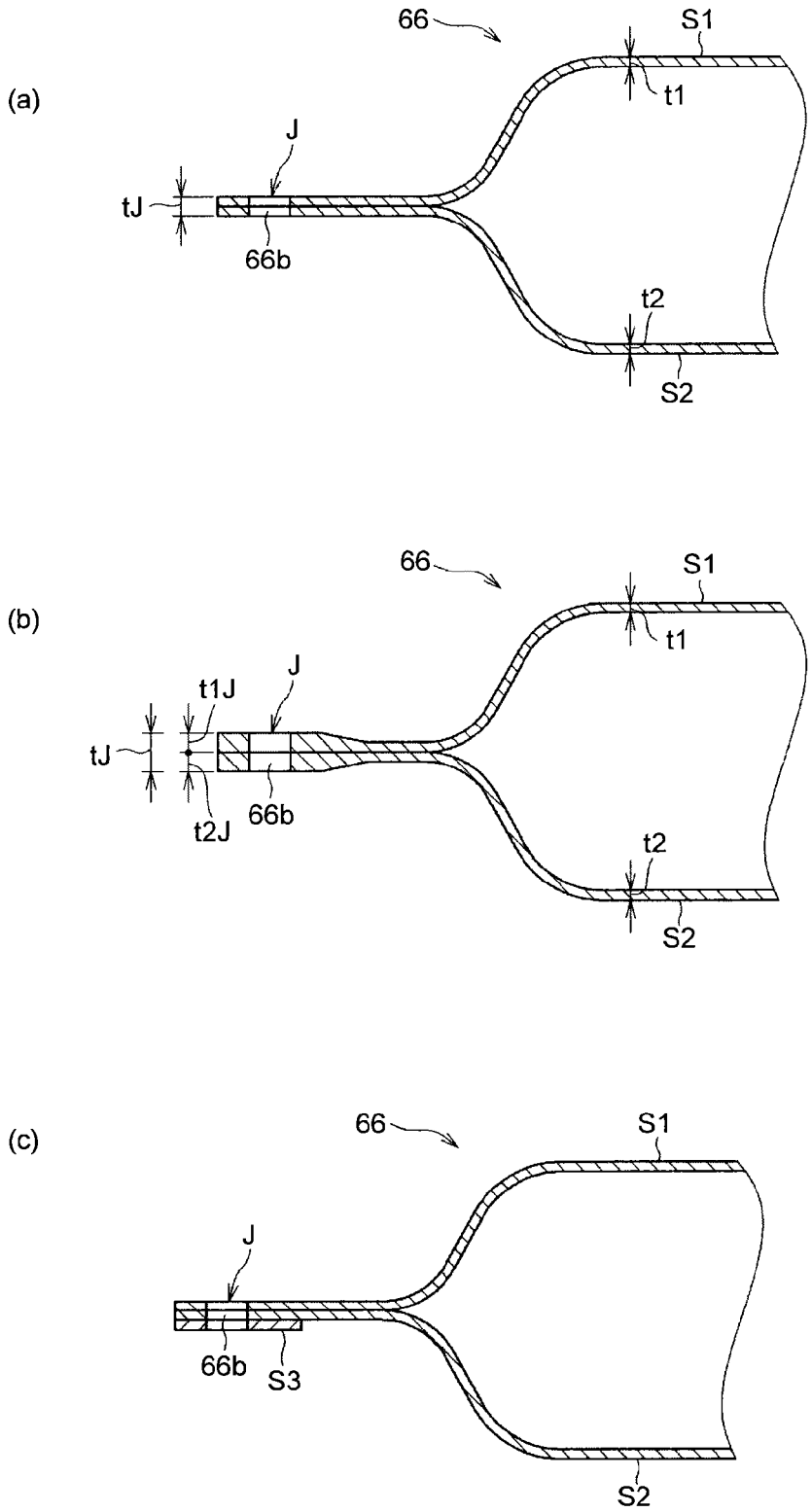
FIG. 22 is a main enlarged cross-sectional view illustrating a configuration in which strength of a portion provided with a hole portion of a toner containing unit is improved.

For example, when the portion provided with the hole portion 66*b* (hereinafter, referred to as a "portion to be hung J") is formed by bonding two sheet materials S1 and S2 constituting the upper and lower surfaces of the toner containing unit 66 of the drawing as illustrated in FIG. 22(*a*), the portion to be hung J may be thickened and the strength thereof improves. Specifically, when the thicknesses t1 and t2 of the upper and lower sheet materials S1 and S2 are respectively set to 100 μm, the thickness tJ of the portion to be hung J becomes 200 μm.

In order to further improve the strength, as illustrated in FIG. 22(*b*), the thicknesses t1J and t2J of the upper and lower sheet materials S1 and S2 at the portion to be hung J may be thicker than the thicknesses t1 and t2 of the other portion. Specifically, when the thicknesses t1 and t2 of the upper and lower sheet materials S1 and S2 are 100 μm and only the thicknesses t1J and t2J of the portion to be hung J increase by 150 μm, the thickness tJ of the portion to be hung J which is formed by bonding the upper and lower sheet materials S1 and S2 may become 300 μm.

Further, the strength may be improved by separately attaching the reinforcing sheet material S3 to the portion to be hung J as illustrated in FIG. 22(*c*). When the strength of the portion to be hung J is improved as described above, the damage or the deformation of the portion to be hung J may be prevented. Accordingly, since the posture of the toner containing unit 66 may be satisfactorily held for a long period of time, the toner conveying stability according to the movement of the delivery member 81 may be ensured.

Second Embodiment

Referring to FIGS. 27 to 33, a second embodiment will be described in detail. The configuration which is not particularly described in the second embodiment is the same as that of the first embodiment.

In the related art, there is known a developer supply device which inserts a nozzle into a flexible container containing toner, suctions the toner through the nozzle by a pump, and supplies the toner to a developing device (see Japanese Patent Publication Laid-open No. 2005-91879). In such a toner supplying system, the flexible container automatically decreases in volume as the toner is suctioned by the pump. Then, since the container is crushed in a state where the toner inside the container substantially disappears, it is possible to reduce cost necessary for collecting, carrying, and recycling the used container. Further, since the volume of the container decreases in response to the remaining toner amount inside the container, there is an advantage that the remaining toner amount may be recognized from the appearance thereof.

However, in the type of suctioning the toner by the pump, the discharge port of the container needs to be disposed at the lower side in order to easily suction the toner from the discharge port (the suction outlet). When the container is disposed in the horizontal direction by directing the discharge port to the lateral side, the toner may not be aggregated near the discharge port due to the gravity, and the toner may remain inside the container without being discharged to the outside in a cross-linked state. Accordingly, it is difficult to horizontally dispose the container of a type that suctions the toner by the pump, and there is a large limitation in the arrangement of the container. Specifically, it is necessary to dispose the container so as to be inclined with respect to the horizontal plane by 50° or more in order to smoothly discharge the toner inside the container. Accordingly, in the configuration that uses such a kind of a container, the installation space for the container which is substantially elongated in the longitudinal direction needs to be ensured, which is not appropriate for causing the entire size of the image forming apparatus to be compact in the longitudinal direction.

Further, as a method of discharging the toner from the flexible container to the outside of the container without using the pump, there is proposed a method of pressing a convex member from the outside of the container so as to extrude the toner therein from the discharge port (see Patent Literature 2). According to this method, the toner may be discharged even when the container is disposed so as to be elongated in the horizontal direction.

However, in the method of discharging the toner from the flexible container without using the pump, the container may not automatically decrease in volume with the discharging of the toner. For this reason, there is a need to perform an operation of crushing the container so as to decrease the volume of the used container. Further, the remaining toner amount may not be recognized from the appearance.

In the embodiment, the above-described problem is solved by providing the powder container which automatically decreases in volume with a decrease in the amount of the powder therein without using the pump, the toner cartridge which uses the powder container, and the powder conveying apparatus and the image forming apparatus which include the powder container.

Figure 27:
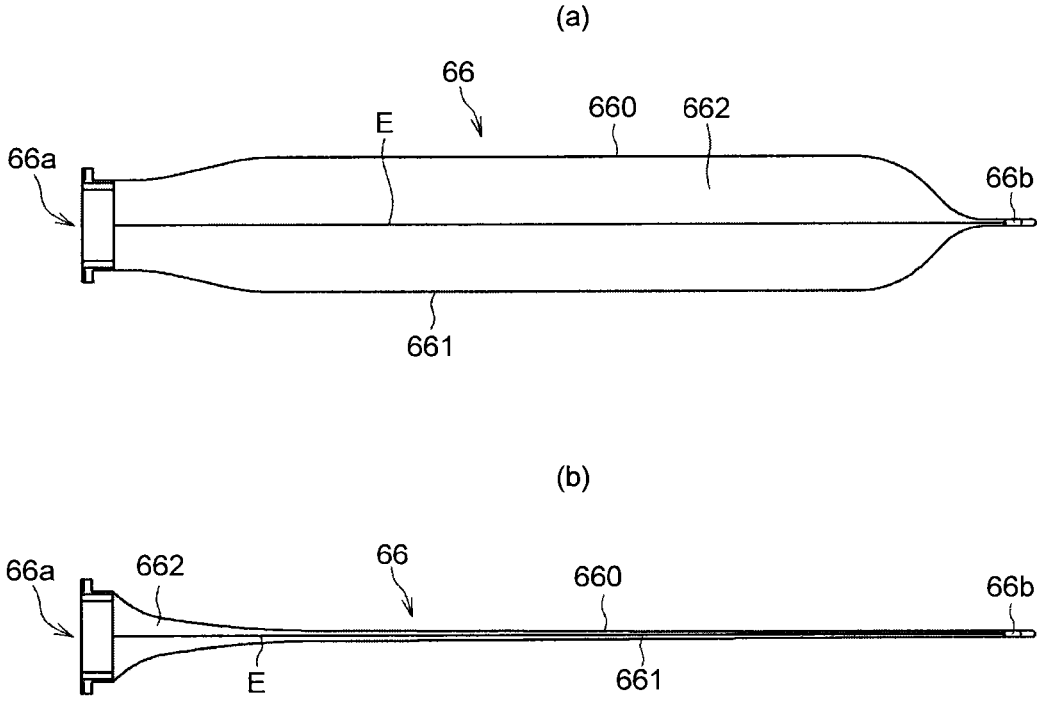
FIG. 27 is a longitudinal sectional view of the toner containing unit, where FIG. 27(*a*) is a diagram illustrating a state where the toner containing unit is expanded and FIG. 27(*b*) is a diagram illustrating a state where the toner containing unit is folded.
Figure 28:
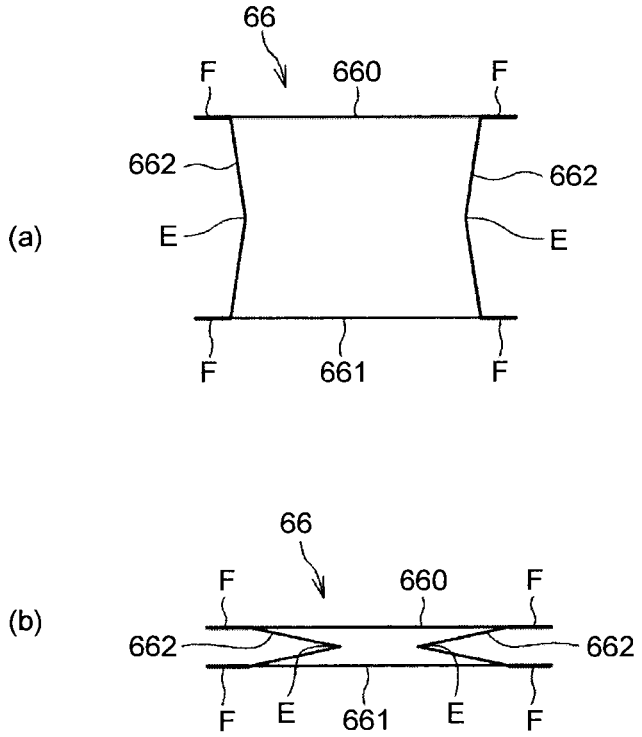
FIG. 28 is a cross-sectional view of the toner containing unit, where FIG. 28(*a*) is a diagram illustrating a state where the toner containing unit is expanded and FIG. 28(*b*) is a diagram illustrating a state where the toner containing unit is folded.

FIG. 27 is a longitudinal sectional view of the toner containing unit 66, and FIG. 28 is a cross-sectional view of the toner containing unit 66. Further, in FIGS. 27 and 28, FIGS. 27(*a*) and 28(*a*) illustrate a state where the toner containing unit 66 is expanded and FIGS. 27(*b*) and 28(*b*) illustrate a state where the toner containing unit 66 is folded.

As illustrated in FIGS. 27 and 28, a folding line E which extends in the longitudinal direction may be formed in both side surfaces 662 of the toner containing unit 66. In FIG. 27, the folding line E is formed in a linear shape throughout the entire area from one end portion provided with the opening portion 66*a* of the toner containing unit 66 to the other end portion opposite thereto. Further, the folding line E may be formed so that the side surface 662 of the toner containing unit 66 is folded inward.

Further, in the example illustrated in FIG. 28, the upper surface 660, the lower surface 661, and left and right side surfaces 662 of the toner containing unit 66 are respectively formed of different sheet materials; and these four sheet materials are bonded to each other so as to form a bag-like toner containing unit 66. In this case, as illustrated in FIG. 28, an adhering margin F which bonds the respective sheet materials to each other is needed at four positions.

Further, as illustrated in FIG. 29, the toner containing unit 66 may be formed by forming one sheet material in a bag shape. That is, the upper surface 660, the lower surface 661, and the left and right side surfaces 662 are formed in a manner such that one sheet material is bonded in a cylindrical shape and four corners of the end surfaces are folded in a mountain shape. Further, the folding line E is formed by folding the center portion of each side surface 662 in a valley shape. In this case, since the adhering margin F of the sheet material is only one position, the number of the adhering margins F is smaller than that of the toner containing unit 66 illustrated in FIG. 28. For this reason, the toner containing unit 66 illustrated in FIG. 29 has an advantage that the arrangement space of the toner containing unit 66 may be decreased since the number of the adhering margins F is small. Further, since the toner charging space may be widened in a portion without the adhering margin F, the restricted space inside the image forming apparatus may be effectively used.

On the other hand, since the toner containing unit 66 which is illustrated in FIG. 28 has the adhering margins F at four corners, the strength improves compared to the toner containing unit 66 illustrated in FIG. 29. For this reason, the entire rigidity of the toner containing unit 66 increases, and hence there is an advantage that the toner containing unit 66 may be easily carried.

Further, in the second embodiment, the sheet materials adhere to each other by heat-bonding, but the sheet materials may adhere to each other by using an adhesive or a two-sided adhesive tape. Furthermore, in a case where the sheet materials adhere to each other by heat-bonding, the adhesiveness improves by using LDPE in the innermost sheet layer.

In the second embodiment, the entire toner containing unit 66 is formed as a deformable member, and this is advantageous in that the environmental burden corresponding to the collection, the carriage, and the recycle may be reduced by folding the used toner containing unit 66 in a compact size. Here, only a part of the toner containing unit 66 may be formed as a deformable member.

Next, a state where the toner cartridge 61 is attached to the pullout tray 62 will be described. Even in the second embodiment, the toner cartridge 61 is attached to the pullout tray 62 by locking the hole portion 66*b* as the portion to be locked to the hook portion 62*b* as in the first embodiment.

In a state where the toner containing unit 66 is locked to the hook portion 62*b*, a pulling force acts on the toner containing unit 66 in the longitudinal direction by the hook portion 62*b*. That is, a pulling force acts in a direction in which the folding line E extends, and hence an inward folding force along the folding line E occurs in the toner containing unit 66 by the pulling force. For this reason, when the toner inside the toner containing unit 66 decreases, the toner containing unit 66 is folded along the folding line E, and decreases in volume while being deformed so that the upper surface and the lower surface of the toner containing unit 66 become closer to each other. Then, when the toner inside the toner containing unit 66 substantially disappears, the toner containing unit 66 is crushed in a flat shape as illustrated in FIG. 27(*b*).

In this way, in the second embodiment, since the toner containing unit 66 automatically decreases in volume while being folded with the consumption of the toner even when the pump is not used, the remaining toner amount may be recognized from the appearance thereof. Further, when the toner inside the toner containing unit 66 substantially disappears, the toner containing unit 66 is folded and crushed, and hence the convenience improves since there is no need to make an effort for crushing the toner containing unit 66 when discharging the used toner containing unit 66.

Further, in the second embodiment, since the folding line E is formed from one end portion near the opening portion 66*a* of the toner containing unit 66 to the other end portion at the opposite side thereto (throughout the entire area in the longitudinal direction), the folding posture of the toner containing unit 66 may be easily controlled. For this reason, the powder discharging performance (the toner conveying action) with the deformation of the toner containing unit 66 may be stabilized, which is advantageous in the toner supply operation.

Further, in the second embodiment, since the toner containing unit 66 is formed so as to be folded inward at the position of the folding line E, it is possible to prevent a problem in which the toner containing unit 66 is damaged due to the contact with the peripherally arranged members or generates abnormal sound due to the contact when the toner containing unit 66 is folded. Further, since the toner containing unit 66 does not contact the peripherally arranged members, there is no need to worry about the suppression in a decrease in volume due to the interruption of the folding deformation of the toner containing unit 66 or degradation in the toner discharging performance according thereto.

Further, it is desirable that the hole portion 66*b* which is hung by the hook portion 62*b* is disposed on the same line as the folding line E as illustrated in FIG. 27. When the hole portion 66*b* is disposed in this way, the toner containing unit 66 may be easily folded along the folding line E and when the toner inside the toner containing unit 66 substantially disappears, the toner containing unit 66 is folded in the thinner size.

While the second embodiment of the invention has been described, the invention is not limited to the above-described embodiment.

Figure 30:
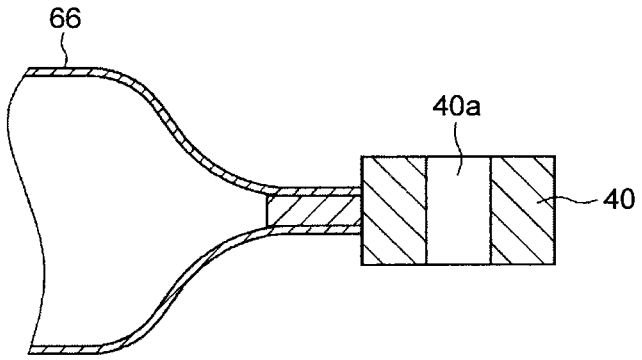
FIG. 30 is a cross-sectional view illustrating a configuration in which a member to be locked adheres to the inner surface of the toner containing unit.

In the above-described embodiment, the hole portion 66*b* as the portion to be locked is directly formed in the end portion of the toner containing unit 66, but a hole portion 40*a* as a portion to be locked may be provided in a member to be locked 40 which is separated from the toner containing unit 66 as illustrated in FIG. 30.

In the embodiment illustrated in FIG. 30, the member to be locked 40 having the hole portion 40*a* formed therein (therethrough) is attached to the end portion of the toner containing unit 66. Specifically, a part of the member to be locked 40 is inserted from the end portion of the toner containing unit 66, and the inserted portion adheres to the inner surface of the toner containing unit 66 so as to be attached thereto. Further, the hole portion 40*a* is formed in the portion which is exposed from the toner containing unit 66 in the member to be locked 40, and the locking portion such as the hook portion 62*b* is inserted and locked to the hole portion 40*a*. Furthermore, the hole portion 40*a* may be also formed in a shape of a bottomed hole or a concave portion other than the through hole if the locking portion of the counter member may be locked.

Figure 31:
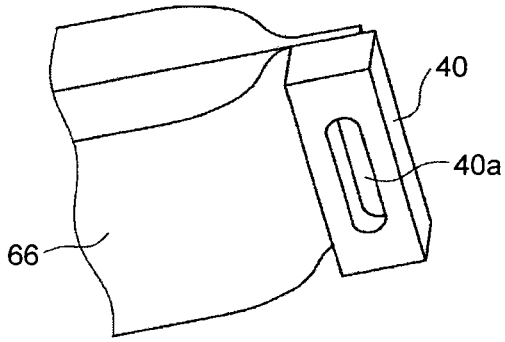
FIG. 31 is a diagram illustrating a configuration in which the member to be locked adheres to the outer surface of the toner containing unit, where FIG. 31(*a*) is a perspective view thereof and FIG. 31(*b*) is a cross-sectional view thereof.
Figure 31:
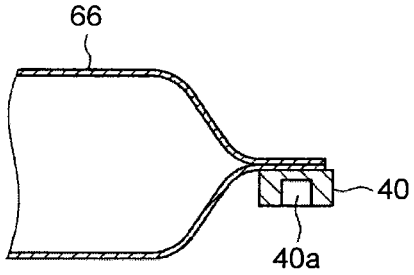

Further, the member to be locked 40 may adhere to the outer surface of the end portion of the toner containing unit 66 so as to be attached thereto as in the embodiment illustrated in FIG. 31. Furthermore, in FIG. 31, the hole portion 40*a* which is formed in the member to be locked 40 is formed as a bottomed hole or a concave portion, but may be formed as a through hole.

Figure 32:
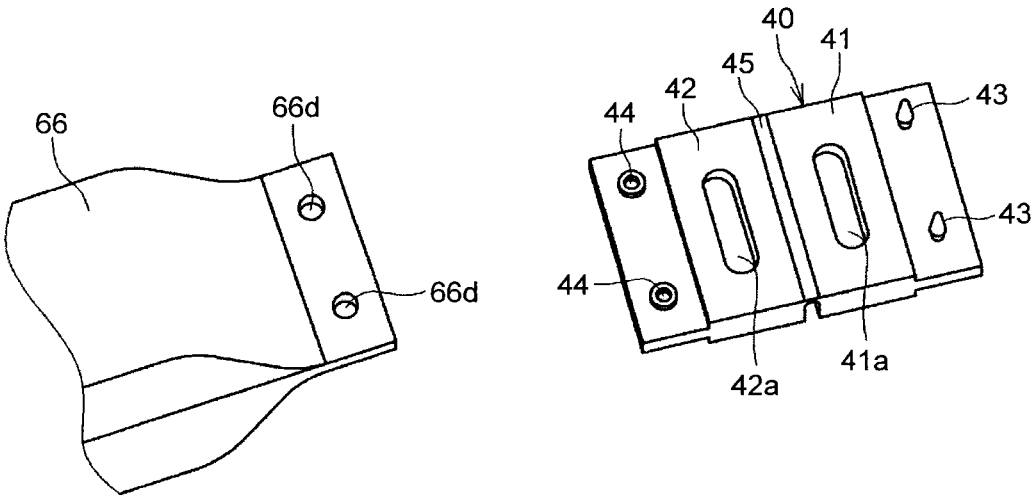
FIG. 32 is a diagram illustrating a configuration in which the member to be locked is attached with the end portion of the toner containing unit by being interposed therebetween, where FIG. 32(*a*) is an exploded diagram thereof and FIG. 32(*b*) is a cross-sectional view thereof.
Figure 32:
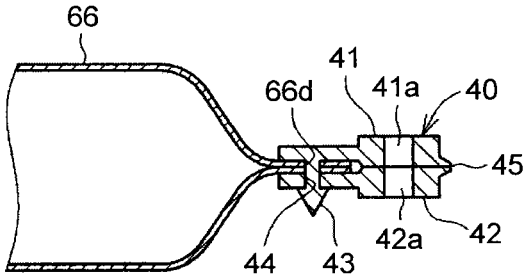

Further, the member to be locked 40 may be attached with the end portion of the toner containing unit 66 interposed therebetween as in the embodiment illustrated in FIG. 32.

As illustrated in FIG. 32(*a*), in the embodiment, the member to be locked 40 includes a pair of nipping portions 41 and 42 which is integrally connected through a flexible bent portion 45. The respective nipping portions 41 and 42 are provided with hole portions 41*a* and 42*a* (which is formed therethrough) as portions to be locked. Further, one nipping portion 41 is provided with two convex members 43, and the other nipping portion 42 is provided with two fitting holes 44 (which is formed therethrough) which may be fitted to the convex members 43. Further, the end portion of the toner containing unit 66 is provided with two attachment holes 66*d* (which is formed therethrough) to which the member to be locked 40 is attached.

When attaching the member to be locked 40 to the end portion of the toner containing unit 66, as illustrated in FIG. 32(*b*), the end portion of the toner containing unit 66 is nipped between the pair of nipping portions 41 and 42 by bending the bent portion 45. At this time, the convex member 43 penetrates the attachment hole 66*d*, and the convex member 43 is inserted and fitted to the fitting hole 44, so that the pair of nipping portions 41 and 42 is fixed so as not to be exploded. Accordingly, the member to be locked 40 is attached to the end portion of the toner containing unit 66.

Furthermore, in the configuration illustrated in FIG. 32, the pair of nipping portions 41 and 42 may be separately formed without connecting them each other. Further, any one of the pair of nipping portions 41 and 42 may be provided with a through hole, a bottomed hole, or a concave portion as a portion to be locked.

Figure 33:
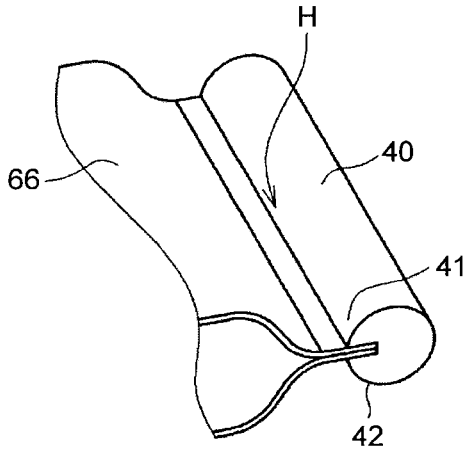
FIG. 33 is a diagram illustrating a configuration in which the member to be locked is attached by nipping the end portion of the toner containing unit, where FIG. 33(*a*) is a perspective view when the member to be locked is formed in a columnar shape and FIG. 33(*b*) is a perspective view when the member to be locked is formed in a quadrangular prism shape.
Figure 33:
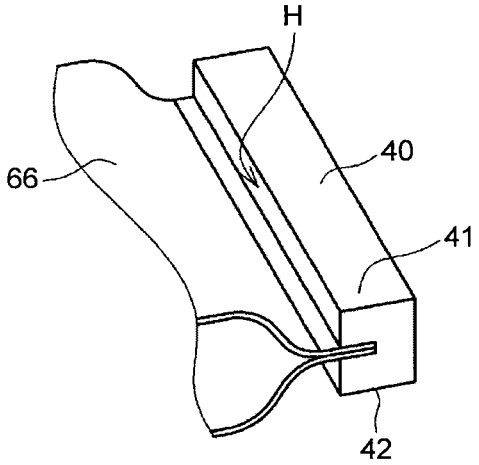

In addition, another embodiment is illustrated in FIG. 33. In the embodiment illustrated in FIG. 33, the toner containing unit 66 is attached by nipping the other end portion of the toner containing unit using the pair of nipping portions 41 and 42 included in the member to be locked 40. Further, in the embodiment, the hole portion or the concave portion is not formed as the portion to be locked. Here, a step portion H which is formed at the boundary between the end portions of the member to be locked 40 and the toner containing unit 66 is formed as a portion to be locked. That is, the locking portion of the counter member is hung by the step portion H so as to be locked thereto. Further, the shape of the member to be locked 40 may be formed in a cylindrical shape illustrated in FIG. 33(*a*) or a quadrangular prism shape illustrated in FIG. 33(*b*), and may be selectively formed in various shapes. Furthermore, in this configuration, a hole portion or a concave portion may be formed as a portion to be locked. Further, when the member to be locked 40 is nipped between the pair of locking portions upon locking the counter member to the step portion H, the member to be locked 40 hardly separates from the end portion of the toner containing unit 66.

As described above, when the portion to be locked is provided in the member to be locked 40 separated from the toner containing unit 66, the portion to be locked may be easily changed into various shapes such as a through hole, a bottomed hole, a concave portion, or a step portion just by changing the shape of the member to be locked 40. Further, since the member to be locked 40 having a different shape is attached to each toner containing unit 66, the toner containing unit 66 may be identified. In this case, since the respective toner containing units 66 may be formed in a common shape, the toner containing units 66 may be identified at low cost. Further, the shape of the member to be locked 40 may be different for each color of the toner contained inside the toner containing unit 66. In addition, when the shape of the counter member side locking portion becomes different for the member to be locked 40 having a different shape, it is possible to exhibit a function of preventing a non-compatible or erroneous attachment of the toner cartridge.

When the member to be locked 40 adhere (heat-bonded, or welded) to the toner containing unit 66, the heat-bonding may be highly efficiently performed by inserting a part of the member to be locked 40 into the toner containing unit 66 as in the embodiment illustrated in FIG. 30. Here, in this case, since the member to be locked 40 needs to be heat-bonded to the toner containing unit 66 before charging the toner into the toner containing unit 66, there is a problem in which the toner adheres to the member to be locked 40 or the member to be locked 40 is damaged during the toner charging process that is performed later. For this reason, in the configuration in which the member to be locked 40 is attached without being inserted into the toner containing unit 66 as illustrated in FIGS. 31, 32, and 33, the toner is charged into the toner containing unit 66, and the toner containing unit is sealed, and the member to be locked 40 may be attached thereto. For this reason, in such a configuration, it is possible to prevent the adhesion of the toner to the member to be locked 40 or prevent the damage of the member to be locked 40, and hence it is not necessary to perform an operation of cleaning the adhering toner or replacing the damaged member to be locked 40. Accordingly, there is an advantage that cost may be decreased. Further, in the configuration in which the end portion of the toner containing unit 66 is nipped in the member to be locked 40 as illustrated in FIG. 32 or 33, there is no need to perform an adhesive applying process or a heat-bonding process, and hence there is an advantage that the attachment operation may be easily performed.

As described above, according to the second embodiment, since the powder containing unit is folded so as to automatically decrease in volume with a decrease in the amount of the powder therein without using the pump, the remaining powder amount may be recognized from the appearance. Further, when the powder inside the powder containing unit substantially disappears, the powder containing unit is folded so as to be crushed, and hence there is no need to make an effort for crushing the powder containing unit when discarding the used powder containing unit, thereby improving the convenience.

Third Embodiment

Referring to FIGS. 34 to 38, a third embodiment will be described in detail. The configuration which is not particularly described in the third embodiment is the same as that of the first embodiment. Hereinafter, based on FIGS. 34 to 38, the specific configurations of a vibration applying unit and a fixing unit provided with the vibration applying unit will be described.

Figure 34:
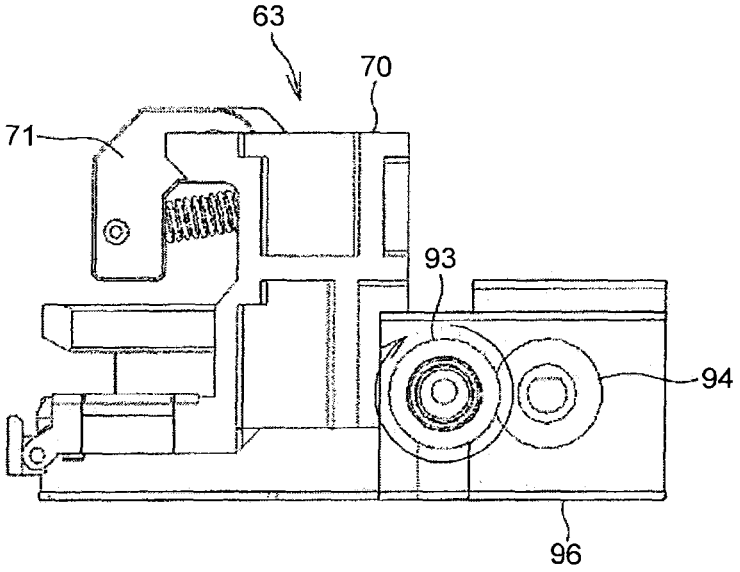
FIG. 34 is a cross-sectional view of a fixing unit.
Figure 35:
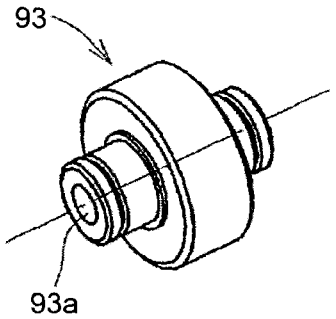
FIG. 35 is a perspective view of an eccentric weight.
Figure 36:
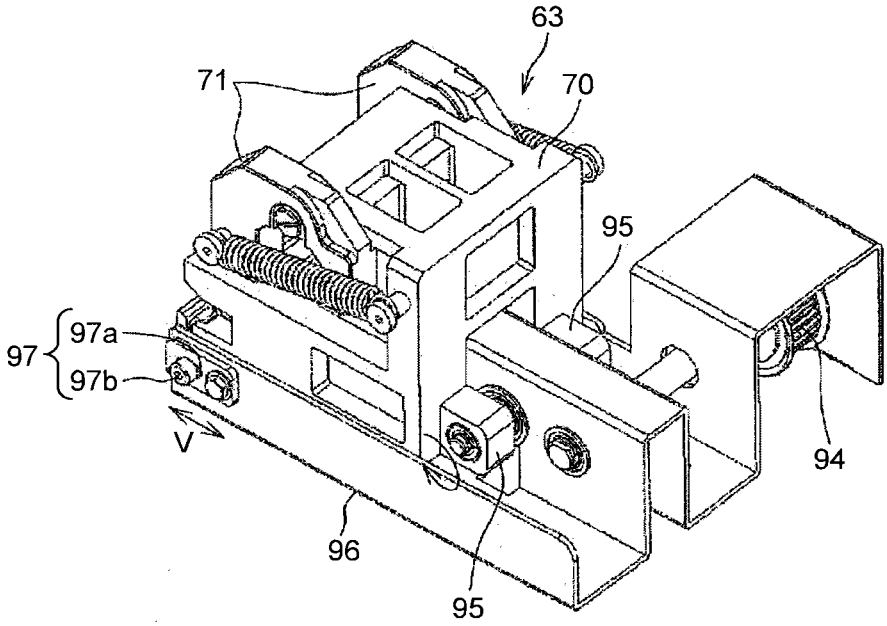
FIG. 36 is a perspective view of the fixing unit.
Figure 37:
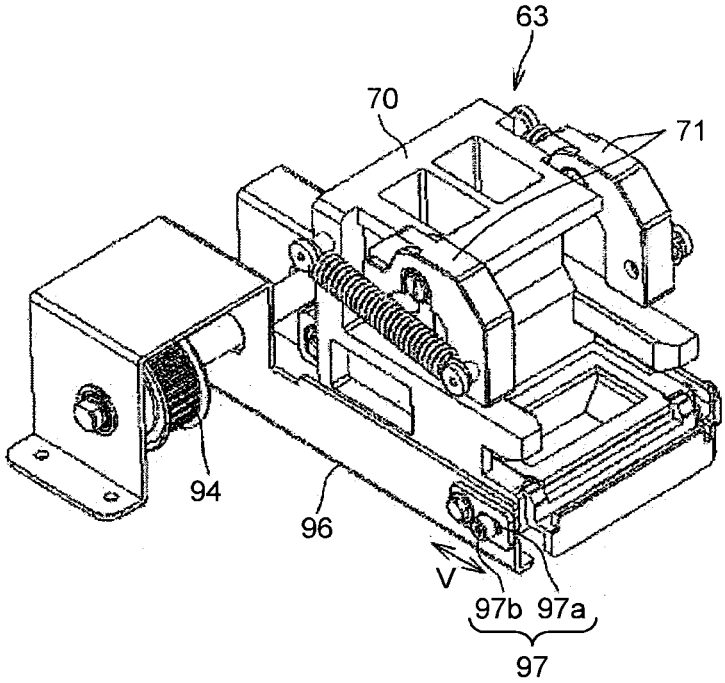
FIG. 37 is a perspective view of the fixing unit.

FIG. 34 is a cross-sectional view of the fixing unit 63, FIG. 35 is a perspective view of the vibration applying unit, and FIGS. 36 and 37 are perspective views of the fixing unit.

As illustrated in FIG. 34, the fixing unit 63 is provided with an eccentric weight 93 which is attached as a vibration applying unit to the rotary shaft. Further, as illustrated in FIG. 35, the eccentric weight 93 is a cylindrical member which protrudes toward both sides in the axial direction, and an insertion hole 93*a* is formed at a position shifted from the center so that the rotary shaft is inserted therethrough. Then, a structure is formed which generates vibration in a manner such that a driving force is applied from a driving unit 94 (see FIG. 34) provided in the fixing unit 63 to the rotary shaft and the eccentric weight 93 rotates along with the rotary shaft. Further, the eccentric amount (the amount shifted from the rotation center) of the eccentric weight 93 is set to be 1 mm or less, and the generated vibration is very small. Further, as illustrated in FIG. 36, both ends of the rotary shaft are supported by rectangular support members 95, and the respective support members 95 are adapted to rotate along with the rotary shaft.

Further, as illustrated in FIGS. 36 and 37, a main body 70 of the fixing unit 63 is attached to a base portion 96 which is fixed to the apparatus main body through an oscillation support portion 97 so as to be oscillated in the horizontal direction (the direction of the arrow V of the drawing). Specifically, the oscillation support portion 97 includes a hole 97*a* which is elongated in the horizontal direction and is formed in both side surfaces of the base portion 96 and a bolt 97*b* which is inserted through the elongated hole 97*a*, and one end portion of the main body 70 is attached to the base portion 96 by the bolt 97*b* which is inserted through the elongated hole 97*a*. When the main body 70 is adapted to oscillate in this way, the main body 70 is effectively vibrated. Further, in the third embodiment, since the main body 70 is further effectively vibrated, the eccentric weight 93 is provided in the end portion which is separated from the end portion provided with the oscillation support portion 97.

Figure 38:
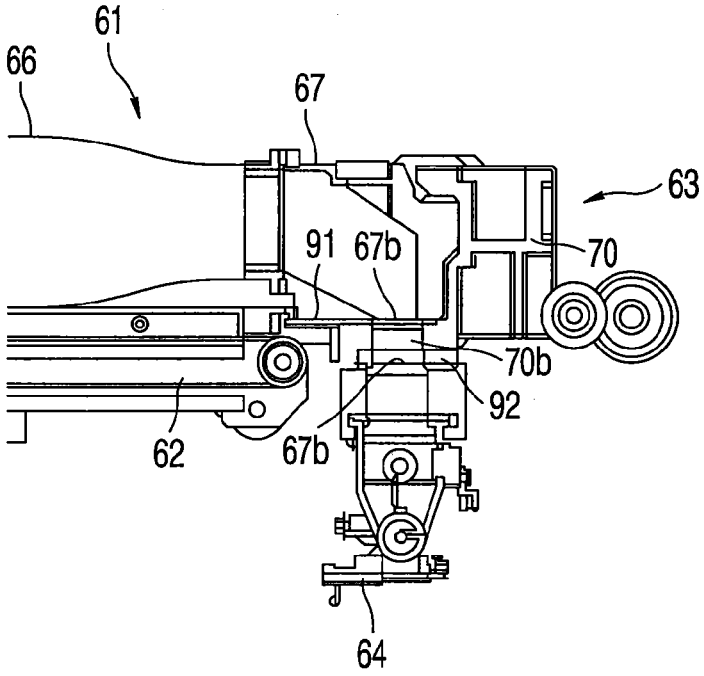
FIG. 38 is a cross-sectional view of a state where a toner cartridge is fixed to the fixing unit.

FIG. 38 is a cross-sectional view illustrating a state where the toner cartridge 61 is fixed to the fixing unit 63. As illustrated in FIG. 38, the main body 70 of the fixing unit 63 is provided with a communication path 70*b* which communicates the discharge port 67*b* of the discharging unit 67 with an inlet 64*a* of the toner conveying path (the powder conveying path) of the sub hopper 64. Further, a first seal member 91 which prevents the leakage of the toner is disposed in the connection portion between the communication path 70*b* and the discharge port 67*b*, and a second seal member 92 which prevents the leakage of the toner is disposed in the connection portion between the communication path 70*b* and the inlet 64*a* of the sub hopper 64. The second seal member 92 is formed as an elastic body which is thicker than the first seal member 91. As a material of the elastic body, for example, urethane foam having a low repelling property may be exemplified. Further, since the second seal member 92 is interposed between the fixing unit 63 and the sub hopper 64, the fixing unit 63 and the sub hopper 64 are connected while separating from each other (in a non-contact state). When the fixing unit 63 and the sub hopper 64 are connected while separating from each other (in a non-contact state) through the elastic body (the second seal member 92) in this way, the vibration which is generated by the fixing unit 63 is not transmitted to the sub hopper 64.

Further, in a state where the discharging unit 67 is fixed to the fixing unit 63 as illustrated in FIG. 38, the pullout tray 62 and the discharging unit 67 do not contact each other. Accordingly, the vibration which is applied from the fixing unit 63 to the discharging unit 67 is not transmitted from the discharging unit 67 to the pullout tray 62.

In the third embodiment, since the fixing unit 63 is provided with the eccentric weight 93 as the vibration generating unit (see FIG. 34), a vibration may be applied to the discharging unit 67 which is fixed to the fixing unit 63 by generating a vibration through the rotation of the eccentric weight 93. Accordingly, it is possible to promote the discharging of the toner from the discharging unit 67. Further, even when the toner may not move due to the cross-linking thereof in the discharging unit 67, the cross-linked toner may be broken by applying a vibration to the discharging unit 67, and hence the clogging of the toner may be prevented. In this way, according to the embodiment, since the toner may be reliably discharged from the discharging unit 67, the toner may be stably conveyed, and hence an apparatus having high reliability may be provided.

Furthermore, since the generated vibration is very small, the function of the image forming unit or the other device is not substantially influenced, and a problem such as an abnormal image does not occur. Further, since a configuration is adopted which generates a vibration by rotating the eccentric weight 93 in the embodiment, it is possible to suppress noise or an extra vibration to a minimum compared to the configuration that generates a vibration by the collision between the members.

Further, since the fixing unit 63 and the sub hopper 64 are spaced from each other (in a non-contact state) through the second seal member 92 which is formed as the elastic body while separating from each other (see FIG. 38), it is possible to prevent the vibration which is applied to the fixing unit 63 from being transmitted to the sub hopper 64. Further, since the pullout tray 62 does not contact the discharging unit 67 in a state where the discharging unit 67 is fixed to the fixing unit 63 (see the same drawing), it is possible to prevent the vibration from being transmitted from the discharging unit 67 to the pullout tray 62. Since the vibration is prevented from being transmitted to the other member other than the discharging unit 67 in this way, it is possible to highly prevent the occurrence of abnormal sound caused by the vibration.

Figure 39:
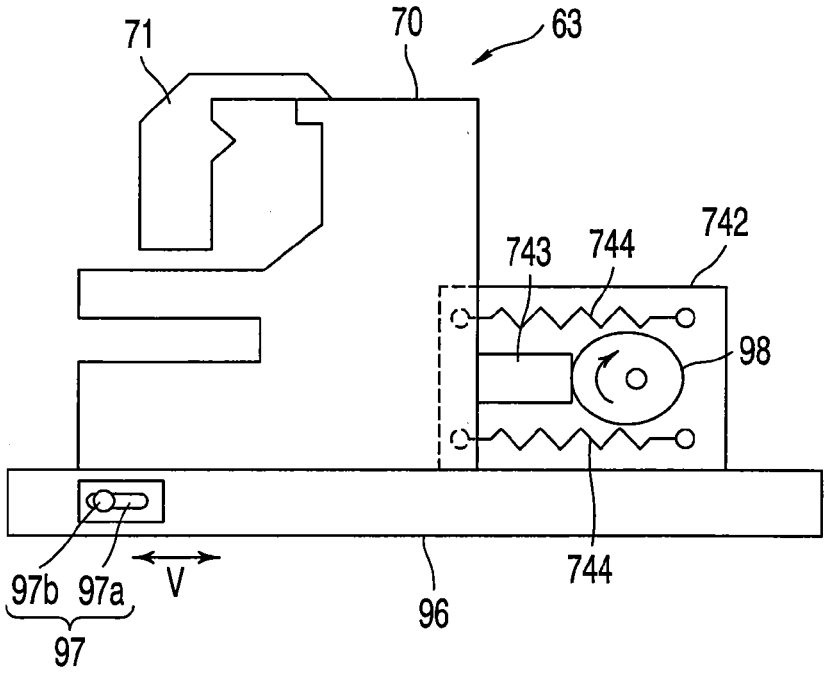
FIG. 39 is a schematic diagram illustrating a configuration of another embodiment of a vibration applying unit.

FIG. 39 is a schematic diagram illustrating a configuration of another embodiment of the vibration applying unit. The vibration applying unit illustrated in FIG. 39 includes an eccentric cam 98 which eccentrically rotates around the rotary shaft. The eccentric cam 98 is rotatably attached to the cam support member 742 which is fixed to the base portion 96 through a bearing (not illustrated). The main body 70 of the fixing unit 63 is provided with a cam contact portion 743 which contacts the peripheral surface of the eccentric cam 98. Further, the main body 70 and the cam support member 742 are connected to each other by a plurality of spring members 744, and the main body 70 is biased toward the eccentric cam 98 by the biasing forces of the spring members 744, so that the cam contact portion 743 contacts the eccentric cam 98. Then, when the eccentric cam 98 rotates by receiving a driving force from a driving unit (not illustrated), the main body 70 oscillates in the direction of the arrow V with respect to the base portion 96 with the rotation, and hence a vibration is generated.

Figure 40:
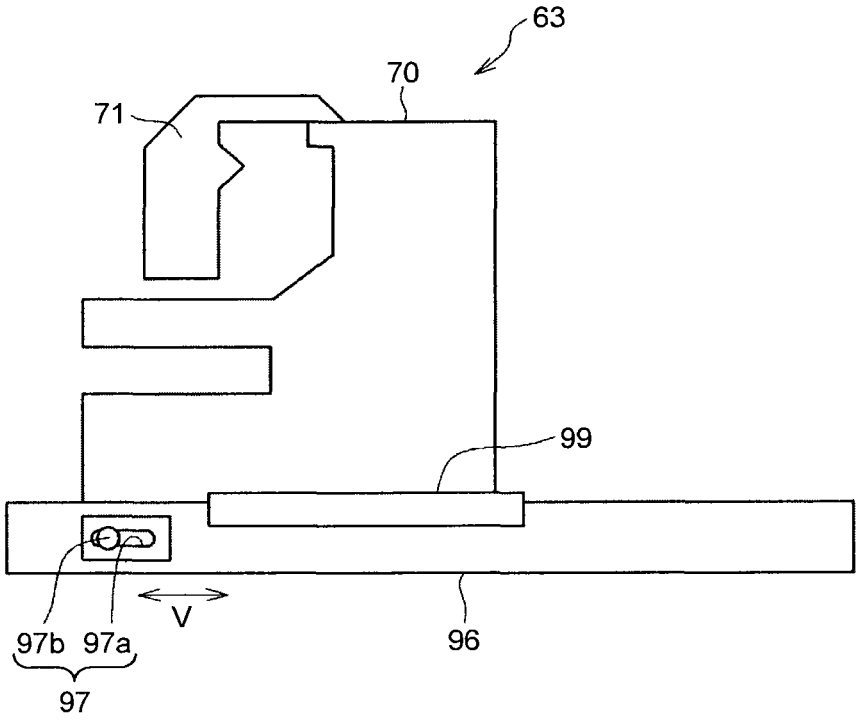
FIG. 40 is a schematic diagram illustrating a configuration of a still another embodiment of a vibration applying unit.

Further, FIG. 40 is a schematic diagram illustrating a configuration of still another embodiment of a vibration applying unit. Here, as illustrated in FIG. 40, a linear motor 99 is used as a vibration applying unit, and the main body 70 is attached to the base portion 96 through the linear motor 99. The fixing body of the linear motor 99 is fixed to the base portion 96 and a movable body which is movable in a reciprocating manner with respect to the fixing body is fixed to the main body 70. Accordingly, a vibration may be generated by oscillating the main body 70 with respect to the base portion 96 in the direction of the arrow V of the drawing.

As described above, according to the third embodiment, since the powder may be reliably discharged from the discharging unit, the powder may be stably conveyed, and hence an apparatus having high reliability may be provided.

Fourth Embodiment

Referring to FIGS. 41 to 47, a fourth embodiment will be described in detail. The configuration which is not particularly described in the fourth embodiment is the same as that of the first embodiment.

Hereinafter, based on FIG. 41, a toner delivery operation (conveying operation) of the toner conveying apparatus 8 according to the fourth embodiment will be described. In the state illustrated in FIG. 41, the toner cartridge 61 is attached to the pullout tray 62, and the pullout tray 62 is accommodated inside the apparatus's main body. Accordingly, a driving force may be transmitted from the apparatus's main body side driving device to the belt member 83 in this state, and hence the delivery member 81 may be moved in a reciprocating manner.

Figure 41:
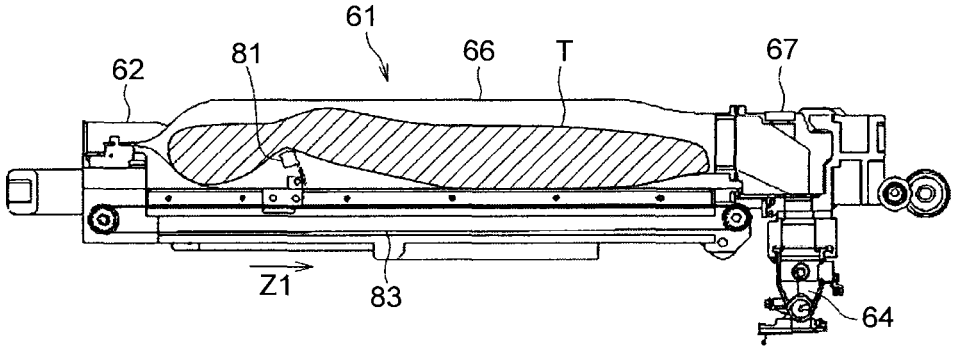
FIG. 41 is a diagram illustrating a state of a delivery operation when a remaining toner amount is large.
Figure 41:
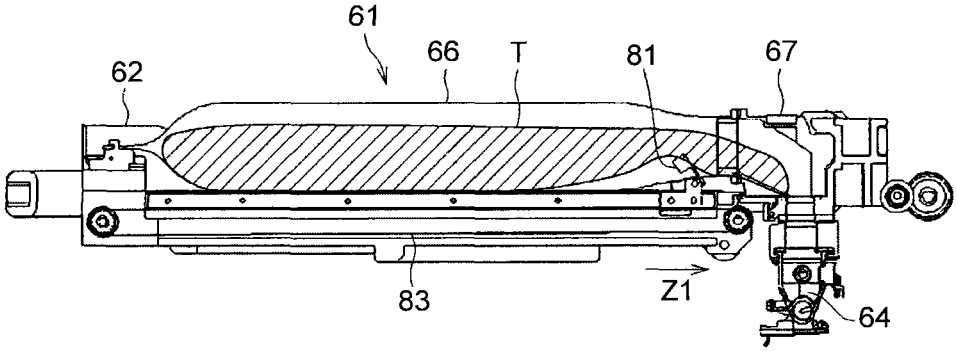

When the delivery member 81 moves to the delivery direction Z1 as illustrated in FIG. 41(*a*) by driving the belt member 83, the delivery member 81 moves while pressing the bottom surface of the toner containing unit 66 inward, and hence the toner T inside the toner containing unit 66 is moved to the discharging unit 67. Then, as illustrated in FIG. 41(*b*), the toner T which is moved to the discharging unit 67 is sent from the discharging unit 67 to the lower sub hopper 64 due to the inertia and the gravity.

Figure 42:
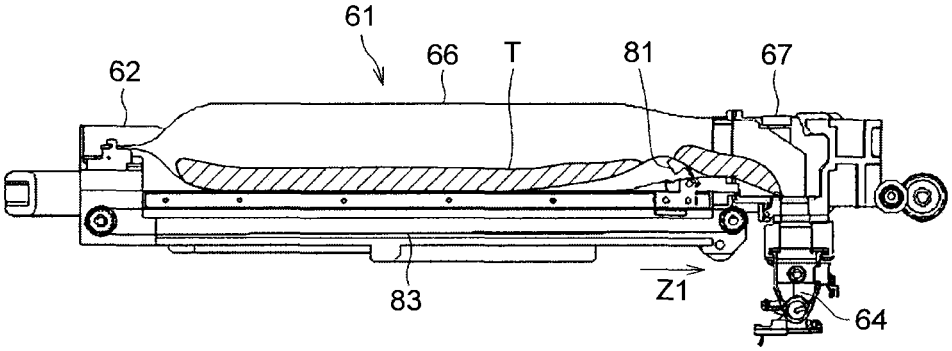
FIG. 42 is a diagram illustrating a state of the delivery operation when the remaining toner amount decreases.
Figure 42:
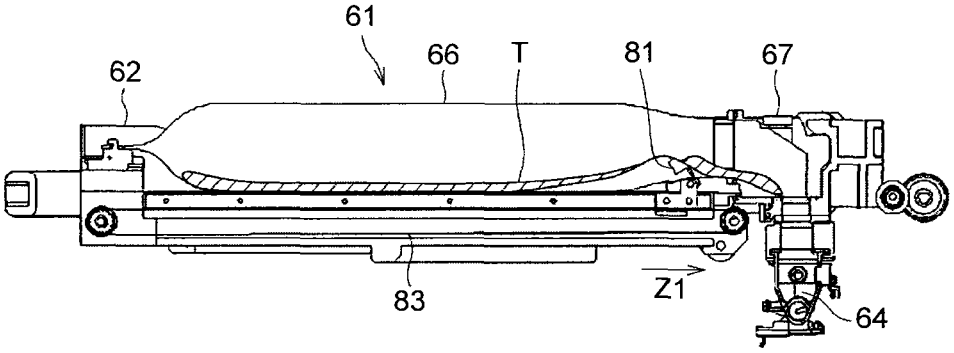

Further, FIG. 42 is a diagram illustrating a state where the toner T is delivered when the amount of the toner T remaining inside the toner containing unit 66 decreases. As illustrated in FIG. 42(*a*), when the remaining toner amount decrease to the medium degree, the toner delivery amount to the discharging unit 67 decreases compared to the case where the remaining toner amount is large as illustrated in FIG. 41, and the toner delivery amount further decreases when the remaining toner amount further decreases as illustrated in FIG. 42(*b*). In this way, the toner delivery amount to the discharging unit 67 also decreases as the remaining toner amount decreases.

For example, when the remaining toner amount inside the toner containing unit 66 is 200 g or more, the toner delivery amount becomes 10 g or more in each delivery operation. However, the toner delivery amount becomes about 5 g when the remaining toner amount is 100 to 200 g, and becomes about 3 g when the remaining toner amount is 100 g or less.

Therefore, in the fourth embodiment, the following configuration is adopted in order to stably convey the toner regardless of the remaining toner amount inside the toner containing unit 66.

Figure 43:
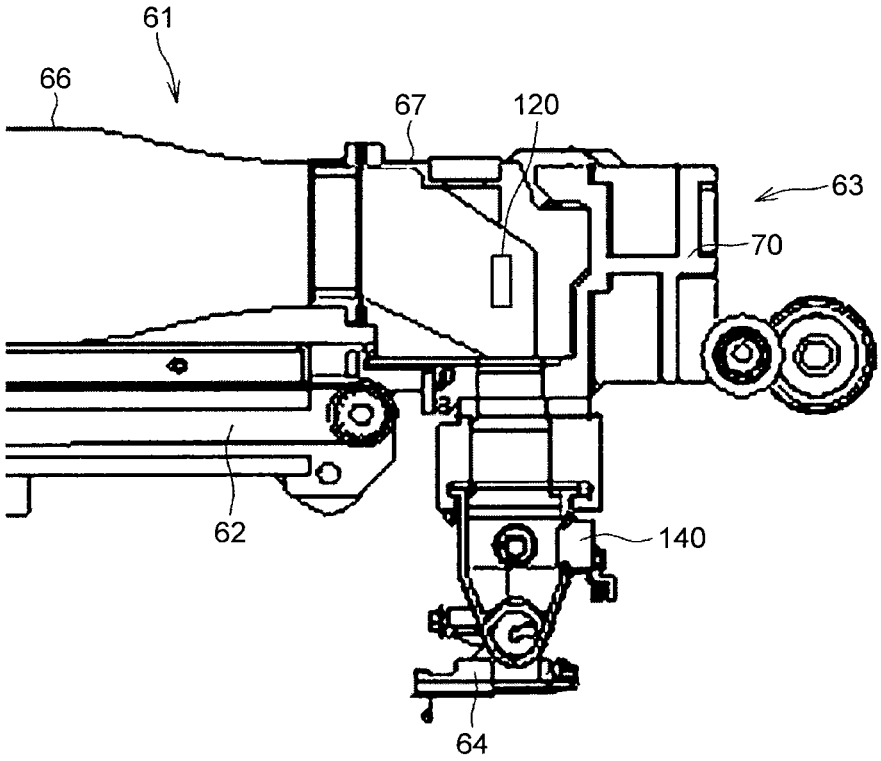
FIG. 43 is an enlarged cross-sectional view of a discharging unit and the peripheral portion thereof.

FIG. 43 is an enlarged cross-sectional view of the discharging unit 67 and the peripheral portion thereof. As illustrated in FIG. 43, the discharging unit 67 is provided with a toner sensor 120 which serves as a toner detecting unit (a powder detecting unit) that detects the toner therein. In the embodiment, the toner sensor 120 is configured as a piezoelectric sensor which has a piezoelectric element and detects the powder by measuring the contact pressure of the toner against the piezoelectric element.

Figure 44:
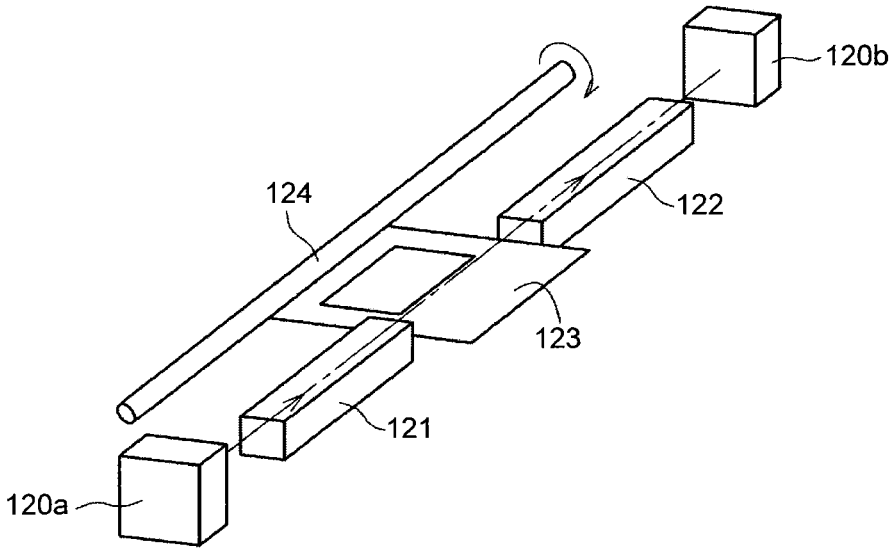
FIG. 44 is a schematic diagram illustrating a configuration of an optical toner sensor.

Further, the toner sensor 120 may be configured as an optical sensor. Specifically, as illustrated in FIG. 44, the optical sensor includes a light emitting portion 120*a* which emits light and a light receiving portion 120*b* which receives light, and the light emitting portion 120*a* and the light receiving portion 120*b* are disposed in the discharging unit 67 so as to face each other. In the embodiment illustrated in FIG. 44, light guiding paths 121 and 122 are formed between the light emitting portion 120*a* and the light receiving portion 120*b* so that light pass therethrough. A structure which detects the toner is formed in a manner such that a space is formed between the respective light guiding paths 121 and 122 so as to interpose the toner and the optical path from the light emitting portion 120*a* to the light receiving portion 120*b* is interrupted by the toner interposed in the space. Further, a scraping member 123 which scrapes the toner is formed so as to pass between the light guiding paths 121 and 122. In this case, the scraping member 123 is attached to a rotary shaft 124, and when the rotary shaft 124 rotates, the scraping member 123 passes between the light guiding paths 121 and 122. Accordingly, the toner is prevented from staying between the light guiding paths 121 and 122, and hence the toner detection precision is improved. Furthermore, although it is not illustrated in the drawings, even in the embodiment that uses a piezoelectric sensor, a scraping member that scrapes the toner is provided, and hence the toner is accurately detected.

Further, the sub hopper 64 is provided with a toner sensor 140 which serves as a toner detecting unit (a powder detecting unit) that detects the toner therein as illustrated in FIG. 43. Hereinafter, for convenience of description, the toner sensor 120 which is provided in the discharging unit 67 is referred to as a first toner sensor, and the toner sensor 140 which is provided in the sub hopper 64 is referred to as a second toner sensor. As the second toner sensor 140, a piezoelectric sensor or an optical sensor may be used as in the first toner sensor 120.

When the piezoelectric sensor is used as the first toner sensor 120 and the second toner sensor 140, the toner amount may be directly detected by measuring the contact pressure of the toner. Accordingly, the detection precision improves, and the appropriate toner amount may be delivered to the discharging unit 67. On the other hand, in a case where the optical sensor is used, when the light emitting portion 120*a* and the light receiving portion 120*b* illustrated in FIG. 44 are disposed at the outside of the discharging unit 67 and at the discharging unit 67 in a non-contact state, the light emitting portion 120*a* and the light receiving portion 120*b* are not influenced by the vibration even when a vibration occurs in the discharging unit 67. Further, in this case, since the discharging unit 67 may be provided with only the light guiding paths 121 and 122, an erroneous detection caused by a vibration may be prevented at low cost. Furthermore, as the first toner sensor 120 and the second toner sensor 140, a reflection type optical sensor which measures reflectivity of light or a magnetic sensor which measures permeability may be also used.

Figure 45:
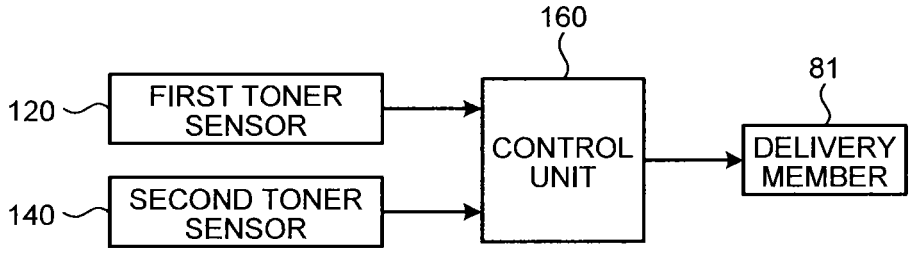
FIG. 45 is a block diagram illustrating a control system of the delivery member.

FIG. 45 is a block diagram illustrating a control system of the delivery member. As illustrated in FIG. 45, the operation of the delivery member 81 is controlled by a control unit 160 which receives the detection signal of the first toner sensor 120 or the second toner sensor 140. Specifically, when the driving device of the belt member 83 provided with the delivery member 81 is controlled by the control unit 160, it is possible to start and stop the movement of the delivery member 81 to the delivery direction and to control the frequency of the movement and the movement speed.

Figure 46:
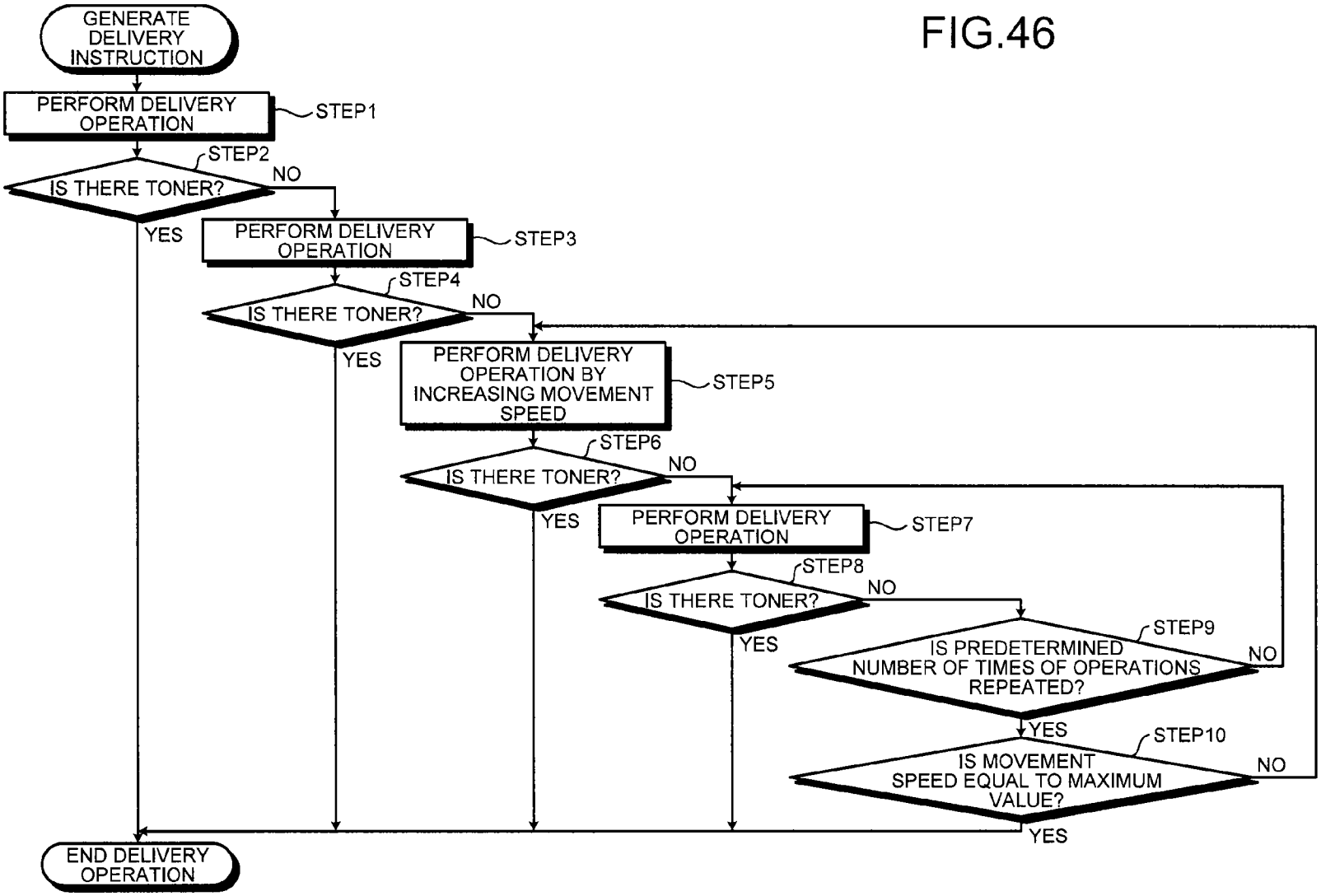
FIG. 46 is a flowchart for illustrating a method of controlling the delivery member.

Hereinafter, referring to the flowchart of FIG. 46, a method of controlling the delivery member will be described. When the toner is not detected by the first toner sensor 120 (when the toner inside the discharging unit 67 becomes less than a predetermined amount) as a result of a decrease in the toner amount inside the discharging unit 67 with the supply of the toner inside the sub hopper 64 to the developing device, the control unit 160 generates a delivery instruction that delivers the toner to the discharging unit 67. Then, the delivery member 81 is moved to the discharging unit 67 and the delivery operation is performed (STEP 1). When the toner is sent to the discharging unit 67 by the delivery member 81 by performing the delivery operation and the existence of the toner is detected by the first toner sensor 120 ("YES" in STEP 2), the delivery operation ends.

On the other hand, when the non-existence of the toner is still detected by the first toner sensor 120 ("NO" in STEP 2) even when the delivery operation is performed, the delivery member 81 is moved again so as to perform the delivery operation (STEP 3). Then, when the existence of the toner is detected by the first toner sensor 120 ("YES" in STEP 4) as a result of the delivery operation, the delivery operation ends. However, when the non-existence of the toner is detected by the first toner sensor 120 even after this ("NO" in STEP 4), the delivery operation is performed by increasing the movement speed of the delivery member 81 (STEP 5).

Then, when the existence of the toner is detected by the first toner sensor 120 ("YES" in STEP 6) by performing the delivery operation, the delivery operation ends. When the non-existence of the toner is detected ("NO" in STEP 6), the delivery operation is performed again in a state where the movement speed increases (STEP 7). Subsequently, the delivery operation is repeatedly performed several times which have been predetermined until the existence of the toner is detected by the first toner sensor 120 (STEPS 7 to 9).

As described above, in a case where the non-existence of the toner is detected by the first toner sensor 120 ("YES" in STEP 9) as a result of the delivery operation performed several times in a state where the speed increases, when the movement speed of the delivery member 81 does not become a maximum value ("NO" in STEP 10), the delivery operation is performed by further increasing the movement speed of the delivery member 81 (STEP 5). Then, the delivery operation is performed several times until the existence of the toner is detected by the first toner sensor 120 (STEPS 7 to 9). When the non-existence of the first toner sensor 120 is detected even after this, the delivery operation is performed by further increasing the speed (STEPS 9 and 10 and STEPS 5 to 8). Subsequently, when the existence of the toner is not finally detected ("YES" in STEP 10) as a result of the delivery operation performed several times in a state where the movement speed of the delivery member 81 becomes a maximum value, it is determined that the toner does not exist inside the toner containing unit 66, and the delivery operation ends. Further, even when the non-existence of the toner is detected by the second toner sensor 140 provided in the sub hopper 64, it is determined that the toner does not exist inside the toner containing unit 66, and the delivery operation ends. When it is determined that the toner does not exist inside the toner containing unit 66, a signal for promoting the replacement of the toner cartridge 61 is generated.

Further, in the fourth embodiment, in order to improve the detection precision of the first toner sensor 120, the fixing unit 63 is provided with a vibration applying unit which applies a vibration to the discharging unit 67. That is, when the toner adheres to the inner surface of the discharging unit 67 around the first toner sensor 120, the first toner sensor 120 performs an erroneous detection. For this reason, the erroneous detection of the first toner sensor 120 is prevented by preventing the adhesion of the toner to the inner surface of the discharging unit 67 through the vibration of the vibration applying unit.

As described above, in the fourth embodiment, the existence/non-existence of the toner is checked by the first toner sensor 120 after performing the delivery operation by moving the delivery member 81, and the delivery operation is repeated until the existence of the toner is detected (until it is detected that the toner inside the discharging unit 67 is a predetermined amount or more). Accordingly, it is possible to supply a predetermined amount or more of the toner into the discharging unit 67 regardless of whether the remaining toner amount inside the toner containing unit 66 is large or small. That is, since the remaining toner amount inside the toner containing unit 66 is small, it is possible to deliver a predetermined amount of the toner to the discharging unit 67 by repeatedly performing the delivery operation even when a predetermined amount of the toner may not be sent to the discharging unit 67 in each delivery operation. In this way, according to the embodiment, the toner may be stably and reliably conveyed regardless of the remaining toner amount inside the toner containing unit 66.

Further, in the fourth embodiment, the movement speed of the delivery member 81 is increased at a predetermined timing when repeatedly performing the delivery operation. When the frequency of the delivery operation increases, the operation time extends with an increase in the number of times. However, when the movement speed is increased, the time taken for each delivery operation may be shortened, and hence the extension of the operation time may be reduced. In other words, the movement speed is increased in order to increase the frequency of the movement (the frequency of the delivery) of the delivery member 81 within a predetermined time.

Further, in the fourth embodiment, since the vibration is applied to the discharging unit 67 by the vibration applying unit, it is possible to prevent the adhesion of the toner to the inner surface of the discharging unit 67 or to drop the adhered toner by the vibration. Accordingly, it is possible to prevent the erroneous detection of the first toner sensor 120 caused by the adhesion of the toner. Further, when the vibration applying unit is provided as in the embodiment, desirably, the first toner sensor 120 is configured as an optical sensor, and the light emitting portion 120*a* and the light receiving portion 120*b* are disposed at the outside of the discharging unit 67 and at the discharging unit 67 in a non-contact state. Accordingly, even when the discharging unit 67 is vibrated, it is possible to prevent the erroneous detection of the first toner sensor 120 caused by the vibration.

While the fourth embodiment has been described, the invention is not limited to the above-described embodiment, and various modifications may be, of course, made without departing from the spirit of the invention. In the above-described embodiment, the frequency of the delivery operation is controlled in response to the remaining toner amount inside the toner containing unit 66 as a result of the repeated delivery operation based on the detection result of the first toner sensor 120. However, the remaining toner amount inside the toner containing unit 66 is detected by a sensor or the like, and the frequency of the movement (the frequency of the delivery) or the movement speed of the delivery member 81 within a predetermined time may be changed in response to the remaining toner amount.

As a method of detecting the remaining toner amount inside the toner containing unit 66, there is known a method in which a sensor detecting the toner amount inside the toner containing unit 66 is provided or the remaining toner amount inside the toner containing unit 66 is calculated from the toner consumption amount of the output image. Alternatively, the remaining toner amount may be estimated by calculating the delivered toner amount from the frequency of the delivery operation. Then, the frequency of the movement and the movement speed of the delivery member 81 are set in advance in response to the remaining toner amount, and when there is a delivery instruction, the frequency of the movement and the movement speed of the delivery member 81 are defined in response to the detected remaining toner amount.

Figure 47:
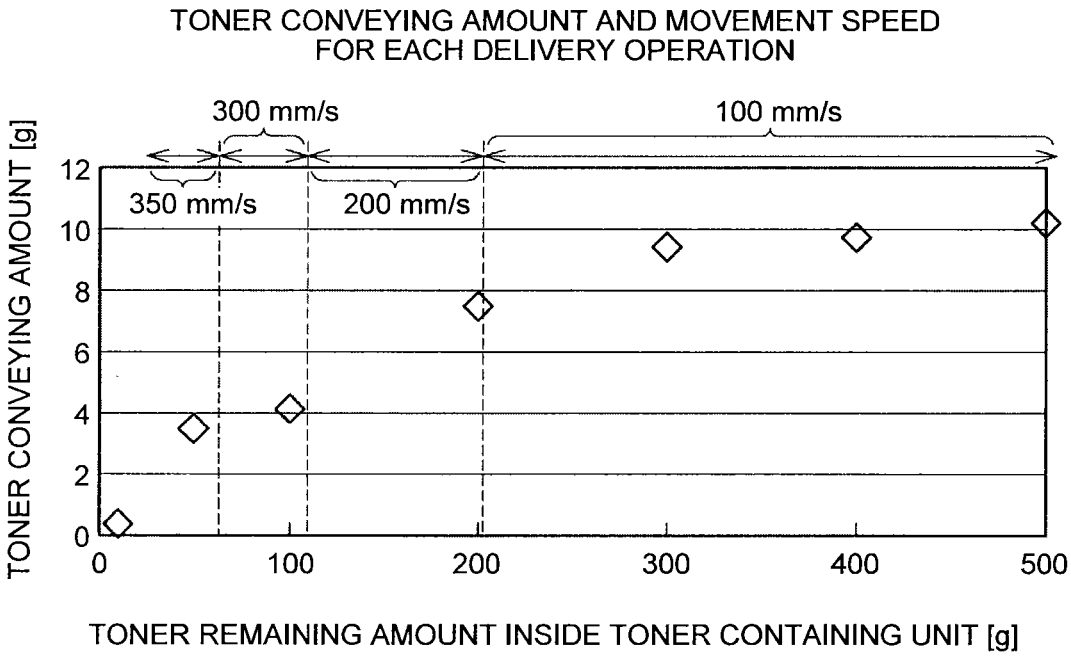
FIG. 47 is a diagram illustrating an example in which the movement speed of the delivery member is set based on the remaining toner amount.

For example, FIG. 47 illustrates an example in which the movement speed of the delivery member 81 is set based on the remaining toner amount. The horizontal axis of FIG. 47 indicates the remaining toner amount inside the toner containing unit 66, and the vertical axis indicates the toner conveying amount in each delivery operation in each case. In this example, the remaining toner amount is divided into four ranges, and the movement speed of the delivery member 81 is set for each range of the remaining toner amount. Specifically, the movement speed is set to 100 mm/s when the remaining toner amount is equal to or larger than 200 g, the movement speed is set to 200 mm/s when the remaining toner amount is equal to or larger than 110 g and smaller than 200 g, the movement speed is set to 300 mm/s when the remaining toner amount is equal to or larger than 70 g and smaller than 110 g, and the movement speed is set to 350 mm/s when the remaining toner amount is less than 70 g. In this way, when the movement speed becomes faster as the remaining toner amount becomes smaller, it is possible to ensure the frequency of the delivery operation within a predetermined time and to reduce the extension of the time necessary for the delivery operation.

Furthermore, the toner is easily aggregated when the delivery operation is performed by increasing the movement speed of the delivery member 81, but the movement speed is increased when the remaining toner amount is small, and hence there is no need to worry about the aggregation of the toner. For this reason, a toner conveying failure caused by the aggregation of the toner or a problem in which the toner cannot be conveyed to the discharging unit 67 or the sub hopper 64 does not occur due to an increase in movement speed.

The invention is not limited to the respective embodiments, but it is apparent that the respective embodiments may be appropriately modified in addition to suggestions of the respective embodiments without departing from the technical spirit of the invention. Further, the number, the positions, the shapes, and the like of the constituents are not limited to those of the respective embodiments, but may be set as the numbers, the positions, the shapes, and the like which are very appropriate for carrying out the invention.

Further, the configuration of the invention may be applied to convey a powder container that contains a powder other than the toner or may be applied to a powder conveying apparatus including the same. Further, the powder conveying apparatus according to the invention is not limited to the printer illustrated in FIG. 1, but may be mounted on the other printers, copy machines, facsimiles, or multi-functional peripherals thereof.

The toner used in the invention will be described in detail below.

Toner is mainly formed of a resin component, a pigment component, a wax component, and an external additive.

Examples of the resin include polystyrene resin, epoxy resin, polyester resin, polyamide resin, styrene acrylic resin, styrene-methacrylate resin, polyurethane resin, vinyl resin, polyolefin resin, styrene butadiene resin, phenolic resin, polyethylene resin, silicon resin, butyral resin, terpene resin, and polyol resin. Examples of the vinyl resin include homopolymer of styrene, such as polystyrene, poly-p-chlorostyrene, or polyvinyl toluene, or substitute of styrene; styrene copolymer, such as styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-chloromethyl methacrylate copolymer, styrene-acrylonitrile copolymer, styrene-vinyl methyl ether copolymer, styrene-vinyl ethyl ether copolymer, styrene-methyl vinyl ketone copolymer, styrene-butadiene copolymer, styrene-isoprene copolymer, styrene-acrylonitrile-indene copolymer, styrene-maleic acid copolymer, or styrene-maleic acid ether copolymer; polymethylmethacrylate; polybutylmethacrylate; polyvinyl chloride; and polyvinyl acetate.

The polyester resin is formed of dihydric alcohol as listed below in the group A and dibasic acid salts as listed below in the group B. It is possible to add trihydric alcohol or carboxylic acid as listed below in the group C, as a third component.

Group A: ethylene glycol; triethylene glycol; 1,2-propylene glycol; 1,3-propylene glycol; 1,4-butanediol; neopentyl glycol; 1,4-butenediol; 1,4-bis(hydroxymethyl)cyclohexane; bisphenol A; hydrogenated bisphenol A; polyoxyethylene bisphenol A; polyoxypropylene(2,2)-2,2'-bis (4-hydroxyphenyl)propane; polyoxypropylene (3,3)-2,2'-bis (4-hydroxyphenyl)propane; polyoxyethylene (2,0)-2,2-bis (4-hydroxyphenyl)propane; and polyoxypropylene (2,0)-2,2'-bis(4-hydroxyphenyl)propane.

Group B: maleic acid; fumaric acid; mesaconic acid; citraconic acid; itaconic acid; glutaconic acid; phthalic acid; isophthalic acid; terephthalic acid; cyclohexanedicarboxylic acid; succinic acid; adipic acid; sebacic acid; malonic acid; linolenic acid; and ester of acid anhydride of the above or ester of lower alcohol.

Group C: polyhydric alcohol containing at least three hydroxyl groups, such as glycerin, trimethylolpropane, or pentaerythritol; and polyvalent carboxylic acid containing at least three valences, such as trimellitic acid or pyromellitic acid. Examples of polyol resin include alkylene oxide adduct of epoxy resin and dihydric phenol; and a reactant of glycidyl ether, a compound that contains one active hydrogen that reacts with epoxy group in a molecule, and a compound that contains two or more active hydrogen that reacts with epoxy resin in a molecule.

The pigments used in the invention are listed below.

Examples of a black pigment include azine dyes, such as carbon black, oil furnace black, channel black, lamp black, acetylene black, or aniline black; metal salt azo dyes, metallic oxide, and combined metal oxide.

Examples of a yellow pigment include cadmium yellow, mineral fast yellow, nickel yellow, naples yellow, naphthol yellow S, hansa yellow G, hansa yellow 10G, benzidine yellow GR, quinoline yellow lake, permanent yellow NCG, and tartrazine lake.

Examples of an orange pigment include molybdenum orange, permanent orange GTR, pyrazolone orange, vulcan orange, indanthrene brilliant orange RK, benzidine orange G, and indanthrene brilliant orange GK.

Examples of a red pigment include colcothar, cadmium red, permanent red 4R, lithol red, pyrazolone red, watching red calcium salt, lake red D, brilliant carmine 6B, eosin lake, rhodamine lake B, alizarin lake, and brilliant carmine 3B.

Examples of a purple pigment include fast violet B and methyl violet lake.

Examples of a blue pigment include cobalt blue, alkaline blue, victoria blue lake, phthalocyanine blue, metal-free phthalocyanine blue, phthalocyanine blue partial chlorination product, fast sky blue, and indanthrene blue BC.

Examples of a green pigment include chrome green, chromium oxide, pigment green B, and malachite green lake.

It is possible to use one pigment or two or more pigments from among the above pigments. Particularly for color toner, it is necessary to uniformly disperse preferable pigments. Therefore, a system is employed in which a master batch with pigments dispersed at high concentrations is produced instead of directly introducing a large amount of pigments into resin, and the master batch is diluted and then introduced. In this case, solvent is generally used to accelerate the dispersion; however, in the embodiment, water is used for the dispersion in order to cope with the environmental problem or the like. When water is used, it is important to control a temperature in order to prevent the problem with remaining moisture in the master batch.

The toner of the invention contains a charge-controlling agent inside the toner particle (internal addition). The charge-controlling agent enables control of the optimal charge amount depending on a developing system. In particular, in the developing device to which the present invention is applied, it becomes possible to further stabilize a balance between the particle size distribution and the charge amount. As a substance that allows toner to have positive charge property, it is possible to use one of or a combination of two or more of the followings: nigrosine; quaternary ammonium salt; triphenylmethane dye; imidazole metal complex; or salts. As a substance that allows the toner to have negative charge property, salicylic acid metal complex, salts, organoboron salts, or calixarene compound is used.

It is possible to internally add a release agent to the toner of the invention in order to prevent offset at the time of photographic fixing. Examples of the release agent include natural waxes, such as candellia wax, carnauba wax, or rice wax; montan wax and derivative of montan wax; paraffin wax and derivatives of paraffin wax; polyolefin wax and derivatives of polyolefin wax; sasol wax; low-molecular-weight polyethylene; low-molecular-weight polypropylene; and alkylphosphorylated ester. The melting point of the release agent is preferably in a range from 65 to 90[° C.]. When the melting point is lower than this range, the toner blocking easily occurs when the toner is stored. When the melting point is higher than this range, offset easily occurs in an area where a fixing temperature is low.

It is possible to add an additive agent in order to increase the dispersibility of the release agent. Examples of the additive agent include styrene acrylic resin, polyethylene resin, polystyrene resin, epoxy resin, polyester resin, polyamide resin, styrene methacrylate resin, polyurethane resin, vinyl resin, polyolefin resin, styrene butadiene resin, phenolic resin, butyral resin, terpene resin, and polyol resin. A combination of two or more substances from among the above may be used as the additive agent.

The resin may be crystalline polyester. Crystalline polyester is aliphatic polyester which has a crystal property and a sharp molecular weight distribution in which the absolute amount of lower molecular weight is maximized to the extent possible. This resin causes crystalline transformation at a glass transformation temperature (Tg), and at the same time, the melting viscosity is sharply reduced from the solid state, so that the fixation property to papers is expressed. With use of the crystalline polyester resin, it is possible to realize fixation at a low temperature without extremely reducing Tg of the resin or the molecular weight. Therefore, the preserving property is not reduced by the reduction in Tg. Furthermore, it is possible to prevent extreme glossiness due to the reduction in the molecular weight or prevent reduction in the offset resistance. Therefore, introducing the crystalline polyester resin is extremely advantageous to improve the toner fixability at a low temperature.

Regarding the toner, an inorganic fine powder as a flowability increasing agent may be added or fixed to the surface of the toner. The average diameter of the inorganic fine powder is preferably in a range form 10 to 200 [nm]. If the diameter is smaller than 10 [nm], it becomes difficult to generate surface irregularity that is advantageous in terms of the flowability. If the diameter is greater than 200 [nm], the shape of the powder becomes rough, which causes a problem with the shape of the toner.

Examples of the inorganic fine powder of the invention include oxide, hydroxide, carbonate, sulfate, and compound oxide of Si, Ti, Al, Mg, Ca, Sr, Ba, In, Ga, Ni. Mn, W, Fe, Co, Zn, Cr, Mo, Cu, Ag, V, or Zr. Among them, the following oxide is usually employed to ensure the safety and stability. That is, particles of silicon oxide (silica), titanium oxide, or aluminum oxide (alumina or corundum) are preferably used. It is also effective to perform surface modification treatment on the additive agent by using a hydrophobizing agent. A representative example of the hydrophobizing agent is a silane coupling agent as listed below.

Dimethyldichlorosilane, trimethylchlorosilane, methyltrichlorosilane, allyldimethyldichlorosilane, allylphenyldichlorosilane, benzyldimethylchlorosilane, bromomethyldimethylchlorosilane, α-chloroethyltrichlorosilane, p-chloroethyltrichlorosilane, chloromethyldimethylchlorosilane, chloromethyltrichlorosilane, hexaphenyldisilazane, and hexatolyldisilazane.

By performing the hydrophobizing treatment on the additive agent, moisture is not likely to be adsorbed to the surface of the additive agent that is a nano particle. Therefore, the stability of the toner is increased.

It is preferable that the 0.1 to 2 [weight %] of inorganic fine powder is used with respect to the toner. If the amount is smaller than 0.1 [weight %], the effect to ameliorate the toner aggregation is reduced. If the amount is greater than 2 [weight %], problems, such as toner dispersion between fine lines, contamination inside the apparatus, or damage or abrasion of the photosensitive element, easily occur.

It may be possible to add or fix a charge-controlling agent to the surface of a powder formed of at least resin and pigment so that the shape of the surface of the powder has a small pitch and a large pitch. A small particle with an average diameter of 5 to 200 [nm] is optimal.

It is possible to further add a small amount of other additive agents to the extent that does not practically cause adverse effect. Examples of the other additive agents include lubricant powder, such as Teflon (registered trademark) powder as organic powder, metal soap powder including stearic acid zinc powder, or polyvinylidene fluoride powder; abrasive agent, such as cerium oxide powder, silicon carbide powder, or strontium titanate powder; or a conductivity applying agent as a developing property improver, such as a conductive particle including carbon black powder, zinc oxide powder, tin oxide powder, or indium oxide powder, or an insulating powder coated with the conductive particle. The other additive agents may be used in a small amount as a developing property improver.

By adding the fine powder to the toner, the toner can be easily loosened when the delivery member 81 operates, so that even when the flowability of the toner is lowered because a toner supply operation is not performed for a while, it is possible to discharge the toner from a container.

Furthermore, the first, second, third, and fourth embodiments include the aspects of the powder container, the powder conveying apparatus, and the image forming apparatus (First to Eighth Aspects) below.

According to First Aspect, there is provided a powder container including: a powder containing unit which has an opening portion formed at one end portion thereof so as to contain a powder therein and is formed of a flexible material so as to be deformable, wherein when a delivery member is pressed inward from the outside of the powder containing unit so as to move toward the opening portion, the powder is delivered from the opening portion, wherein the other end portion opposite to the one end portion provided with the opening portion is provided with a portion to be locked which locks a locking portion of a counter member, and wherein the portion to be locked is disposed at a position equal to or higher than the lower end of the opening portion in an installation posture of the powder containing unit in use.

Since the portion to be locked is disposed at a position equal to or higher than the lower end of the opening portion, when the powder inside the powder containing unit decreases in amount, the lower surface (or the bottom surface) of the powder containing unit is disposed in a horizontal shape or is inclined downward from the portion to be locked toward the opening portion. That is, even when the powder inside the powder containing unit decreases in amount, the position of the fixed portion to be locked does not change. For this reason, the lower surface of the powder containing unit is disposed in a horizontal shape or is inclined downward towards the lower end of the opening position disposed at a position equal to or lower than the position of the portion to be locked. In this way, according to First Aspect, since the lower surface of the powder containing unit is not inclined downward toward the opposite side to the opening portion even when the powder inside the powder containing unit decreases in amount, it is possible to suppress the powder moved to the opening portion from being returned by the influence of the gravity. Accordingly, it is possible to suppress a decrease in the powder conveying amount caused by the returning of the powder from the opening portion, and hence to stabilize the powder conveying amount. Further, it is possible to decrease the remaining powder amount inside the powder containing unit lastly.

According to Second Aspect, in the powder container according to First Aspect, the opening portion is disposed at the center portion of one end portion of the powder containing unit in the vertical direction.

When the opening portion is disposed at the lower portion of the powder containing unit, the amount of the powder which adheres to the inner surface above the opening portion increases due to the powder delivery operation by the delivery member, and hence the remaining powder amount increases. In contrast, when the opening portion is disposed at the upper portion of the powder containing unit, the position of the opening portion becomes higher than the height of the delivery member, and hence the amount of the delivered powder decreases. For this reason, when the opening portion is disposed at the center portion of the end portion of the powder containing unit in the vertical direction as in Second Aspect, it is possible to further stabilize the powder conveying amount and to decrease the remaining powder amount.

According to Third Aspect, the powder container according to First or Second Aspect includes a discharging unit which is provided in the opening portion of the powder containing unit and has a discharge port for discharging the powder delivered from the opening portion to a supply destination, wherein the discharging unit is provided with a slope surface which is inclined downward from the opening portion toward the discharge port.

In this case, since the powder slides on the slope surface, the powder may be smoothly discharged from the discharge port. Accordingly, it is possible to stably discharge the powder inside the powder containing unit to the last, and hence to decrease the powder amount remaining inside the powder containing unit.

According to Fourth Aspect, there is provided a powder conveying apparatus including: a powder container which includes a powder container having an opening portion formed at one end portion thereof so as to contain a powder therein and formed of a flexible material so as to be deformable; a delivery member which presses the powder containing unit from the outside to move to the opening portion so that the powder is delivered from the opening portion; and a locking portion which locks the other end portion opposite to the one end portion provided with the opening portion of the powder containing unit, wherein the powder container according to any one of First to Third Aspects is used as the powder container.

When the powder container according to any one of First to Third Aspects is used as the powder container, it is possible to stabilize the powder conveying amount and to decrease the remaining powder amount.

According to Fifth Aspect, in the powder conveying apparatus according to Fourth Aspect, the locking portion is disposed at a position equal to or higher than the lower end of the opening portion.

Since the locking portion is disposed at a position equal to or higher than the lower end of the opening portion, it is possible to maintain the position of the portion to be locked so as to be equal to or higher than the lower end of the opening portion when the portion to be locked of the powder containing unit is locked to the locking portion. Accordingly, when the powder inside the powder containing unit decreases, the lower surface of the powder containing unit is disposed so as to become a horizontal shape or to be inclined downward toward the opening portion. That is, since the lower surface of the powder containing unit is not inclined downward toward the opposite side to the opening portion even when the powder inside the powder containing unit decreases, it is possible to suppress the powder moved to the opening portion from being returned due to the influence of the gravity. Accordingly, it is possible to stabilize the powder conveying amount and to decrease the remaining powder amount.

According to Sixth Aspect, in the powder conveying apparatus according to Fourth or Fifth Aspect, when the delivery member presses the powder containing unit inward so as to move toward the opening portion, the top portion of the inner surface of the portion inward pressed by the delivery member becomes equal to or higher than the lower end of the opening portion and equal to or lower than the upper end thereof around at least the opening portion.

When the top portion of the inner surface of the inward pressed portion is lower than the lower end of the opening portion, the powder conveying amount decreases. In contrast, when the top portion of the inner surface of the inward pressed portion becomes higher than the upper end of the opening portion, the powder adheres to the inner surface above the opening portion by the powder delivery operation, and hence the remaining powder amount increases. For this reason, since the top portion of the inner surface of the inward pressed portion becomes equal to or higher than the lower end of the opening portion and equal to or lower than the upper end thereof as in Sixth Aspect, it is possible to further stabilize the powder conveying amount and to decrease the remaining powder amount.

According to Seventh Aspect, in the powder conveying apparatus according to any one of Fourth to Sixth Aspects, the locking portion is adapted to be movable toward the opening portion and movable toward the opposite side thereto, and the locking portion is biased toward the opposite side to the opening portion by the elastic member.

In this case, the end portion of the powder containing unit which is locked to the locking portion is pulled toward the opposite side to the opening portion. At this time, since the volume of the powder containing unit decreases and the shape of the powder containing unit is stabilized by the tensile force generated in the powder containing unit, it is possible to further effectively suppress the returning of the powder due to the gravity.

According to Eighth Aspect, there is provided an image forming apparatus including the powder conveying apparatus according to any one of Fourth to Seventh Aspects.

Since the image forming apparatus includes the powder conveying apparatus according to any one of Fourth to Seventh Aspects, it is possible to stabilize the powder conveying amount and to decrease the remaining powder amount.

In addition, the first, second, third, and fourth embodiments include the aspects of the powder container, the powder conveying apparatus, and the image forming apparatus (Ninth to Twenty-third Aspects) below.

According to Ninth Aspect, there is provided a powder container including: a powder containing unit which has an opening portion formed at one end portion thereof so as to contain a powder therein and of which at least a part is deformable, wherein the other end portion opposite to one end portion provided with the opening portion is provided with a portion to be locked to lock a locking portion of a counter member which locks pulls the other end portion in a direction in which the other end portion separates from the one end portion, and wherein a folding line which extends from the one end portion to the other end portion is formed in the powder containing unit.

In a state where the locking portion of the counter member is locked to the portion to be locked of the powder containing unit, the other end portion of the powder containing unit is pulled in a direction in which the other end portion separates from the one end portion. That is, a pulling force acts on the powder containing unit in a direction in which the folding line extends. A folding force is generated along the folding line in the powder containing unit by the pulling force. Accordingly, when the powder inside the powder containing unit decreases, the powder containing unit is folded along the folding line so as to automatically decrease in volume.

According to Tenth Aspect, in the powder container according to Ninth Aspect, a folding line is formed in each of the facing surfaces of the powder containing unit.

When the amount of the powder inside the powder containing unit decreases by forming a folding line in each of the facing surfaces of the powder containing unit, the powder containing unit is folded in a flat shape along the folding line, and hence the powder containing unit may further effectively decrease in volume.

According to Eleventh Aspect, in the powder container according to Ninth or Tenth Aspect, the folding line is formed so that the powder containing unit is folded inward.

Since the folding line is formed so that the powder containing unit is folded inward, the folded powder containing unit does not contact the peripherally arranged members. Accordingly, it is possible to prevent the damage or the abnormal sound which is generated when the powder containing unit contacts the members arranged around the powder containing unit. Further, it is possible to prevent the suppression of a decrease in volume due to the interruption of folding deformation generated by the contact between the powder containing unit and the members arranged around the powder containing unit and hence to prevent degradation in the powder discharging performance.

According to Twelfth Aspect, in the powder container according to any one of Ninth to Eleventh Aspects, the folding line is formed throughout the entire area from the one end portion of the powder containing unit to the other end portion thereof.

Since the folding line is formed throughout the entire area from the one end portion of the powder containing unit to the other end portion thereof, the folding posture of the powder containing unit may be easily controlled. For this reason, it is possible to stabilize the powder discharging performance with the deformation of the powder containing unit.

According to Thirteenth Aspect, in the powder container according to any one of Ninth to Twelfth Aspects, the folding line and the portion to be locked are disposed on the same line.

Since the folding line and the portion to be locked are disposed on the same line, the powder containing unit may be easily folded along the folding line, and when the powder inside the powder containing unit substantially disappears, the powder containing unit is folded to be thinner.

According to Fourteenth Aspect, in the powder container according to any one of Ninth to Thirteenth Aspects, the other end portion of the powder containing unit is provided with a hole portion, and the hole portion is formed as the portion to be locked which inserts and locks the locking portion of the counter member.

In this way, the portion to be locked may be formed by forming the hole portion in the other end portion of the powder containing unit.

According to Fifteenth Aspect, in the powder container according to any one of Ninth to Fourteenth Aspects, the member to be locked provided with the hole portion is attached to the other end portion of the powder containing unit, and the hole portion is formed as the portion to be locked which inserts and locks the locking portion of the counter member.

In this way, the member to be locked provided with the hole portion as the portion to be locked may be attached to the other end portion of the powder containing unit. In this case, since the portion to be locked is formed in the member to be locked separated from the powder containing unit, the portion to be locked may be easily changed into various shapes just by changing the shape of the member to be locked. Further, it is possible to identify the powder containing unit or to prevent the non-compatible or erroneous attachment thereof by attaching the member to be locked having a different shape to each powder containing unit. In addition, since the respective powder containing units may have a common shape, it is possible to identify the powder containing unit or to prevent the non-compatible or erroneous attachment thereof at low cost.

According to Sixteenth Aspect, in the powder container according to any one of Ninth to Fourteenth Aspects, the member to be locked is attached to the other end portion of the powder containing unit, and a step portion which is formed in a boundary between the member to be locked and the other end portion is formed as the portion to be locked which hangs and locks the locking portion of the counter member.

In this way, the member to be locked is attached to the other end portion of the powder containing unit, and the step portion which is formed in the boundary between the member to be locked and the other end portion may be formed as the portion to be locked. Further, even in this case, the portion to be locked may be easily changed into various shapes just by changing the shape of the member to be locked as in Fifteenth Aspect. Further, it is possible to identify the powder containing unit or prevent the non-compatible or erroneous attachment thereof by attaching the member to be locked having a different shape to each powder containing unit.

According to Seventeenth Aspect, in the powder container according to Fifteenth or Sixteenth Aspect, a part of the member to be locked is inserted from the other end portion of the powder containing unit, and a part of the inserted member to be locked adhere to the inner surface of the powder containing unit.

In this way, the member to be locked may be highly efficiently adhered to the powder containing unit by inserting a part of the member to be locked into the powder containing unit.

According to Eighteenth Aspect, in the powder container according to Fifteenth or Sixteenth Aspect, the member to be locked adheres to the outer surface of the other end portion of the powder containing unit.

In this way, when the member to be locked adheres to the outer surface of the other end portion of the powder containing unit, the member to be locked may be attached to the powder containing unit having the powder charged therein in a sealed state. Accordingly, it is possible to prevent the adhesion of the powder to the member to be locked or to prevent the damage of the member to be locked. Thus, since it is not necessary to perform an operation of cleaning the adhering powder or replacing the damaged member to be locked, it is possible to decrease the cost.

According to Nineteenth Aspect, in the powder container according to Fifteenth or Sixteenth Aspect, the member to be locked includes a pair of nipping portions which nips the other end portion of the powder containing unit. One nipping portion is provided with a convex member and the other nipping portion is provided with a fitting hole. The other end portion of the powder containing unit is provided with an attachment hole. The other end portion of the powder containing unit is nipped between the pair of nipping portions. The convex member of the one nipping portion penetrates the attachment hole, and the convex member is fitted to the fitting hole of the other nipping portion, so that the member to be locked is attached to the other end portion of the powder containing unit.

In this case, since the member to be locked may be attached to the powder containing unit having the powder charged therein in a sealed state as in Eighteenth Aspect, it is possible to prevent the adhesion of the powder to the member to be locked or the damage of the member to be locked. Accordingly, since there is no need to perform an operation of cleaning the adhering powder or an operation of replacing the damaged member to be locked, it is possible to decrease the cost. In addition, in this case, since there is no need to perform an adhesive applying process or a heat-bonding process so as to attach the member to be locked, the attachment operation may be easily performed.

According to Twentieth Aspect, in the powder container according to Fifteenth or Sixteenth Aspect, the member to be locked includes a pair of nipping portions which nips the other end portion of the powder containing unit, and when the pair of nipping portions nips the other end portion of the powder containing unit, the member to be locked is attached to the other end portion of the powder containing unit.

In this case, since the member to be locked may be attached to the powder containing unit having the powder charged therein in a sealed state as in Eighteenth and Nineteenth Aspects, it is possible to prevent the adhesion of the powder to the member to be locked or the damage of the member to be locked. Accordingly, since there is no need to perform an operation of cleaning the adhering powder or an operation of replacing the damaged member to be locked, it is possible to decrease the cost. Further, in this case, since there is no need to perform an adhesive applying process or a heat-bonding process so as to attach the member to be locked as in Nineteenth Aspect, the attachment operation is easily performed.

According to Twenty-first Aspect, there is provided a toner cartridge that contains toner inside the powder container according to any one of Nine to Twentieth Aspects.

The powder container according to any one of Nine to Twentieth Aspects may be used as a toner cartridge.

According to Twenty-second Aspect, there is provided a powder conveying apparatus including: the powder container according to any one of Nine to Twentieth Aspects; and a delivery member which moves to the opening portion in a state where the deformable portion of the powder containing unit is pressed inward so as to deliver the powder from the opening portion.

Since the powder conveying apparatus includes the powder container according to any one of Nine to Twentieth Aspects, the above-described effect by the powder container may be obtained.

According to Twenty-third Aspect, there is provided an image forming apparatus including the powder container according to any one of Ninth to Twentieth Aspects.

Since the image forming apparatus includes the powder container according to any one of Ninth to Twentieth Aspects, the above-described effect by the powder container may be obtained.

In addition, the first, second, third, and fourth embodiments include the aspects of the powder container, the powder conveying apparatus, and the image forming apparatus (Twenty-fourth to Thirty-first Aspects) below.

According to Twenty-fourth Aspect, there is provided a powder conveying apparatus including: a powder containing unit which contains a powder therein and of which at least a portion is deformable; a discharging unit which discharges the powder inside the powder containing unit to the outside; and a delivery member which moves to the discharging unit in a state where the deformable portion of the powder containing unit is pressed inward so as to deliver the powder to the discharging unit, wherein a fixing unit is provided so as to fix the discharging unit thereto and a vibration applying unit is provided so as to apply a vibration to the fixing unit.

Since the vibration applied to the fixing unit by the vibration applying unit is transmitted to the discharging unit, it is possible to promote the discharging of the powder from the discharging unit. Further, even when the powder may not move in a cross-linked state in the discharging unit, the cross-linked powder may be broken by applying a vibration to the discharging unit, and hence the staying of the powder may be prevented. In this way, it is possible to reliably discharge the powder from the discharging unit by applying a vibration to the discharging unit.

According to Twenty-fifth Aspect, in the powder conveying apparatus according to Twenty-fourth Aspect, the vibration applying unit is formed by providing an eccentric weight in a rotary shaft rotated by a driving unit.

Since the vibration applying unit is formed as described above, it is possible to suppress the noise or the extra vibration as minimal as possible compared to the configuration in which the vibration is generated by the collision between the members.

According to Twenty-sixth Aspect, in the powder conveying apparatus according to Twenty-fourth or Twenty-fifth Aspect, an oscillation support portion is provided so as to support the fixing unit in an oscillating manner.

It is possible to effectively vibrate the fixing unit by supporting the fixing unit in an oscillating manner.

According to Twenty-seventh Aspect, in the powder conveying apparatus according to Twenty-sixth Aspect, the vibration applying unit is provided in the end portion separated from the end portion provided with the oscillation support portion.

Since the vibration applying unit is provided in the end portion separated from the end portion provided with the oscillation support portion, it is possible to further effectively vibrate the fixing unit.

According to Twenty-eighth Aspect, in the powder conveying apparatus according to any one of Twenty-fourth to Twenty-seventh Aspects, the discharge port which is formed in the discharging unit is disposed so as to face the lower side, and a slope surface is provided inside the discharging unit so as to be inclined downward toward the discharge port.

Since the slope surface is provided so as to be inclined downward toward the discharge port, the powder may be smoothly conveyed to the discharge port along the slope surface. Further, since the discharge port is disposed so as to face the lower side, it is possible to discharge the powder by dropping the powder from the discharge port by the gravity. Accordingly, a mechanism for discharging the powder may be simplified.

According to Twenty-ninth Aspect, in the powder conveying apparatus according to any one of Twenty-fourth to Twenty—eighth Aspects, the other member other than the discharging unit is connected to the fixing unit through an elastic body in a separated state.

Since the other member is connected to the fixing unit through the elastic body in a separated state, it is possible to prevent the vibration applied to the fixing unit from being transmitted to the other member. Accordingly, it is possible to highly prevent an abnormal sound which is generated by the transmission of the vibration to the other member.

According to Thirtieth Aspect, in the powder conveying apparatus according to any one of Twenty-fourth to Twenty-ninth Aspects, a holding member is provided so as to hold the powder containing unit in a non-contact state with respect to the discharging unit.

Since the holding member does not contact the discharging unit, it is possible to prevent the vibration from being transmitted from the discharging unit to the holding member. Accordingly, it is possible to highly prevent an abnormal sound caused which is generated by the transmission of the vibration to the holding member.

According to Thirty-first Aspect, there is provided an image forming apparatus including the powder conveying apparatus according to any one of Twenty-fourth to Thirtieth Aspects.

Since the image forming apparatus includes the powder conveying apparatus according to any one of Twenty-fourth to Thirtieth Aspects, the above-described effect by the powder conveying apparatus may be obtained.

In addition, the first, second, third, and fourth embodiments include the aspects of the powder conveying apparatus and the image forming apparatus (Thirty-second to Forty-second Aspects) below.

According to Thirty-second Aspect, there is provided a powder conveying apparatus including: a powder containing unit which contains a powder therein and of which at least a portion is deformable; a discharging unit which discharges the powder inside the powder containing unit to the outside; and a delivery member which moves to the discharging unit in a state where the deformable portion of the powder containing unit is pressed inward so as to deliver the powder to the discharging unit, wherein the inward pressing amount of the delivery member changes in response to the amount of the powder inside the powder containing unit.

Since the inward pressing amount of the delivery member changes in response to the amount of the powder inside the powder containing unit, it is possible to stably and reliably deliver the powder to the discharging unit regardless of the powder remaining inside the powder containing unit.

According to Thirty-third Aspect, in the powder conveying apparatus according to Thirty-second Aspect, the delivery member is biased toward the powder containing unit by a predetermined biasing force.

Since the delivery member is biased by a predetermined biasing force, it is possible to change the inward pressing amount of the delivery member in response to the amount of the powder inside the powder containing unit, and to stably and reliably deliver the powder to the discharging unit regardless of the powder remaining inside the powder containing unit.

According to Thirty-fourth Aspect, in the powder conveying apparatus according to Thirty-second or Thirty-third Aspect, the delivery member is rotatably attached to a leg member which is movable along with the delivery member, is switched to a standing state toward the powder containing unit and a laid state, and is biased in the standing direction by the biasing member.

Since the delivery member is switched between the standing state and the laid state, it is possible to change the inward pressing amount with respect to the powder containing unit.

According to Thirty-fifth Aspect, in the powder conveying apparatus according to Thirty-fourth Aspect, the delivery member is held in the standing state by a guide surface which guides the leg member when moving the leg member and a regulating portion which regulates the delivery member against the biasing force of the biasing member.

Regardless of the biasing force of the biasing member, the delivery member may be held in the standing state by the guide surface and the regulating portion. For this reason, the biasing force of the biasing member may be appropriately changed in response to the material of the powder containing unit or the maximum powder containing amount, and hence the inward pressing force of the delivery member may be adjusted to an appropriate value.

According to Thirty-sixth Aspect, in the powder conveying apparatus according to Thirty-fourth or Thirty-fifth Aspect, the delivery member is adapted to be movable in a reciprocating manner in the delivery direction in which the delivery member moves to the discharging unit and the returning direction in which the delivery member moves in the opposite direction. At each movement direction switching position of the delivery member, a concave portion or a hole portion is provided so that the leg member intrudes thereinto by receiving the biasing force of the biasing member. The delivery member moves in the delivery direction so that the leg member intrudes into the concave portion or the hole portion, and the delivery member moves in the returning direction so that the leg member rotates while abutting the edge of the concave portion or the hole portion, thereby switching the state of the delivery member from the standing state to the laid state. The delivery member moves in the returning direction so that the leg member intrudes into the concave portion or the hole portion, and the delivery member moves in the delivery direction so that the leg member rotates while abutting the edge of the concave portion or the hole portion, thereby switching the state of the delivery member from the laid state to the standing state.

Since the operation of switching the delivery member between the standing state and the laid state may be realized by a simple mechanism for allowing the leg member to intrude into the concave portion or the hole portion, the configuration may be simplified. Further, since the delivery member is switched to the laid state when moving the delivery member in the returning direction, it is possible to prevent the powder from being returned by the delivery member.

According to Thirty-seventh Aspect, in the powder conveying apparatus according to Thirty-sixth Aspect, a movement direction switching unit is provided so as to switch the movement direction of the delivery member, and an input unit is provided in the delivery member so as to turn on the movement direction switching unit by contacting or approaching the movement direction switching unit when the delivery member reaches the movement direction switching position.

Since the movement direction of the delivery member is switched in a manner such that the input unit contacts or approaches the movement direction switching unit when the delivery member reaches the movement direction switching position, the powder delivery operation may be continuously performed.

According to Thirty-eighth Aspect, in the powder conveying apparatus according to any one of Thirty-second to Thirty-seventh Aspects, the discharge port which is provided in the discharging unit is disposed so as to face the lower side, and a slope surface is provided inside the discharging unit so as to be inclined downward toward the discharge port.

Since the slope surface is provided so as to be inclined downward toward the discharge port, the powder may be smoothly conveyed to the discharge port along the slope surface. Further, since the discharge port is disposed so as to face the lower side, it is possible to discharge the powder by dropping the powder from the discharge port by the gravity. Accordingly, a mechanism for discharging the powder may be simplified.

According to Thirty-ninth Aspect, in the powder conveying apparatus according to any one of Thirty-second to Thirty-eighth Aspects, an opening holder member is provided so as to maintain the powder input port provided in the powder containing unit in an opened state.

Since the powder input port is maintained in an opened state by the opening holder member, the powder may be easily charged from the powder input port.

According to Fortieth Aspect, in the powder conveying apparatus according to any one of Thirty-second to Thirty-ninth Aspects, a fixing unit capable of integrally attaching or detaching the powder containing unit and the discharging unit is provided, and the fixing unit includes a fixing arm which is switched between a fixation position where a subject fixing unit provided in the powder containing unit or the discharging unit is fixed and a fixation releasing position where the fixation is released and a spring member of which one end portion is attached to the fixing arm and which biases the fixing arm in the direction to be rotated when the attached end portion passes by the rotation support point of the fixing arm with the rotation of the fixing arm.

Since the spring member biases the fixing arm in the direction to be rotated as a result in which the spring member passes by the rotation support point of the fixing arm with the rotation of the fixing arm, the fixing arm may be held at the switched position by the biasing force so as to be reliably fixed thereto.

According to Forty-first Aspect, in the powder conveying apparatus according to Fortieth Aspect, the fixing arm is adapted to be rotatable in a manner such that the subject fixing unit abuts the fixing arm with the attachment and detachment operation of the powder containing unit and the discharging unit to and from the fixing unit.

Since the fixing arm may be rotated with the attachment and detachment operation to and from the fixing unit, the powder containing unit and the discharging unit may be easily fixed and the fixing thereof may be easily released, thereby obtaining the excellent operability.

According to Forty-second Aspect, there is provided an image forming apparatus including the powder conveying apparatus according to any one of Thirty-second to Forty-first Aspects.

Since the image forming apparatus includes the powder conveying apparatus according to any one of Thirty-second to Forty-first Aspects, the above-described effect by the powder conveying apparatus may be obtained.

In addition, the first, second, third, and fourth embodiments include the aspects of powder conveying apparatuses and image forming apparatuses (Forty-third to Fifty-first Aspects) below.

According to Forty-third Aspect, there is provided a powder conveying apparatus including: a powder containing unit which contains a powder therein and of which at least a portion is deformable; a discharging unit which discharges the powder inside the powder containing unit to the outside; and a delivery member which moves to the discharging unit in a state where the deformable portion of the powder containing unit is pressed inward so as to deliver the powder to the discharging unit, wherein a control unit is provided so as to control the movement of the delivery member to the discharging unit in response to the remaining powder amount inside the powder containing unit.

Since the movement of the delivery member to the discharging unit is controlled in response to the remaining powder amount, the powder may be stably conveyed regardless of the amount of the powder contained inside the powder containing unit.

According to Forty-fourth Aspect, in the powder conveying apparatus according to Forty-third Aspect, the number of times of the movement of the delivery member toward the discharging unit within a predetermined time increases as the remaining powder amount inside the powder containing unit decreases.

The amount of the powder which is delivered to the discharging unit for each movement of the delivery member decreases as the remaining powder amount inside the powder containing unit decreases. Therefore, when the number of times of the movement of the delivery member increases as the remaining powder amount decreases, the same amount of powder as the remaining powder amount is large may be delivered to the discharging unit. Accordingly, it is possible to stably convey the powder regardless of the amount of the powder contained inside the powder containing unit.

According to Forty-fifth Aspect, in the powder conveying apparatus according to Forty-fourth Aspect, the movement speed of the delivery member increases as the number of times of the movement of the delivery member increases.

Since the movement speed of the delivery member increases as the number of times of the movement of the delivery member increases, the time taken for each movement may be shortened, and hence the extension of the operation time may be decreased even when the number of times of the movement increases.

According to Forty-sixth Aspect, in the powder conveying apparatus according to any one of Forty-third to Forty-fifth Aspects, a powder detecting unit is provided so as to detect the powder inside the discharging unit. When the powder detecting unit detects that the powder inside the discharging unit becomes less than a predetermined amount, the delivery member is moved to the discharging unit by the delivery instruction of delivering the powder to the discharging unit, and the movement of the delivery member toward the discharging unit is repeated a predetermined number of times until the powder detecting unit detects that the powder inside the discharging unit becomes a predetermined amount or more.

Since the movement of the delivery member toward the discharging unit is repeated a predetermined number of times until the powder detecting unit detects the powder inside the discharging unit becomes a predetermined amount or more, it is possible to supply a predetermined amount or more of the powder into the discharging unit regardless of whether the remaining powder amount inside the powder containing unit is large and small. That is, since the remaining powder amount inside the powder containing unit is small, even when a predetermined amount of the powder may not be delivered to the discharging unit for each movement of the delivery member, it is possible to deliver a predetermined amount of the powder to the discharging unit by repeatedly performing the movement of the delivery member. Accordingly, it is possible to stably and reliably convey the powder regardless of the remaining powder amount inside the powder containing unit.

According to Forty-seventh Aspect, in the powder conveying apparatus according to Forty-sixth Aspect, the powder detecting unit is configured as a piezoelectric sensor which includes a piezoelectric element and detects the powder by measuring the contact pressure of the powder against the piezoelectric element.

Since the powder detecting unit is configured as the piezoelectric sensor, the powder amount may be directly detected. Accordingly, the detection precision improves, and the appropriate powder amount may be delivered to the discharging unit.

According to Forty-eighth Aspect, in the powder conveying apparatus according to Forty-seventh Aspect, the powder detecting unit is configured as an optical sensor which includes a light emitting portion emitting light and a light receiving portion receiving light and detects the powder when the powder interrupts the optical path from the light emitting portion to the light receiving portion.

The powder detecting unit may be configured as an optical sensor.

According to Forty-ninth Aspect, in the powder conveying apparatus according to Forty-eighth Aspect, the light emitting portion and the light receiving portion are disposed at the outside of the discharging unit so as not to be in contact with the discharging unit, and the discharging unit is provided with a light guiding path from the light emitting portion to the light receiving portion.

Since the light emitting portion and the light receiving portion are disposed at the outside of the discharging unit so as not to be in contact with the discharging unit, the light emitting portion and the light receiving portion are not influenced by the vibration even when the discharging unit is vibrated. Further, in this case, since the discharging unit may be provided with only the light guiding path, it is possible to prevent the erroneous detection caused by the vibration at low cost.

According to Fiftieth Aspect, in the powder conveying apparatus according to any one of Forty-sixth to Forty-ninth Aspects, the discharging unit is provided with a vibration applying unit which applies a vibration.

In this case, since the vibration is applied to the discharging unit by the vibration applying unit, it is possible to prevent the powder from adhering to the inner surface of the discharging unit or to drop the adhering powder by the vibration. Accordingly, it is possible to prevent the erroneous detection of the powder detecting unit caused by the adhesion of the powder.

According to Fifty-first Aspect, there is provided an image forming apparatus including at least a developing device and a developer supply device supplying a developer to the developing device, wherein the powder conveying apparatus according to any one of Forty-third to Fiftieth Aspects is used as the developer supply device.

Since the image forming apparatus uses the powder conveying apparatus according to any one of Forty-third to Fiftieth Aspects as the developer supply device, the above-described effect by the powder conveying apparatus may be obtained.

INDUSTRIAL APPLICABILITY

As described above, a powder container, a powder conveying apparatus, and an image forming apparatus according to the invention are useful in an image forming apparatus such as a copy machine or a printer, and is particularly suitable for a copy machine, a printer, and the like including a powder container that contains a powder such as a toner and a developer therein.

REFERENCE SIGNS LIST

8 toner conveying apparatus (powder conveying apparatus)
60 toner supply device
61 toner cartridge (powder container)
62*b* hanging portion (locking portion)
62*k* torsional coil spring (elastic member)
66 toner containing unit (powder containing unit)
66*a* toner input port (opening portion)
66*b* hole portion (portion to be locked)
66*c* air passage portion
67 discharging unit
67*i* air passage portion
T toner (powder)

The invention claimed is:

1. A powder container, comprising:
a powder containing unit which
includes an opening portion at one end portion thereof,
includes a securing section to secure the powder containing unit, the securing section being at an opposite end of the powder containing unit as the opening portion,
includes powder therein,
is formed of a flexible material so as to be deformable,
has a longitudinal direction which is oriented horizontally when the powder container is installed in a powder conveying apparatus; and
a discharging unit which
is disposed at the end portion at which the opening portion is included,
is to be fixed to the powder conveying apparatus when the powder container is installed in the powder conveying apparatus, and
discharges the powder delivered from the opening portion out to the powder conveying apparatus,
wherein the securing section of the powder containing unit is to be fixed to a fixing portion of the powder conveying apparatus while a delivery member, moved from the outside of the powder containing unit to the opening portion, is biased in a direction opposite to the movement direction, the delivery member to contact a flexible bottom of the powder containing unit, and
wherein when the delivery member contacts the flexible bottom of the powder containing unit and is moved toward the opening portion, the powder is delivered out from the opening portion.

2. The powder container according to claim 1, further comprising:
an air passage which enables passage of air between the inside and the outside of the powder container.

3. The powder container according to claim 2,
wherein the air passage is included in the powder containing unit.

4. The powder container according to claim 3,
wherein the air passage is included at an upper surface of the powder containing unit.

5. The powder container according to claim 2,
wherein the air passage is included in the discharging unit.

6. The powder container according to claim 5,
wherein the air passage is included in an upper surface of the discharging unit and opposes a discharge port included in the discharging unit.

7. The powder container according to claim 1, wherein the securing section of the powder containing unit includes a hooking portion to be hooked by the fixing portion of the powder conveying apparatus.

8. The powder container according to claim 7, wherein the hooking portion includes a through hole.

9. The powder container according to claim 7, wherein the hooking portion is a member that is arranged on the powder containing unit and is different from a member of the powder containing unit.

10. A powder conveying apparatus, comprising:
a powder container including a powder containing unit;
a delivery member; and
a fixing portion,
wherein the powder containing unit is installed in the powder conveying apparatus and:
includes an opening portion at one end portion thereof,
includes a securing section which secures the powder containing unit, the securing section being at an opposite end of the powder containing unit as the opening portion,
includes powder therein,
is formed of a flexible material so as to be deformable,
has a longitudinal direction which is oriented horizontally; and
includes a discharging unit which is disposed at the end portion at the opening portion,
is fixed to the powder conveying apparatus, and
discharges the powder delivered from the opening portion out to the powder conveying apparatus,
wherein the securing section of the powder containing unit is fixed to the fixing portion of the powder conveying apparatus and is biased in a direction opposite to a movement direction of the delivery member, and
wherein when the delivery member contacts a flexible bottom of the powder containing unit and is moved toward the opening portion, the powder is delivered out from the opening portion.

11. The powder conveying apparatus according to claim 10, wherein:
the fixing portion is movable toward the discharging unit and movable in an opposite direction thereto, and
the fixing portion is biased toward the direction opposite of the discharging unit through an elastic member.

12. The powder conveying apparatus according to claim 10,
wherein the powder container includes an air passage which enables passage of air between the inside and the outside of the powder container.

13. The powder conveying apparatus according to claim 12,
wherein the air passage is included in the powder containing unit.

14. The powder conveying apparatus according to claim 13,
wherein the air passage portion is included at an upper surface of the powder containing unit.

15. The powder conveying apparatus according to claim 12,
wherein the air passage portion is included in the discharging unit.

16. The powder conveying apparatus according to claim 15, wherein the air passage portion is included at an upper surface of the discharging unit, and at a position opposing a discharge port included in the discharging unit.

17. An image forming apparatus comprising:

the powder conveying apparatus according to claim 10.

18. The powder conveying apparatus according to claim 10, wherein the securing section of the powder containing unit includes a hooking portion to be hooked by the fixing portion of the powder conveying apparatus.

19. The powder conveying apparatus according to claim 18, wherein the hooking portion includes a through hole.

* * * * *

UNITED STATES PATENT AND TRADEMARK OFFICE

CERTIFICATE OF CORRECTION

PATENT NO. : 8,953,986 B2
APPLICATION NO. : 13/643718
DATED : February 10, 2015
INVENTOR(S) : Keiichi Yoshida et al.

It is certified that error appears in the above-identified patent and that said Letters Patent is hereby corrected as shown below:

On the Title Page, col. 1, item (87), replace the PCT Pub. Date --Mar. 11, 2011-- with --Nov. 3, 2011--

Signed and Sealed this
Fourteenth Day of July, 2015

Michelle K. Lee

Michelle K. Lee
*Director of the United States Patent and Trademark Office*